US011293071B2

(12) United States Patent
Nakamura et al.

(10) Patent No.: US 11,293,071 B2
(45) Date of Patent: Apr. 5, 2022

(54) HEAT TREATMENT APPARATUS

(71) Applicant: Koyo Thermo Systems Co., Ltd., Nara (JP)

(72) Inventors: Takahiro Nakamura, Tenri (JP); Hiroaki Tetsubayashi, Tenri (JP); Takeshi Ueda, Tenri (JP)

(73) Assignee: Koyo Thermo Systems Co., Ltd., Nara (JP)

( * ) Notice: Subject to any disclaimer, the term of this patent is extended or adjusted under 35 U.S.C. 154(b) by 281 days.

(21) Appl. No.: 16/561,373

(22) Filed: Sep. 5, 2019

(65) Prior Publication Data

US 2020/0080165 A1 Mar. 12, 2020

(30) Foreign Application Priority Data

Sep. 10, 2018 (JP) ..... JP2018-168898

(51) Int. Cl.
*C21D 9/00* (2006.01)
*F27B 9/30* (2006.01)
*F27B 9/10* (2006.01)

(52) U.S. Cl.
CPC ..... *C21D 9/0006* (2013.01); *F27B 9/10* (2013.01); *F27B 9/3005* (2013.01)

(58) Field of Classification Search
CPC ..... C21D 9/0006; F27B 9/10; F27B 9/3005
See application file for complete search history.

(56) References Cited

U.S. PATENT DOCUMENTS 3,770,408 A * 11/1973 McCully ..... C03B 25/06 65/162
4,597,193 A * 7/1986 Kallfass ..... B65B 53/063 34/224
4,941,823 A * 7/1990 Ross ..... F27B 9/10 432/144
2020/0080165 A1* 3/2020 Nakamura ..... F27B 9/3005
2020/0080781 A1* 3/2020 Nakamura ..... F27D 7/04

FOREIGN PATENT DOCUMENTS

JP 6023905 B1 11/2016

* cited by examiner

*Primary Examiner* — Scott R Kastler
(74) *Attorney, Agent, or Firm* — Studebaker & Brackett PC

(57) ABSTRACT

Workpieces are disposed between a pair of side walls in a heat treatment chamber. A centrifugal fan is disposed to face the workpieces inside the heat treatment chamber, and sucks gas from the workpiece side and generates air current. In regions at the respective side wall sides relative to an intermediate position between the pair of side walls, an air current regulation unit regulates the air current so as to restrict flows of the air current from the centrifugal fan to the respective side wall sides when a rotary blade of the centrifugal fan rotates in regions in which outer circumferential edge portions of the rotating rotary blade separate from the respective side walls, and allows the flows in regions in which the outer circumferential edge portions of the rotating rotary blade approach the respective side walls.

5 Claims, 24 Drawing Sheets

HEAT TREATMENT APPARATUS

CROSS-REFERENCE TO RELATED APPLICATION

This application claims priority to Japanese Patent Application No. 2018-168898. The entire disclosure of Japanese Patent Application No. 2018-168898 is hereby incorporated herein by reference.

TECHNICAL FIELD

The present invention relates to a heat treatment apparatus to apply heat treatment to metallic workpieces.

BACKGROUND ART

Conventionally, a heat treatment apparatus to apply heat treatment to metallic workpieces is known (for example, refer to Patent Document 1). The heat treatment apparatus described in Patent Document 1 includes a heat treatment chamber in which workpieces are disposed, and heaters and a centrifugal fan disposed inside the heat treatment chamber. The heat treatment chamber has a pair of side walls disposed parallel to each other, and the heaters are respectively disposed along the pair of side walls. The centrifugal fan is disposed to face workpieces inside the heat treatment chamber.

The heat treatment apparatus described in Patent Document 1 is configured to apply heat treatment to workpieces disposed inside the heat treatment chamber by heating the atmosphere inside the heat treatment chamber by the heaters. This heat treatment apparatus is configured to suck gas at the workpiece side and generate air current flowing outward in radial directions of the centrifugal fan by rotation of the centrifugal fan. This heat treatment apparatus is configured to stir the atmosphere inside the heat treatment chamber by the air current generated by the centrifugal fan.

CITATION LIST

Patent Document

Patent Document 1: Japanese Patent Publication No. 6023905

SUMMARY OF THE INVENTION

When applying heat treatment to a metallic workpiece, in each of the surface and the inside of the workpiece, if variation in temperature change state occurs among the respective portions of the workpiece during the heat treatment, variation in thermal stress state occurs among the respective portions, and distortion occurs in this workpiece. As in the case of the heat treatment apparatus described in Patent Document 1, when applying heat treatment by heating to a workpiece, if variation in temperature change state occurs among the respective portions of the workpiece when rising in temperature during the heat treatment, distortion occurs in the workpiece. When applying heat treatment by cooling to the workpiece by performing air cooling, if variation in temperature change state occurs among the respective portions of the workpiece when dropping in temperature during the heat treatment, distortion occurs in the workpiece. Therefore, in order to make smaller the distortion caused by the heat treatment, variation in temperature change state among the respective portions of the workpiece during the heat treatment needs to be reduced.

Temperature change states at the respective portions of the workpiece during heat treatment are greatly influenced by a temperature distribution state of the atmosphere inside the heat treatment chamber when changing in temperature. Therefore, in order to reduce variation in temperature change state among the respective portions of the workpiece during heat treatment, it is desired to entirely efficiently circulate the atmosphere inside the heat treatment chamber during the heat treatment, and in a state where variation in temperature distribution of the atmosphere inside the heat treatment chamber is suppressed, entirely more uniformly change the temperature of the atmosphere inside the heat treatment chamber.

According to the heat treatment apparatus described in Patent Document 1, by rotation of the centrifugal fan disposed to face workpieces inside the heat treatment chamber, gas at the workpiece side is sucked and air current flowing outward in radial directions of the centrifugal fan is generated, and the atmosphere inside the heat treatment chamber is stirred. However, much of the air current that was sucked from the workpiece side and flowed outward in radial directions of the centrifugal fan by the centrifugal fan flows in a direction with less flow resistance. Therefore, when the centrifugal fan rotates between the pair of side walls parallel to each other inside the heat treatment chamber, the air current from the centrifugal fan easily deflects and flows to regions which are at the respective side wall sides relative to an intermediate position between the pair of side walls inside the heat treatment chamber and in which outer circumferential edge portions of the rotating rotary blade separate from the respective side walls. In this way, if a flow deflected to a region with less flow resistance is generated between the pair of side walls, it becomes difficult to entirely efficiently circulate the atmosphere inside the heat treatment chamber during heat treatment. Therefore, variation in temperature distribution of the atmosphere inside the heat treatment chamber easily occurs, and it becomes difficult to entirely more uniformly change the temperature of the atmosphere inside the heat treatment chamber during heat treatment. As a result, in each of the surface and the inside of the workpiece, variation in temperature change state occurs among the respective portions of the workpiece, variation in stress state occurs among the respective portions, and distortion easily occurs in the workpiece.

In view of the circumstances described above, an object of the present invention is to provide a heat treatment apparatus capable of reducing variation in temperature change state among the respective portions of a metallic workpiece during heat treatment, and making smaller distortion caused by the heat treatment when applying the heat treatment to the workpiece.

(1) In order to solve the above-described problem, a heat treatment apparatus according to an aspect of the present invention includes a heat treatment chamber having a pair of side walls disposed parallel to each other and configured so that a metallic workpiece as a heat treatment target is disposed between the pair of side walls, a centrifugal fan disposed to face the workpiece inside the heat treatment chamber and configured to suck gas from the workpiece side and generate air current, and an air current regulation unit configured to regulate, in regions at the respective side wall sides relative to an intermediate position between the pair of side walls inside the heat treatment chamber, flows of the air current from the centrifugal fan to the respective side wall sides when a rotary blade of the centrifugal fan rotates, so as to restrict the flows in regions in which outer circumferential edge portions of the rotating rotary blade separate from the respective side walls, and allow the flows of the air current in regions in which the outer circumferential edge portions of the rotating rotary blade approach the respective side walls.

According to this configuration, between the pair of side walls parallel to each other in the heat treatment chamber, by rotation of the centrifugal fan disposed to face a workpiece, gas at the workpiece side is sucked and air current flowing outward in radial directions of the centrifugal fan is generated. Then, the air current that was sucked from the workpiece side and flowed outward in radial directions of the centrifugal fan by the centrifugal fan flows while being regulated by the air current regulation unit. Specifically, in regions which are at the respective side wall sides relative to an intermediate position between the pair of side walls inside the heat treatment chamber and in which outer circumferential edge portions of the rotating rotary blade separate from the respective side walls, flows of the air current from the centrifugal fan to the respective side wall sides are restricted. In regions which are at the respective side wall sides relative to the intermediate position between the pair of side walls inside the heat treatment chamber and in which the outer circumferential edge portions of the rotating rotary blade approach the respective side walls, flows of the air current from the centrifugal fan to the respective side wall sides are allowed. Accordingly, when the centrifugal fan rotates between the pair of side walls parallel to each other in the heat treatment chamber, air current that was sucked from the workpiece side and flowed outward in radial directions of the centrifugal fan further flows along the respective side walls while flowing toward the respective side walls due to an air blowing operation caused by rotation of the centrifugal fan and an air current flow direction regulating operation of the air current regulation unit. The air current that flowed along the respective side walls passes through the workpiece and is sucked by the centrifugal fan, and flows outward in radial directions of the centrifugal fan again. Accordingly, during heat treatment, the atmosphere inside the heat treatment chamber entirely efficiently circulates and flows so as to flow along the respective side walls after passing through the workpiece, and pass through the workpiece again. Therefore, according to the configuration described above, conventional generation of a flow deflected to a region having less flow resistance between the pair of side walls can be suppressed, and the atmosphere inside the heat treatment chamber can be entirely efficiently circulated during heat treatment. According to the configuration described above, during heat treatment, the atmosphere inside the heat treatment chamber can be entirely efficiently circulated, and in a state where variation in temperature distribution of the atmosphere inside the heat treatment chamber is suppressed, the atmosphere inside the heat treatment chamber can be entirely more uniformly changed in temperature. Accordingly, in each of the surface and the inside of the workpiece, variation in temperature change state among the respective portions of the workpiece during heat treatment is reduced, variation in stress state among the respective portions is reduced, and distortion due to the heat treatment can be made smaller.

Therefore, according to the configuration described above, a heat treatment apparatus capable of reducing variation in temperature change state among the respective portions of a metallic workpiece during heat treatment, and making smaller distortion caused by the heat treatment when applying the heat treatment to the workpiece can be provided.

(2) The heat treatment apparatus may further include a pair of heaters disposed along each of the pair of side walls inside the heat treatment chamber, and the centrifugal fan and the workpiece may be disposed between the pair of heaters.

According to this configuration, the atmosphere inside the heat treatment chamber is heated by the pair of heaters disposed along the pair of side walls, and heat treatment by heating is applied to a workpiece disposed inside the heat treatment chamber. According to the configuration described above, when the centrifugal fan rotates between the pair of heaters disposed along the pair of side walls parallel to each other in the heat treatment chamber, air current that was sucked from the workpiece side and flowed outward in radial directions of the centrifugal fan further flows along the respective side walls and the respective heaters while flowing toward the respective side walls and the respective heaters due to an air blowing operation caused by rotation of the centrifugal fan and an air current flow direction regulating operation of the air current regulation unit. The air current that flowed along the respective side walls and the respective heaters passes through the workpiece and is sucked by the centrifugal fan, and flows outward in radial directions of the centrifugal fan again. Accordingly, during heat treatment by heating, the atmosphere inside the heat treatment chamber entirely efficiently circulates and flows so as to flow along the respective side walls and the respective heaters after passing through the workpiece, and pass through the workpiece again. Therefore, according to the configuration described above, generation of a flow deflected to a region with less flow resistance between the pair of heaters respectively disposed along the pair of side walls can be suppressed, and the atmosphere inside the heat treatment chamber can be entirely efficiently circulated during heat treatment by heating. According to the configuration described above, during heat treatment by heating, the atmosphere inside the heat treatment chamber can be entirely efficiently circulated, and in a state where variation in temperature distribution of the atmosphere inside the heat treatment chamber when rising in temperature is suppressed, the atmosphere inside the heat treatment chamber can be entirely more uniformly raised and changed in temperature. Accordingly, in each of the surface and the inside of the workpiece, variation in temperature change state among the respective portions of the workpiece when the respective portions rise in temperature during heat treatment is reduced, variation in stress state among the respective portions is reduced, and distortion due to the heat treatment during heating can be made smaller.

(3) The heat treatment chamber may include a first side wall and a second side wall as the pair of side walls, the air current regulation unit may include a first air current restricting member and a second air current restricting member, the first air current restricting member may restrict a flow of the air current from the centrifugal fan to the first side wall side in a region which is at the first side wall side relative to the intermediate position inside the heat treatment chamber and in which outer circumferential edge portions of the rotary blade separate from the first side wall when the rotary blade rotates, and the second air current restricting member may restrict a flow of the air current from the centrifugal fan to the second side wall side in a region which is at the second side wall side relative to the intermediate position inside the heat treatment chamber and in which the outer circumferential edge portions of the rotary blade separate from the second side wall when the rotary blade rotates.

According to this configuration, the air current regulation unit consists of the first and second air current restricting members. A flow of the air current from the centrifugal fan to the first side wall side in the region in which the outer circumferential edge portions of the rotary blade of the centrifugal fan separate from the first side wall is restricted by the first air current restricting member. A flow of the air current from the centrifugal fan to the second side wall side in the region in which the outer circumferential edge portions of the rotary blade of the centrifugal fan separate from the second side wall is restricted by the second air current restricting member. Therefore, according to the configuration described above, the air current regulation unit can be realized by a simple structure provided with two members including the first and second air current restricting members.

(4) Each of the first air current restricting member and the second air current restricting member may include a curved wall surface curved and disposed along an outer circumference of the centrifugal fan.

According to this configuration, each of the first and second air current restricting members includes a curved wall surface curved and disposed along an outer circumference of the centrifugal fan. Therefore, when flows of the air current from the centrifugal fan to the respective side wall sides are restricted by the respective first and second air current restricting members, the air current whose flow direction is restricted smoothly flows along the curved wall surfaces curved and disposed along the outer circumference of the centrifugal fan. Therefore, an increase in pressure loss when flows of the air current from the centrifugal fan to the respective side wall sides are restricted by the respective first and second air current restricting members can be suppressed.

(5) A first curved wall surface as the curved wall surface of the first air current restricting member and a second curved wall surface as the curved wall surface of the second air current restricting member may be disposed to face each other across the centrifugal fan, and dimensions of the first curved wall surface and the second curved wall surface in a direction extending from the workpiece side toward the opposite side of the workpiece side may be larger than those of the rotary blade of the centrifugal fan.

According to this configuration, the first and second curved wall surfaces have dimensions set to be larger than those of the rotary blade of the centrifugal fan in a direction extending from the workpiece side toward the opposite side of the workpiece side. That is, heights of the respective first and second curved wall surfaces are set to be larger than a height of the rotary blade of the centrifugal fan. Therefore, by the first and second air current restricting members provided with the respective curved wall surfaces, the air current that was sucked from the workpiece side and flowed outward in radial directions of the centrifugal fan by the centrifugal fan can be more completely regulated, and flow directions of the air current can be more stably regulated.

(6) The first curved wall surface and the second curved wall surface may be provided so as to extend and approach each other toward the outer circumferential edge portions of the rotary blade of the centrifugal fan from the workpiece side to the opposite side of the workpiece side.

According to this configuration, the first and second curved wall surfaces are configured to separate at the workpiece side as a sucking side at which gas is sucked by the centrifugal fan, and approach each other toward the opposite side of the sucking side. That is, a region between the first and second curved wall surfaces disposed to face each other across the centrifugal fan is set to be wide at the sucking side region at which gas is sucked by the centrifugal fan, and narrow at the opposite side region of the sucking side. Therefore, when gas at the workpiece side is sucked and air current flowing outward in radial directions of the centrifugal fan and regulated in flow direction by the air current regulation unit is generated, flows of the air current can be made faster in speed. That is, flows of the air current blown by rotation of the centrifugal fan and regulated in flow direction by the air current regulation unit so as to flow toward the respective side walls can be made faster in speed. Accordingly, the atmosphere inside the heat treatment chamber can be entirely more efficiently circulated during heat treatment.

The above-described and other objects, features, and advantages in the present invention will be clarified by reading the description given below along with the accompanying drawings.

BRIEF DESCRIPTION OF THE DRAWINGS

FIG. 8A illustrates a case where the shielding member is in a shielding state, and FIG. 8B illustrates a case where the shielding member is in a radiation state.

FIG. 11A is a view of the centrifugal fan and the air current regulation unit viewed from a horizontal direction, and FIG. 11B is a view of the centrifugal fan and the air current regulation unit viewed from above.

FIG. 17A illustrates temperature measurement results in an example, and FIG. 17B illustrates temperature measurement results in a comparative example.

FIG. 18A illustrates temperature measurement results in an example, and FIG. 18B illustrates temperature measurement results in a comparative example.

EMBODIMENTS OF THE INVENTION

Hereinafter, an embodiment of the present invention will be described with reference to the drawings.

[Outline of Heat Treatment Apparatus]

Figure 1:
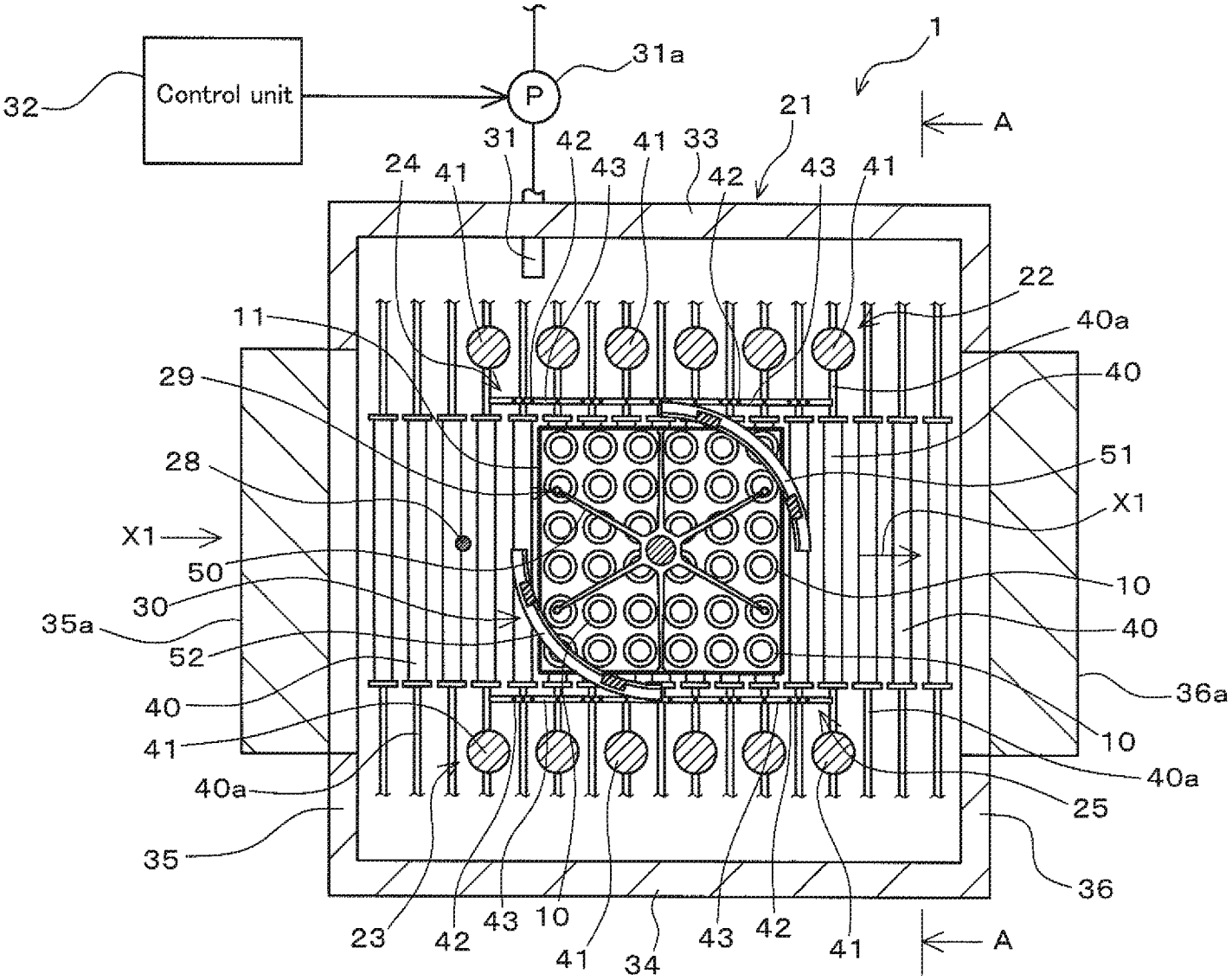
FIG. 1 is a schematic sectional view of a heat treatment apparatus according to an embodiment of the present invention, illustrating a state viewed from the arrow line B-B position in FIG. 2.
Figure 2:
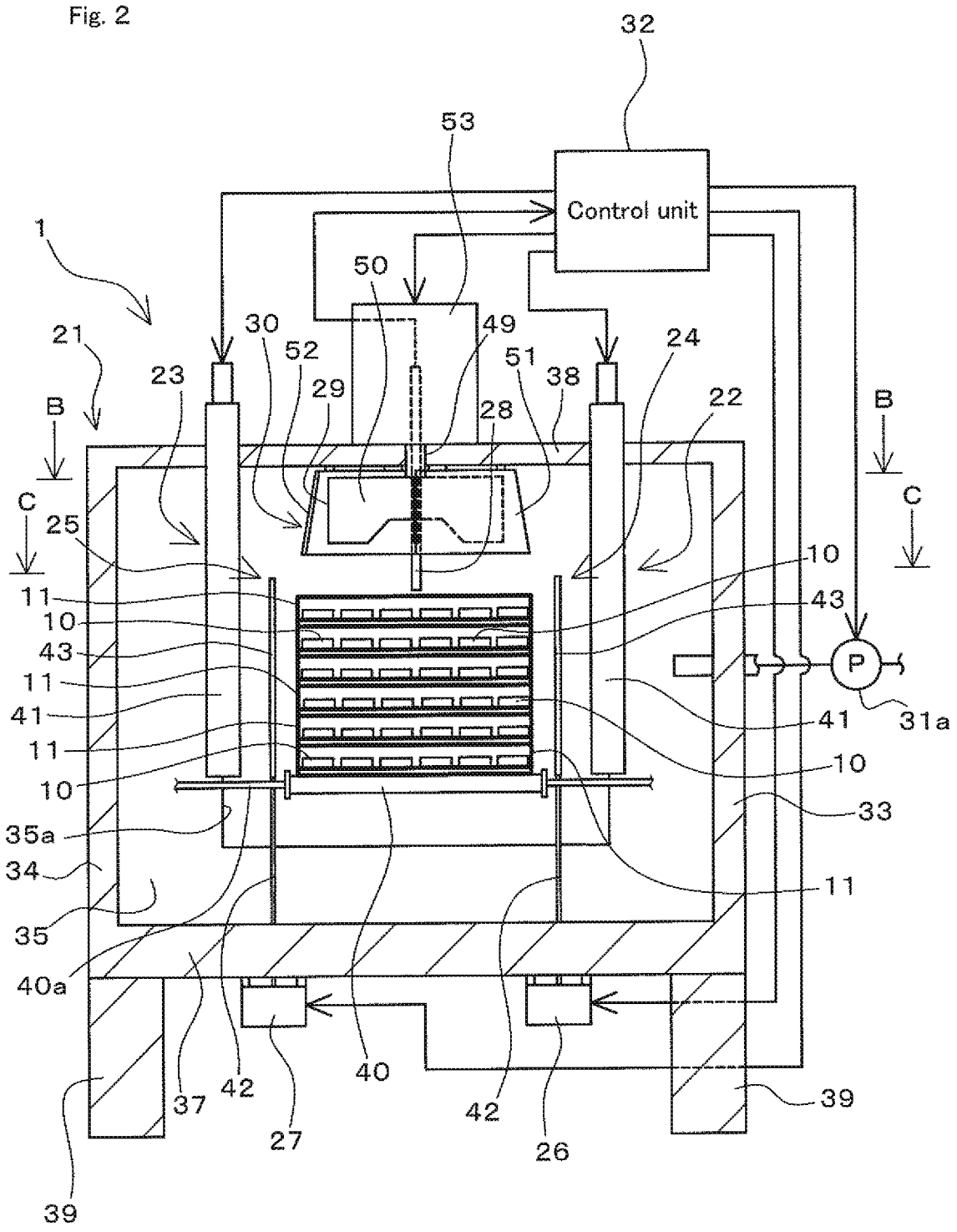
FIG. 2 is a schematic sectional view of the heat treatment apparatus, illustrating a state viewed from the arrow line A-A position in FIG. 1.
Figure 3:
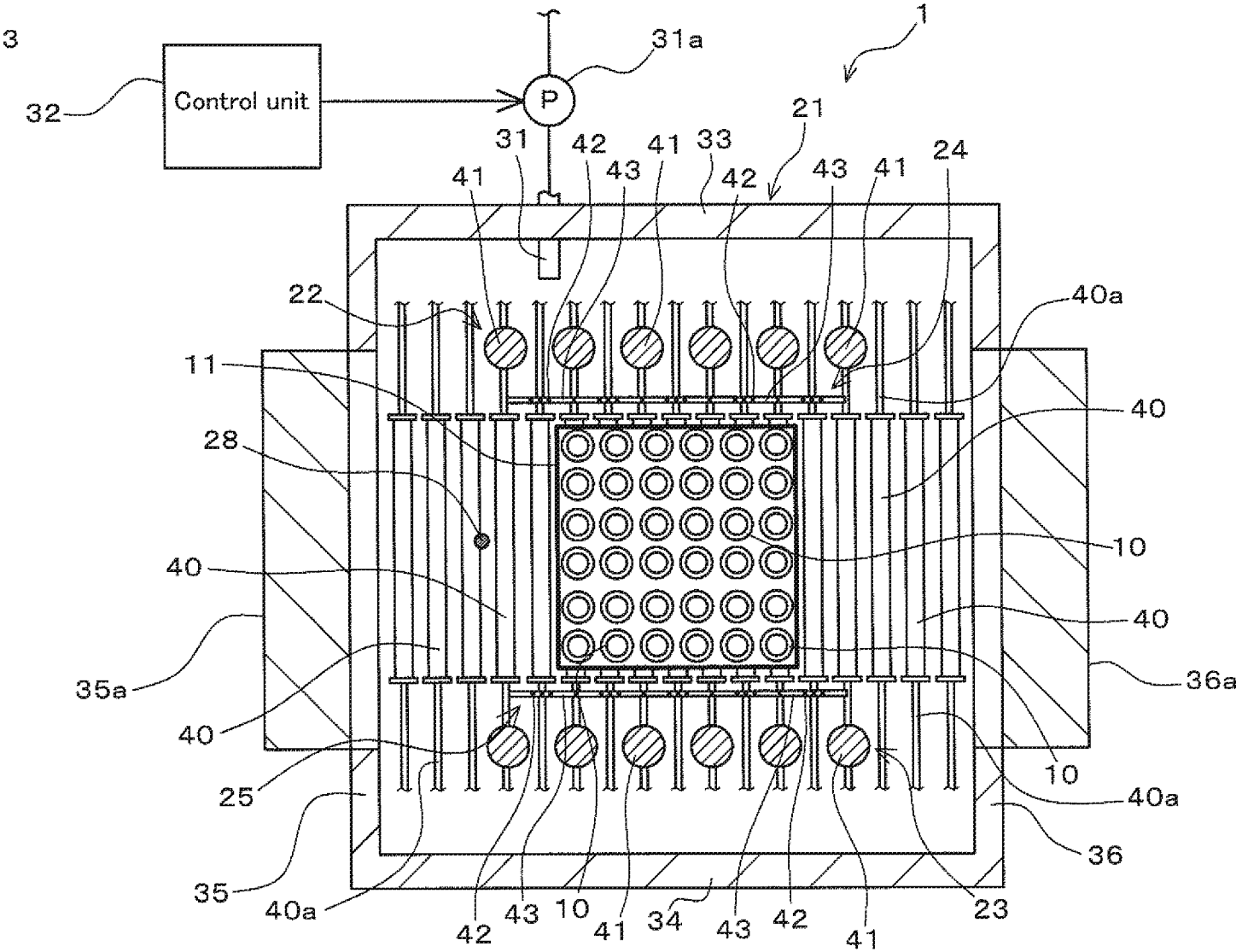
FIG. 3 is a schematic sectional view of the heat treatment apparatus, illustrating a state viewed from the arrow line C-C position in FIG. 2.

FIG. 1 is a schematic sectional view of a heat treatment apparatus 1 according to an embodiment of the present invention, illustrating a state viewed from the arrow line B-B position in FIG. 2. FIG. 2 is a schematic sectional view of the heat treatment apparatus 1, illustrating a state viewed from the arrow line A-A position in FIG. 1. FIG. 3 is a schematic sectional view of the heat treatment apparatus 1, illustrating a state viewed from the arrow line C-C position in FIG. 2.

Referring to FIG. 1 to FIG. 3, the heat treatment apparatus 1 is provided as an apparatus to apply heat treatment by heating to metallic workpieces 10. Heat treatment by the heat treatment apparatus 1 is carburizing treatment, quenching treatment, tempering treatment, and annealing treatment, etc., by way of example. In the present embodiment, description is given by using a case where the heat treatment apparatus 1 is a heat treatment apparatus to apply gas carburizing treatment by way of example.

Figure 4:
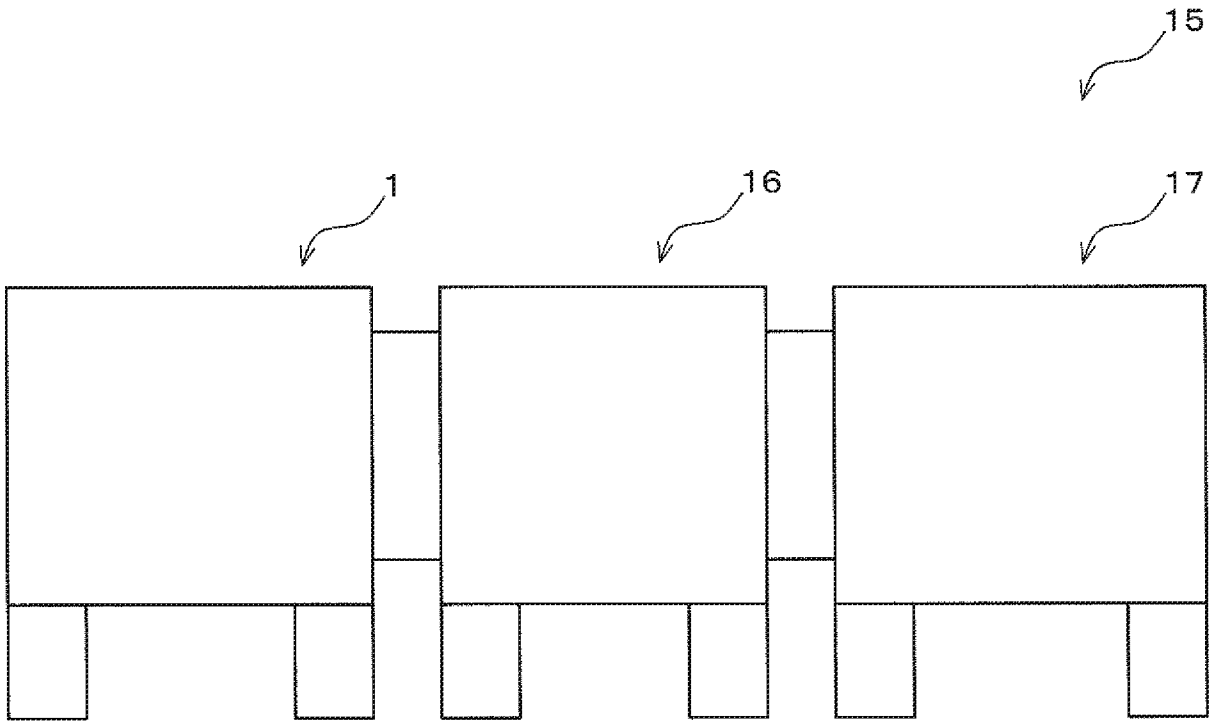
FIG. 4 is a view schematically illustrating an example of a heat treatment system including the heat treatment apparatus.

The heat treatment apparatus 1 may be used alone. Alternatively, the heat treatment apparatus 1 may be combined with other heat treatment apparatuses, and may be used as a part of a heat treatment system including a plurality of heat treatment apparatuses. FIG. 4 is a view schematically illustrating an example of a heat treatment system 15 including the heat treatment apparatus 1. The heat treatment system 15 includes the heat treatment apparatus 1 for gas carburizing treatment, a quenching apparatus 16, and a tempering apparatus 17. When treatment is applied to workpieces 10 by the heat treatment system 15, first, heat treatment as carburizing treatment is applied to the workpieces 10 by the heat treatment apparatus 1. Next, the workpieces 10 subjected to carburizing treatment are conveyed to the quenching apparatus 16, and subjected to quenching treatment in the quenching apparatus 16. Then, when quenching treatment ends, the workpieces 10 are conveyed to the tempering apparatus 17, and subjected to tempering treatment in the tempering apparatus 17. When tempering treatment ends, the heat treatment of the workpieces 10 by the heat treatment system 15 ends, and the workpieces 10 are carried out of the heat treatment system 15.

The workpiece 10 is provided as a metallic member as a heat treatment target, and in the present embodiment, provided as a metallic member as a heating treatment target. Also, in the present embodiment, the workpiece 10 is formed as carbon steel, and provided as a ring-shaped member having a cylindrical shape whose height is smaller than a diameter. The workpiece 10 is formed as, for example, carbon steel with a carbon content (carbon potential) of approximately 0.2%. The ring-shaped workpiece 10 is, for example, a race member such as an outer race or an inner race of a roller bearing, a gear such as a spur wheel, a roller, a shaft, or a washer of a roller bearing, etc., by way of example. In the present embodiment, a case where the workpiece 10 is formed as a ring-shaped member made of carbon steel is described by way of example, however, other cases are also possible. The workpiece 10 may be formed as a member made of metal other than carbon steel, or may be formed as a member having a shape other than a ring shape.

When the workpiece 10 is subjected to heat treatment by the heat treatment apparatus 1, in a state where the workpiece 10 is disposed inside a case 11 formed into, for example, a thin box shape, heat treatment is applied. In the case 11, a plurality of workpieces 10 are stored while being spread and disposed at substantially even intervals. The workpieces 10 are disposed inside the heat treatment chamber 21 described later in the heat treatment apparatus 1 while being disposed inside the case 11, and subjected to heat treatment by being heated by the atmosphere inside the heat treatment chamber 21. A plurality of cases 11 each storing the plurality of workpieces 10 are stacked (that is, layered in tiers) and disposed inside the heat treatment chamber 21. Accordingly, heat treatment is simultaneously applied to the workpieces 10 stored in each of the plurality of cases 11. FIG. 2 illustrates a state where six cases 11 are stacked and layered.

In the case 11 storing a plurality of workpieces 10, in order to enable surrounding gas to pass through with almost no resistance, for example, a number of holes formed in a circumferential side surface and a bottom surface and openings formed in an upper surface are provided. Accordingly, gas in the atmosphere inside the heat treatment chamber 21 flows to pass through the case 11, and gas in the atmosphere inside the heat treatment chamber 21 flows around the workpieces 10 disposed inside the cases 11. The case 11 is only required to have a structure that enables gas in the atmosphere inside the heat treatment chamber 21 to pass through the case 11, and may be formed of, for example, a meshed member.

The heat treatment apparatus 1 is configured to include a heat treatment chamber 21, heaters (22, 23), shielding members (24, 25), switching drive units (26, 27), a temperature measuring unit 28, a centrifugal fan (fan) 29, an air current regulation unit 30, an atmosphere gas supply unit 31, and a control unit 32, etc.

[Heat Treatment Chamber]

Referring to FIG. 1 to FIG. 3, the heat treatment chamber 21 includes a pair of side walls (33, 34), a front wall 35, a rear wall 36, a bottom wall 37, a ceiling wall 38, and a plurality of leg portions 39, etc. The pair of side walls (33, 34), the front wall 35, the rear wall 36, the bottom wall 37, and the ceiling wall 38 constitute a hollow box-shaped portion. The plurality of leg portions 39 are provided at a lower end portion of the hollow box-shaped portion, and are configured to support the hollow box-shaped portion. The heat treatment chamber 21 is provided as a heat treatment furnace to apply heat treatment to workpieces 10 disposed inside the hollow box-shaped portion.

The pair of side walls (33, 34) are disposed parallel to each other, and are configured as a first side wall 33 and a second side wall 34. That is, the heat treatment chamber 21 has the first side wall 33 and the second side wall 34 as the pair of side walls (33, 34). The first side wall 33 and the second side wall 34 are respectively provided as wall portions extending in the up-down direction.

The front wall 35 and the rear wall 36 are disposed parallel to each other, and respectively provided as wall portions spreading perpendicularly with respect to the pair of side walls (33, 34), and extending in the up-down direction. The front wall 35 is provided so as to integrally couple ones of both end portions extending in the up-down direction in the pair of side walls (33, 34). The rear wall 36 is provided so as to integrally couple the others of both end portions extending in the up-down direction in the pair of side walls (33, 34). In the front wall 35, an inlet door 35*a* is provided, and in the rear wall 36, an outlet door 36*a* is provided. The bottom wall 37 is provided as a wall portion to partition a bottom portion of the heat treatment chamber 21, and is provided so as to integrally couple lower end portions of the pair of side walls (33, 34), the front wall 35, and the rear wall 36. From the bottom wall 37, the plurality of leg portions 39 are provided so as to extend downward from a lower end surface of the bottom wall 37. The ceiling wall 38 is provided as a wall portion to demarcate a ceiling portion of the heat treatment chamber 21, and are provided so as to integrally couple upper end portions of the pair of side walls (33, 34), the front wall 35, and the rear wall 36.

In the heat treatment chamber 21, the heaters (22, 23), the shielding members (24, 25), the temperature measuring unit 28, the centrifugal fan (fan) 29, and the air current regulation unit 30 described later are disposed. In addition, in the heat treatment chamber 21, a plurality of conveyance rollers 40 to convey the cases 11 storing the workpieces 10 inside the heat treatment chamber 21 are provided.

Each of the plurality of conveyance rollers 40 is provided with a rotary shaft 40*a*, and is installed so as to rotate around the rotary shaft 40*a*. The rotary shafts 40*a* of the plurality of conveyance rollers 40 are disposed so as to extend parallel to each other, and extend along a direction perpendicular to the pair of side walls (33, 34). The rotary shaft 40*a* of each conveyance roller 40 is supported rotatably with respect to the pair of side walls (33, 34). The plurality of conveyance rollers 40 are configured to rotate synchronously by a chain mechanism not illustrated. For example, one end portion of each rotary shaft 40*a* penetrates through the second side wall 34, a sprocket is provided at one end portion of each rotary shaft 40*a* at the outside of the second side wall 34, and this sprocket is configured to rotate by a chain mechanism. The chain mechanism is configured to be driven to circulate by an electric motor that rotates based on a control command from the control unit 32 described later.

At the time of heat treatment of the workpieces 10, in a state where the inlet door 35*a* of the heat treatment chamber 21 is opened, the workpieces 10 disposed inside the cases 11 are carried together with the cases 11 into the heat treatment chamber 21 from the outside of the heat treatment chamber 21. Then, the workpieces 10 carried into the heat treatment chamber 21 are disposed between the pair of side walls (33, 34). The cases 11 that store the workpieces 10 and were carried into the heat treatment chamber 21 are disposed on the plurality of conveyance rollers 40. Then, by rotation of the plurality of conveyance rollers 40, the cases 11 storing the workpieces 10 are conveyed in a traveling direction X1 as a direction from the inlet door 35*a* toward the outlet door 36*a*. The traveling direction X1 is denoted by an arrow X1 in FIG. 1. When the cases 11 are conveyed to a substantially central portion of the inside of the heat treatment chamber 21 by rotation of the plurality of conveyance rollers 40, the conveyance by the plurality of conveyance rollers 40 is stopped, and heat treatment is applied. During heat treatment of the workpieces 10 inside the heat treatment chamber 21, the inlet door 35*a* and the outlet door 36*a* are closed. When the heat treatment inside the heat treatment chamber 21 ends, the outlet door 36*a* is opened, and the cases 11 storing the workpiece 10 are conveyed along the traveling direction X1 by rotation of the plurality of conveyance rollers 40. Then, in a state where the outlet door 36*a* is opened, the workpieces 10 disposed inside the cases 11 are carried out of the inside of the heat treatment chamber 21 to the outside of the heat treatment chamber 21 together with the cases 11.

[Heater]

Referring to FIG. 1 to FIG. 3, the heaters (22, 23) are provided to heat the workpieces 10 as heating treatment targets, and are disposed inside the heat treatment chamber 21. The heaters (22, 23) are configured to apply heat treatment by heating to the workpieces 10 disposed inside the heat treatment chamber 21 by heating the atmosphere inside the heat treatment chamber 21. The heaters (22, 23) are provided in a pair, and are provided as a first heater 22 and a second heater 23. Inside the heat treatment chamber 21, the first heater 22 is disposed along the first side wall 33, and the second heater 23 is disposed along the second side wall 34. That is, in the heat treatment apparatus 1, a pair of heaters (22, 23) disposed along each of the pair of side walls (33, 34) inside the heat treatment chamber 21 are provided.

Each of the first heater 22 as one of the pair of heaters (22, 23) and the second heater 23 as the other each includes a plurality of heating elements 41. That is, the first heater 22 includes a plurality of heating elements 41, and the second heater 23 also includes a plurality of heating elements 41.

Each heating element 41 of the first and second heaters (22, 23) has a substantially circular sectional shape, and is provided so as to extend straight downward from the ceiling wall 38 of the heat treatment chamber 21 to a position above the conveyance rollers 40. The plurality of heating elements 41 of the first heater 22 are juxtaposed along the first side wall 33, and are disposed at even intervals along a direction parallel to the first side wall 33. The plurality of heating elements 41 of the second heater 23 are juxtaposed along the second side wall 34, and are disposed at even intervals along a direction parallel to the second side wall 34.

Each heating element 41 of the first and second heaters (22, 23) includes a cylindrical tube, and an electric heating body that is disposed inside the tube and converts electric energy supplied from a power source not illustrated into heat energy. The tube is provided to transmit heat generated by power supply to the electric heating body disposed inside the tube to the atmosphere inside the heat treatment chamber 21. The atmosphere inside the heat treatment chamber 21 is heated by heat generated from the electric heating body inside the tube, and by the heated atmosphere, the workpieces 10 inside the heat treatment chamber 21 are heated. Each heating element 41 of the first and second heaters (22, 23) is configured to perform heating operation based on a control command from the control unit 32. By supplying power to the electric heating body of each heating element 41 based on a control command from the control unit 32, each heating element 41 performs heating operation, and accordingly, the atmosphere inside the heat treatment chamber 21 is heated, and the workpieces 10 inside the heat treatment chamber 21 are heated.

[Temperature Measuring Unit]

Referring to FIG. 1 to FIG. 3, the temperature measuring unit 28 is provided as a temperature sensor to measure a temperature at a predetermined temperature measurement position inside the heat treatment chamber 21. The temperature measuring unit 28 is configured to measure a temperature of the atmosphere inside the heat treatment chamber 21. The temperature measuring unit 28 is installed inside the heat treatment chamber 21 by being attached to an attachment tool extending in a rod shape downward from the ceiling wall 38 inside the heat treatment chamber 21. The temperature measuring unit 28 is disposed at a position near the workpieces 10 disposed inside the heat treatment chamber 21. In the present embodiment, the temperature measuring unit 28 is disposed at a position higher than an upper surface of the top case 11 so as not to come into contact with the cases 11 when the cases 11 storing the workpieces 10 are carried into and carried out of the heat treatment chamber 21.

The temperature measuring unit 28 is connected to the control unit 32, and is configured so that a temperature measurement result by the temperature measuring unit 28 is input into the control unit 32. The control unit 32 controls switching drive units (26, 27) described later based on the temperature measurement result by the temperature measuring unit 28.

[Atmosphere Gas Supply Unit]

The atmosphere gas supply unit 31 is configured to supply an atmosphere gas that is a heat treatment gas to apply desired heat treatment to the workpieces 10 and constitutes the atmosphere inside the heat treatment chamber 21 into the heat treatment chamber 21. The atmosphere gas supply unit 31 has piping connected to the heat treatment chamber 21 and opened inside the heat treatment chamber 21, and this piping is connected to a pump 31*a* and a tank not illustrated. Operation of the pump 31*a* of the atmosphere gas supply unit 31 is controlled by the control unit 32. Accordingly, the atmosphere gas stored in the tank is supplied into the heat treatment chamber 21 by the atmosphere gas supply unit 31. In the present embodiment, as the heat treatment gas, a gas containing carbon such as carbon monoxide (CO) gas is used. A carbon potential (mass %) in this gas is set to be larger than a carbon content of carbon steel as a base material of the workpieces 10.

[Shielding Member]

Referring to FIG. 1 to FIG. 3, the shielding members (24, 25) are disposed between the heaters (22, 23) and the workpieces 10 inside the heat treatment chamber 21, and provided as members capable of shielding radiation of radiation heat from the heaters (22, 23) to the workpieces 10. The shielding members (24, 25) are provided in a pair, and provided as a first shielding member 24 and a second shielding member 25.

Inside the heat treatment chamber 21, the first shielding member 24 is disposed along the first heater 22. The first shielding member 24 is installed so as to be disposed between the first heater 22 and the workpieces 10 in a state where the workpieces 10 stored in the cases 11 are carried into the heat treatment chamber 21 and disposed on the conveyance rollers 40 together with the cases 11. Inside the heat treatment chamber 21, the second shielding member 25 is disposed along the second heater 23. The second shielding member 25 is installed so as to be disposed between the second heater 23 and the workpieces 10 in a state where the workpieces 10 stored in the cases 11 are carried into the heat treatment chamber 21 and disposed on the conveyance rollers 40 together with the cases 11.

The shielding members (24, 25) are configured so that their own states (that is, the states of the shielding members (24, 25)) are switched between a radiation state and a shielding state by being driven by the switching drive units (26, 27) described later. In the radiation state, the shielding members (24, 25) are disposed so as to allow radiation of radiation heat from the heaters (22, 23) to the workpieces 10. On the other hand, in the shielding state, the shielding members (24, 25) are disposed to shield radiation of radiation heat from the heaters (22, 23) to the workpieces 10.

Figure 5:
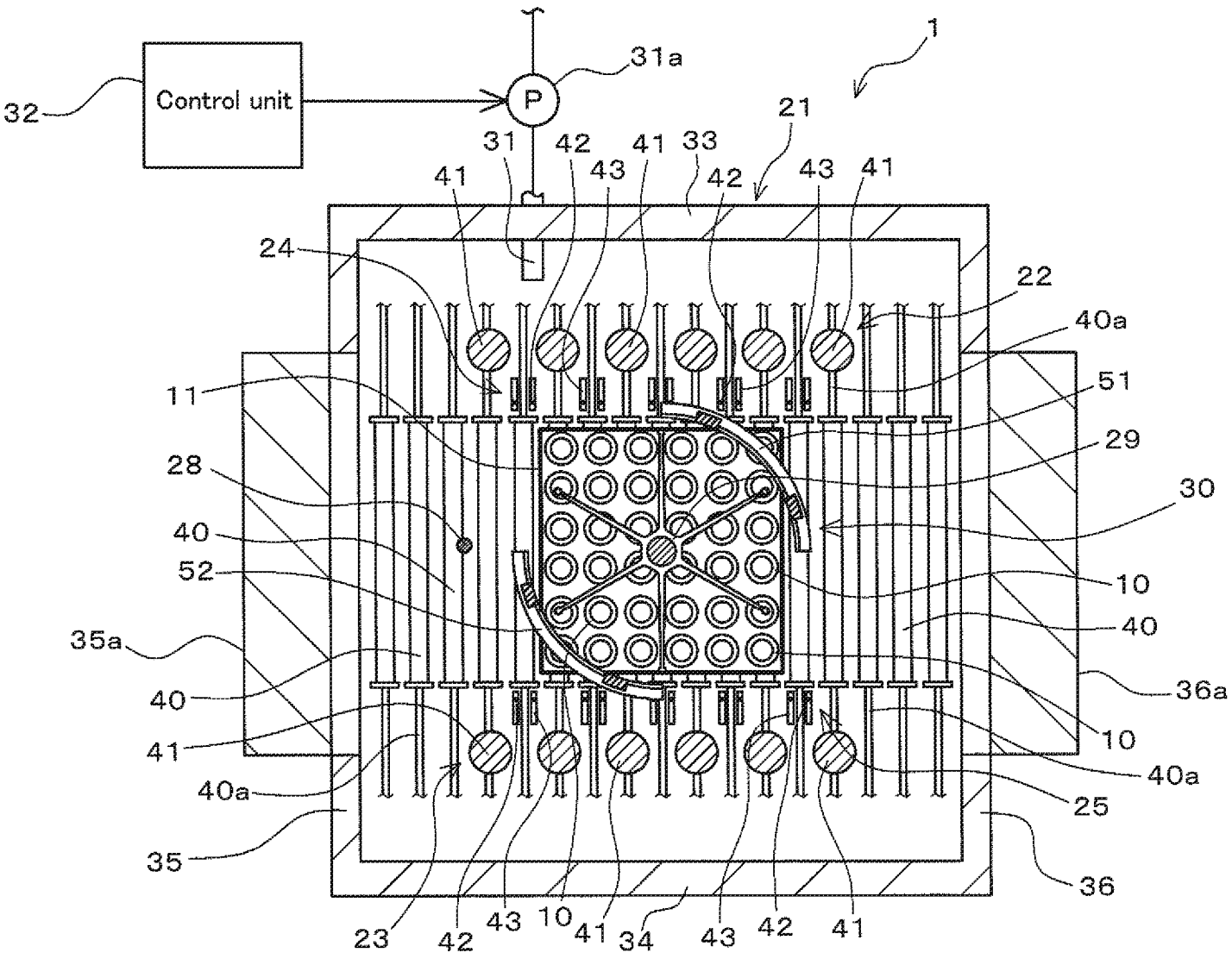
FIG. 5 is a schematic sectional view of the heat treatment apparatus, illustrating a state where states of shielding members in the heat treatment apparatus are different from those in FIG. 1.
Figure 6:
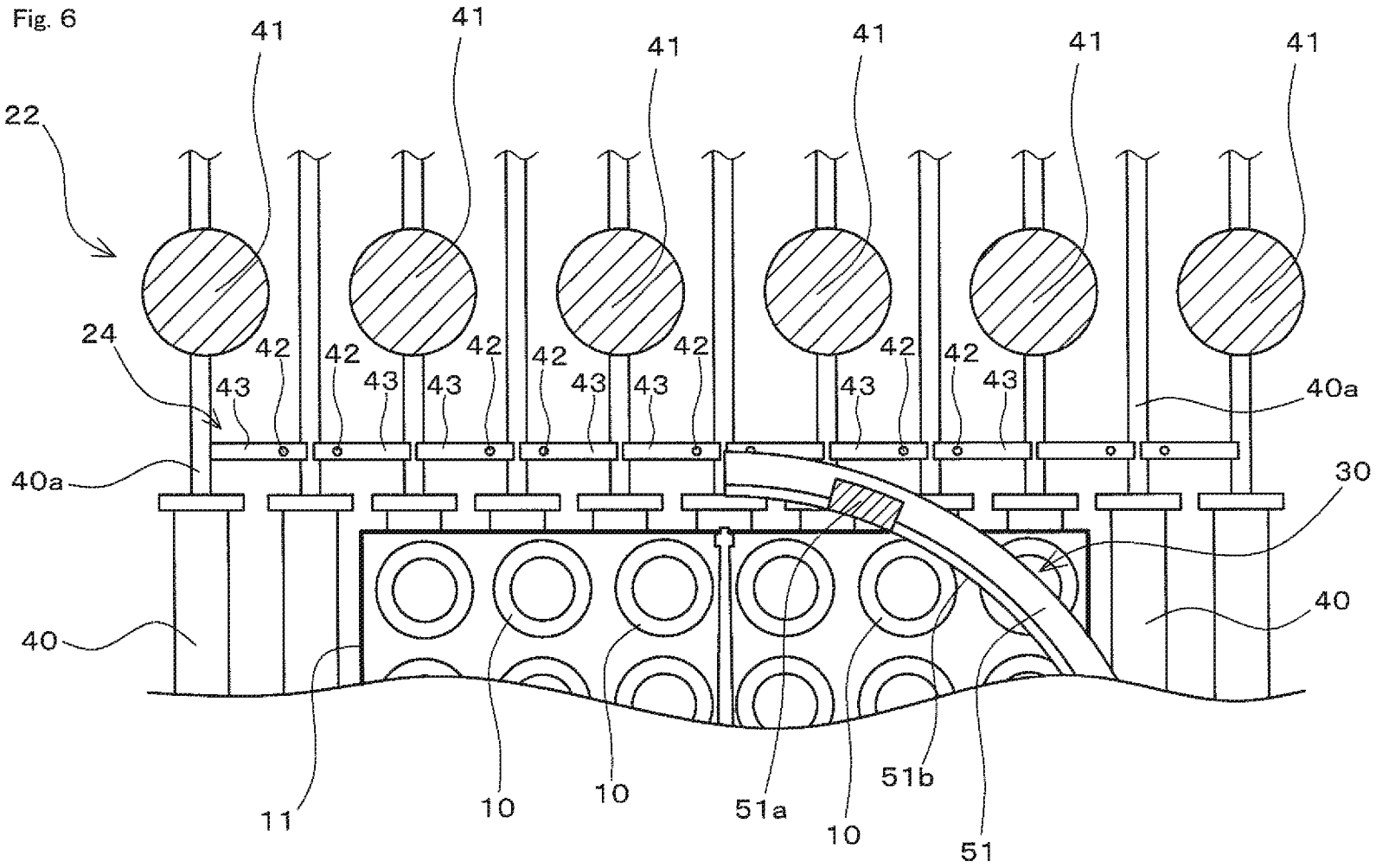
FIG. 6 is an enlarged view of a portion of the heat treatment apparatus, illustrating a case where the shielding member is in a shielding state.
Figure 7:
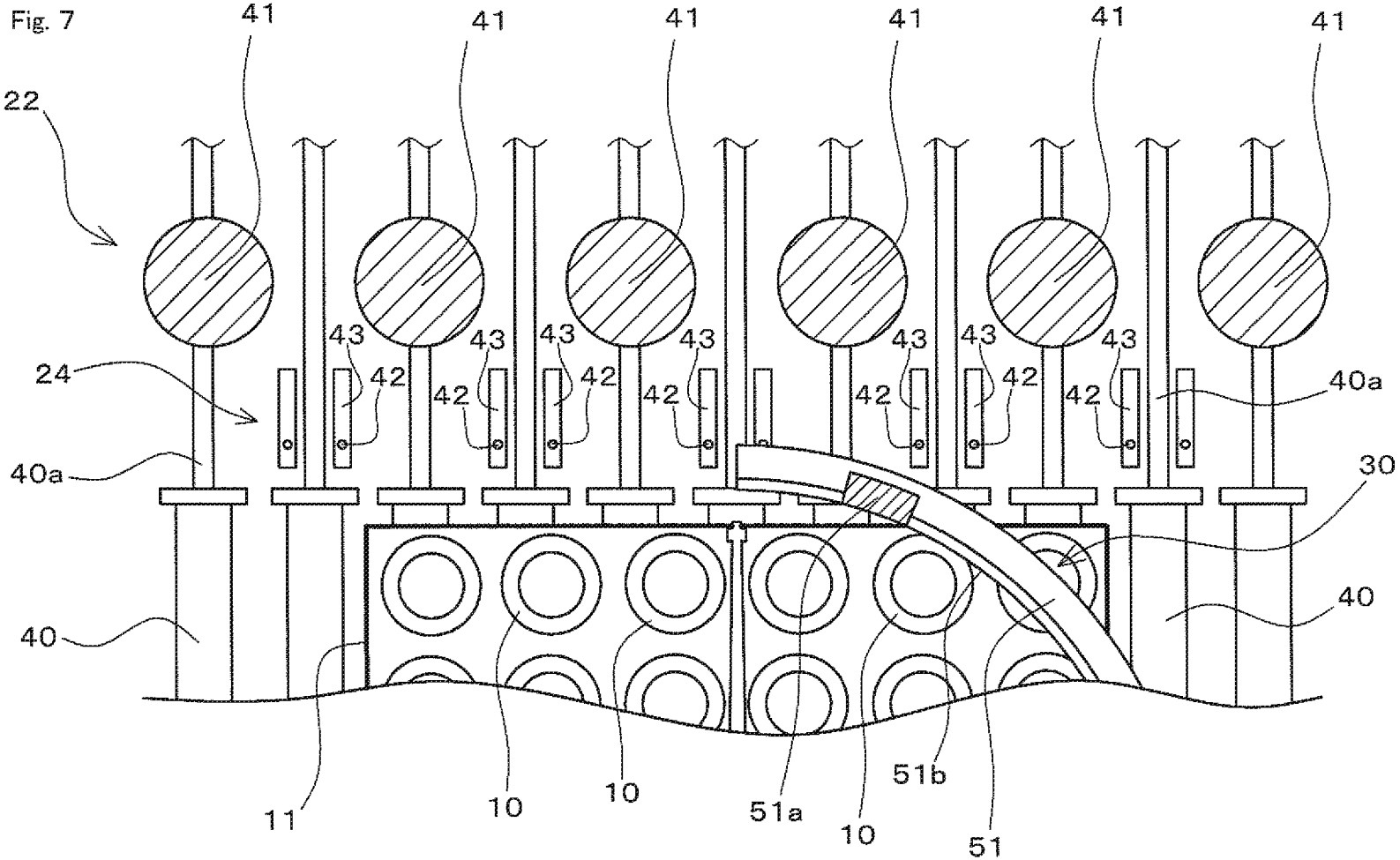
FIG. 7 is an enlarged view of a portion of the heat treatment apparatus, illustrating a case where the shielding member is in a radiation state.
Figure 8A:
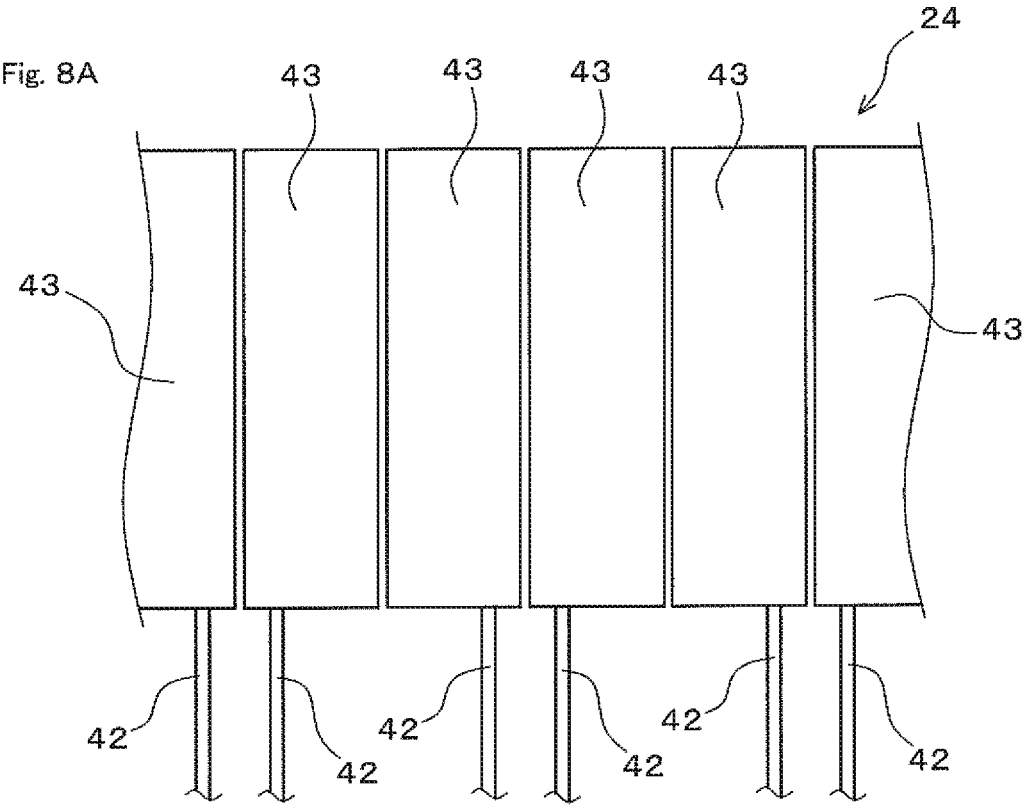
FIGS. 8A and 8B are schematic views of the shielding member.
Figure 8B:
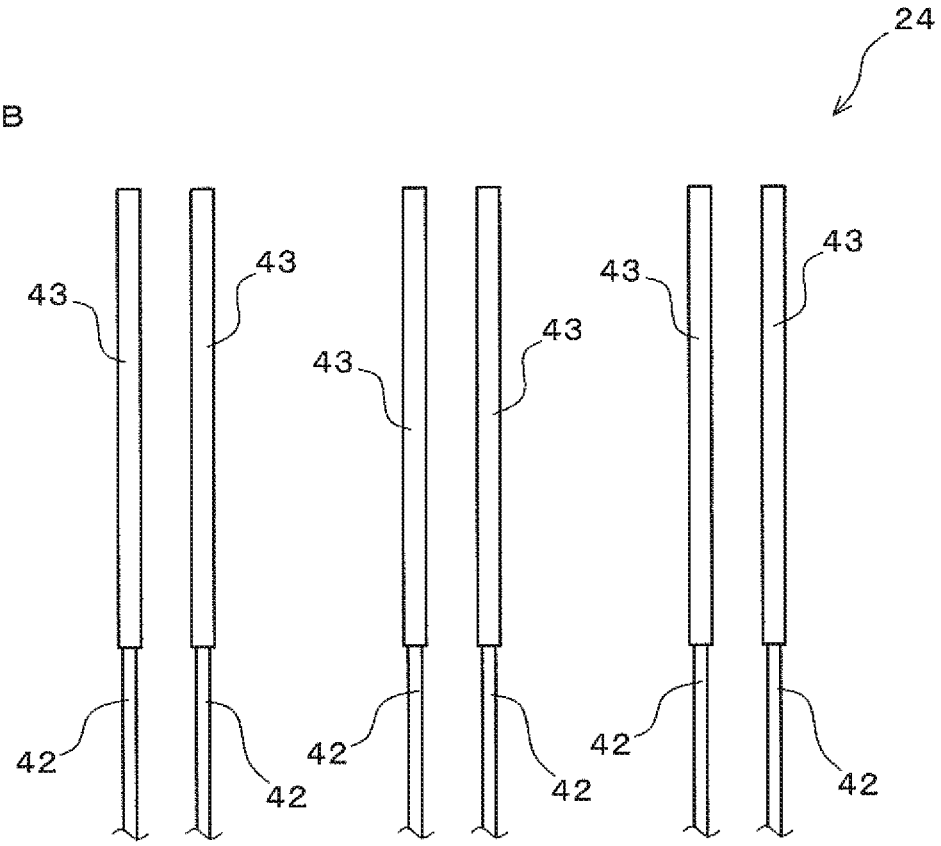

FIG. 5 is a schematic sectional view of the heat treatment apparatus 1, illustrating a state where states of shielding members (24, 25) in the heat treatment apparatus 1 are different from those in FIG. 1. FIG. 1 illustrates a state where the shielding members (24, 25) are in the shielding state, and FIG. 5 illustrates a state where the shielding members (24, 25) are in the radiation state. FIG. 6 is an enlarged view of a portion of the heat treatment apparatus 1, illustrating a case where the first shielding member 24 is in the shielding state. FIG. 7 is an enlarged view of a portion of the heat treatment apparatus 1, illustrating a case where the first shielding member 24 is in the radiation state. FIG. 6 illustrates a portion of FIG. 1 in an enlarged manner, and FIG. 7 illustrates a portion of FIG. 5 in an enlarged manner. FIGS. 8A and 8B are schematic views of the first shielding member 24, FIG. 8A illustrates a case where the first shielding member 24 is in the shielding state, and FIG. 8B illustrates a case where the first shielding member 24 is in the radiation state. FIG. 8A and FIG. 8B schematically illustrate states of the first shielding member 24 viewed from the workpiece 10 side.

Referring to FIG. 1 to FIG. 3 and FIG. 5 to FIG. 8B, each of the shielding members (24, 25) includes a plurality of rotary shafts 42 and a plurality of shielding plates 43. That is, the first shielding member 24 includes a plurality of rotary shafts 42 and a plurality of shielding plates 43, and the second shielding member 25 also includes a plurality of rotary shafts 42 and a plurality of shielding plates 43. In FIG. 6 to FIG. 8B, only the first shielding member 24 is illustrated, however, the second shielding member 25 is also configured in the same manner as the first shielding member 24.

The plurality of rotary shafts 42 in each of the first and second shielding members (24, 25) are respectively provided so as to extend parallel to each other. Each rotary shaft 42 is provided so as to extend straight in the up-down direction, and provided so as to extend in a cantilevered manner upward from the bottom wall 37 inside the heat treatment chamber 21. The plurality of rotary shafts 42 of the first shielding member 24 are juxtaposed along a direction parallel to the first heater 22. The plurality of rotary shafts 42 of the second shielding member 25 are juxtaposed along a direction parallel to the second heater 23. The respective rotary shafts 42 of the first and second shielding members (24, 25) are supported rotatably around central axes. For example, a portion at a lower end side of each rotary shaft 42 penetrates through the bottom wall 37 downward in a rotatable state, and a lower end portion of each rotary shaft 42 is supported rotatably around a central axis by a bearing portion not illustrated.

The plurality of shielding plates 43 in each of the first and second shielding members (24, 25) are respectively fixed to the plurality of rotary shafts 42. Accordingly, the plurality of shielding plates 43 are respectively supported rotatably around the plurality of rotary shafts 42, and provided so as to rotate together with the plurality of the rotary shafts 42. Each of the plurality of shielding plates 43 is provided as a plate-shaped body having a rectangular external shape extending long in the up-down direction.

In the shielding state illustrated in FIG. 1, FIG. 3, FIG. 6, and FIG. 8A, the plurality of shielding plates 43 are disposed so that their surface directions spreading flatly spread along the same plane spreading in a direction parallel to a disposition direction of each heater (22, 23) disposed along a direction parallel to each side wall (33, 34). Therefore, in the shielding state, by the plurality of shielding plates 43 spreading along the same plane, radiation heat from each heater (22, 23) to the workpieces 10 is shielded.

On the other hand, in the radiation state illustrated in FIG. 5, FIG. 7, and FIG. 8B, the plurality of shielding plates 43 are disposed so that their surface directions spreading flatly spread parallel to each other along a direction perpendicular to a disposition direction of each heater (22, 23) disposed along a direction parallel to each side wall (33, 34). Therefore, in the radiation state, a region between the shielding plates 43 adjacent to each other is widely open, and allows radiation of radiation heat from each heater (22, 23) to the workpieces 10.

[Switching Drive Unit]

The switching drive units (26, 27) are provided as mechanisms to switch the states of the shielding members (24, 25) by driving the shielding members (24, 25). The switching drive units (26, 27) are configured to switch the states of the shielding members (24, 25) between the radiation state illustrated in FIG. 5 and the shielding state illustrated in FIG. 1 to FIG. 3 by driving the shielding members (24, 25). The radiation state is configured as a state where the shielding members (24, 25) are disposed to allow radiation of radiation heat from the heaters (22, 23) to the workpieces 10. The shielding state is configured as a state where the shielding members (24, 25) are disposed to shield radiation of radiation heat from the heaters (22, 23) to the workpieces 10.

The switching drive units (26, 27) are provided in a pair, and are provided as a first switching drive unit 26 and a second switching drive unit 27. The first switching drive unit 26 is configured to switch the state of the first shielding member 24 between the radiation state and the shielding state by driving the first shielding member 24. The second switching drive unit 27 is configured to switch the state of the second shielding member 25 between the radiation state and the shielding state by driving the second shielding member 25.

Figure 9A:
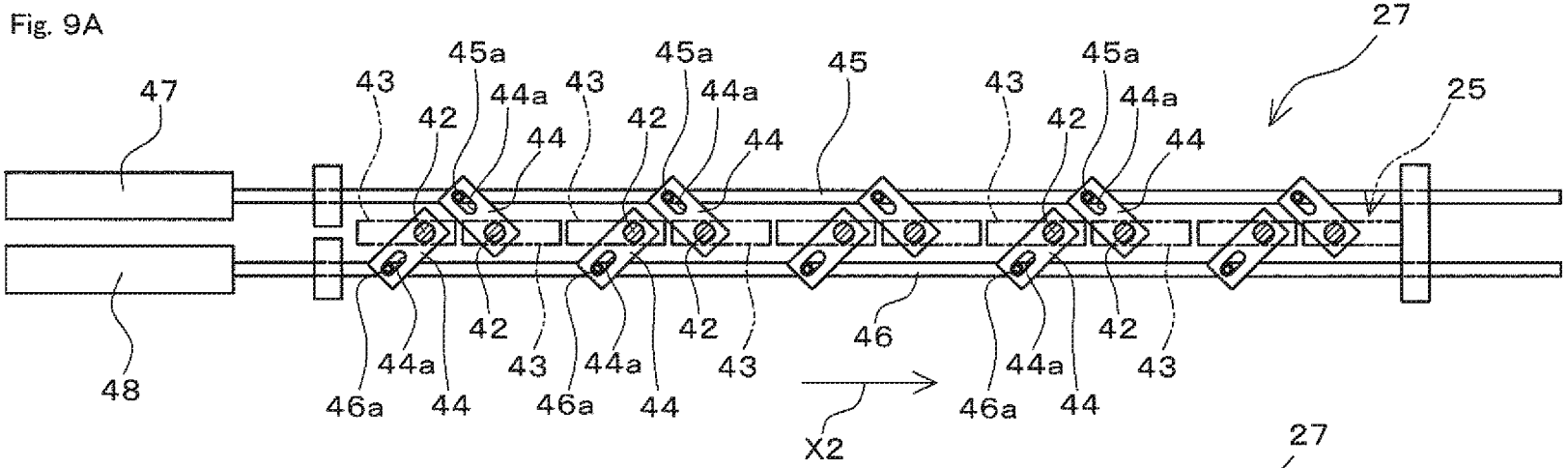
FIGS. 9A and 9B are views for describing operation of a switching drive unit in the heat treatment apparatus, FIG. 9A schematically illustrates a state where the switching drive unit has switched the state of the shielding member into a shielding state, and FIG. 9B schematically illustrates a state where the switching drive unit has switched the state of the shielding member into a radiation state.
Figure 9B:
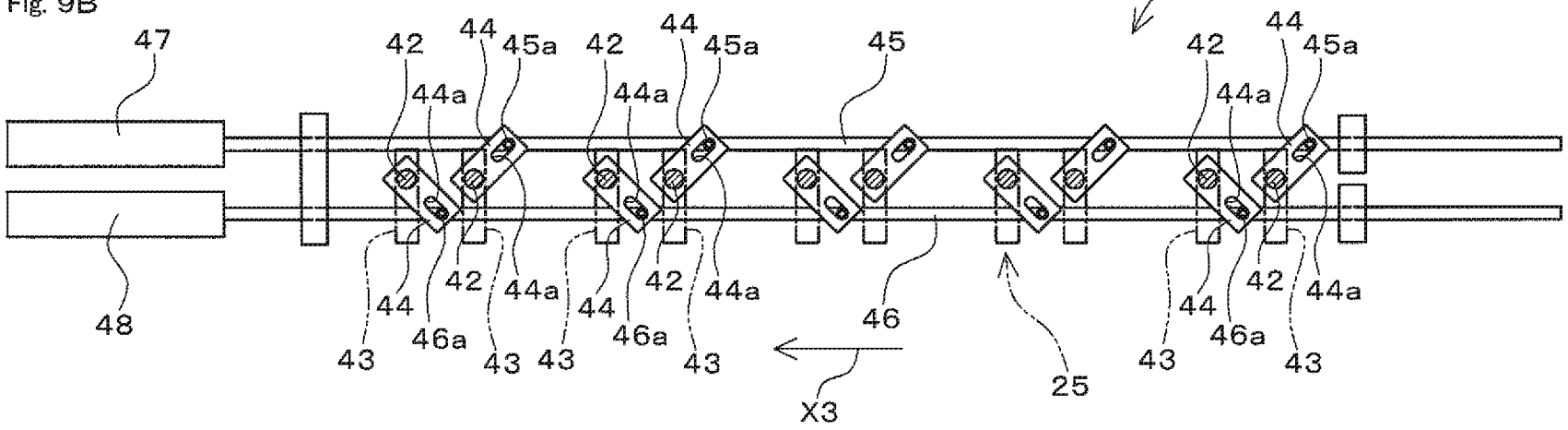
Figure 10:
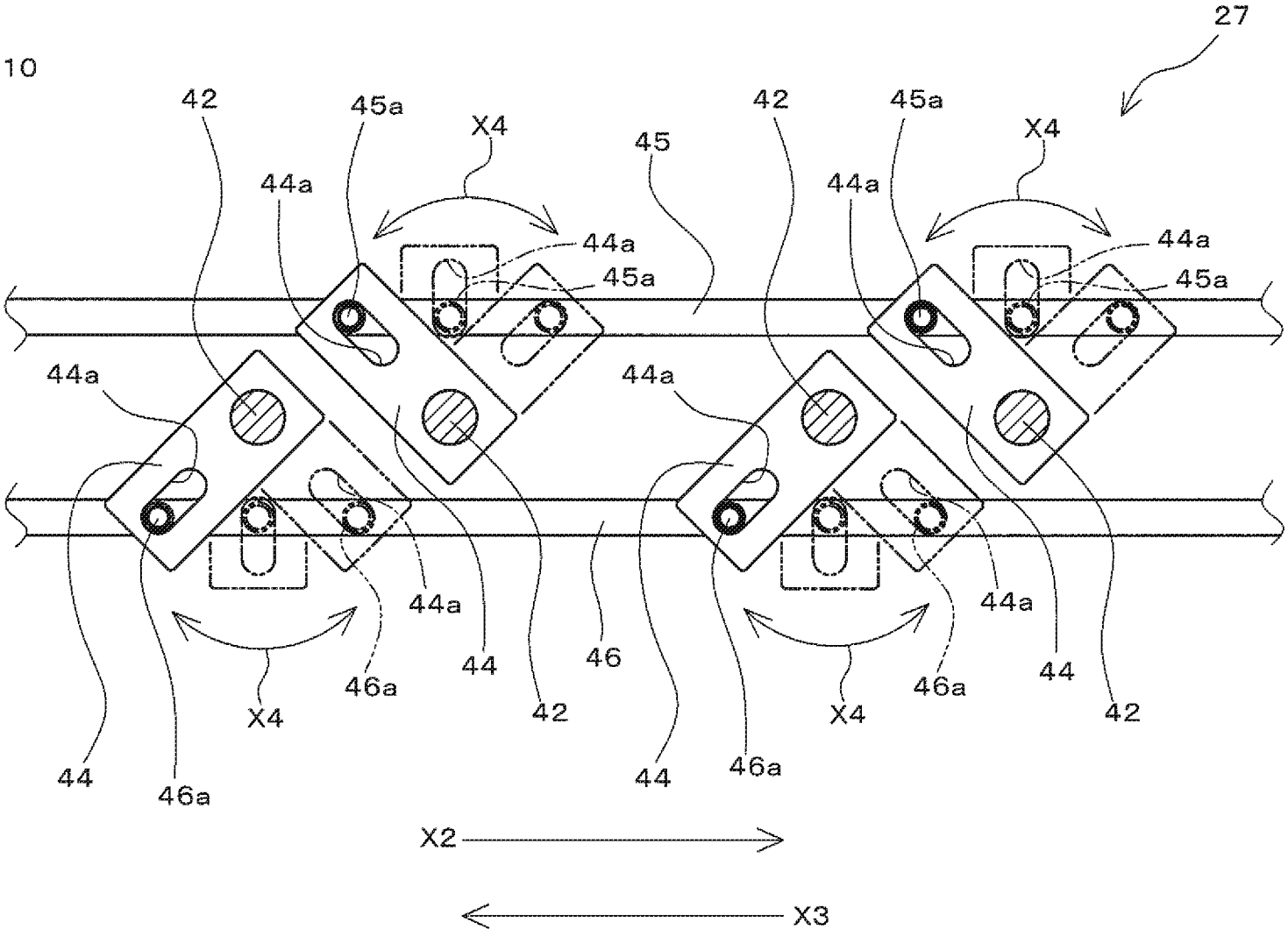
FIG. 10 is a schematic view of the switching drive unit in the heat treatment apparatus, describing operation of the switching drive unit.

FIGS. 9A and 9B are views for describing operation of the switching drive units (26, 27), and are schematic plan views of the second switching drive unit 27 of the switching drive units (26, 27) having the same structure. FIG. 9A schematically illustrates a state where the second switching drive unit 27 has switched the state of the second shielding member 25 into the shielding state, and FIG. 9B schematically illustrates a state where the second switching drive unit 27 has switched the state of the second shielding member 25 into the radiation state. In FIG. 9A and FIG. 9B, the plurality of shielding plates 44 in the second shielding member 25 are represented by alternate long and two short dashed lines. FIG. 10 is a schematic view of the second switching drive unit 27, describing operation of the second switching drive unit 27. FIG. 10 illustrates a portion of the second switching drive unit 27 in an enlarged manner.

Referring to FIG. 2, FIG. 9A, FIG. 9B, and FIG. 10, the switching drive units (26, 27) are installed at a lower side of the bottom wall 37 of the heat treatment chamber 21, and each includes a plurality of swing members 44, joint rods (45, 46), and joint rod drive units (47, 48). FIG. 9A, FIG. 9B, and FIG. 10 illustrate the second switching drive unit 27, and the first switching drive unit is also configured in the same manner as the second switching drive unit 27. That is, the first switching drive unit 26 includes a plurality of swing members 44, joint rods (45, 46), and joint rod drive units (47, 48), and the second switching drive unit 27 also includes a plurality of swing members 44, joint rods (45, 46), and joint rod drive units (47, 48).

The plurality of swing members 44 in the first and second switching drive units (26, 27) are respectively provided as plate-shaped members having rectangular external shapes, and are respectively fixed to the plurality of rotary shafts 42. The switching drive units (26, 27) are installed at a lower side of the bottom wall 37, and the respective swing members 44 are fixed to lower end portions of the respective rotary shafts 42 supported rotatably with respect to the bottom wall 37 and penetrating through the bottom wall 37.

The respective swing members 44 are fixed to the respective rotary shafts 42 while extending to project so that their extending directions in rectangular plate shapes are perpendicular to the respective rotary shafts 42. The respective swing members 44 are fixed to the respective rotary shafts 42 while projecting and extending aslant at predetermined angles toward the inlet door 35*a* side with respect to a direction in which the plurality of rotary shafts 42 are juxtaposed parallel to the traveling direction X1 from the inlet door 35*a* to the outlet door 36*a* when the shielding members (24, 25) are in the shielding state. The plurality of swing members 44 are provided so as to project and extend aslant at predetermined angles alternately to both sides with respect to the juxtaposition direction of the plurality of rotary shafts 42 when the shielding members (24, 25) are in the shielding state. In each swing member 44, a slot 44*a* for joining swingably to the joint rods (45, 46) described later is provided.

The joint rods (45, 46) are provided as rod-shaped members to join the plurality of swing members 44. In each of the first and second switching drive units (26, 27), the joint rods (45, 46) are provided in a pair. The pair of joint rods (45, 46) are installed so as to extend parallel to each other, and extend along a direction parallel to the juxtaposition direction of the plurality of rotary shafts 42. The joint rod 45 joins half of the plurality of swing members 44 in each of the first and second switching drive units (26, 27), and the joint rod 46 joins the remaining half of the plurality of swing members 44 in each of the first and second switching drive units (26, 27). More specifically, the joint rod 45 joins every other swing members 44 juxtaposed along the juxtaposition direction of the plurality of rotary shafts 42 so as to join half (five in the example of the present embodiment) of the plurality of swing members 44. The joint rod 46 is provided so as to join the swing members 44 that are not joined to the joint rod 45. That is, the joint rod 46 is provided to join every other swing members 44 of the plurality of swing members 44 juxtaposed along the juxtaposition direction of the plurality of rotary shafts 42 so as to join the remaining half (five in the example of the present embodiment) of the plurality of swing members 44.

Each of the joint rods (45, 46) is provided with a plurality of joint pins (45*a*, 46*a*) to join the plurality of swing members 44 swingably. That is, the joint rod 45 is provided with a plurality of joint pins 45*a* to join half of the plurality of swing members 44 swingably, and the joint rod 46 is provided with a plurality of joint pins 46*a* to join the remaining half of the plurality of swing members 44 swingably.

Each joint pin 45*a* in the joint rod 45 is provided to project in a cantilevered manner upward from a rod-shaped portion of the joint rod 45 and penetrate through the slot 44*a* of each swing member 44 in a loose-fit state. Each joint pin 45*a* of the joint rod 45 penetrates through, in a loose-fit state, the slot 44*a* of each of the swing members 44 as half of the plurality of swing members 44 in each of the first and second switching drive units (26, 27). Accordingly, to the joint rod 45, half of the plurality of swing members 44 in each of the first and second switching drive units (26, 27) are respectively joined swingably.

Each joint pin 46*a* in the joint rod 46 is provided so as to project in a cantilevered manner upward from a rod-shaped portion of the joint rod 46 and penetrate through the slot 44*a* of each swing member 44 in a loose-fit state. Each joint pin 46*a* of the joint rod 46 penetrates through, in a loose-fit state, the slot 44*a* of each of the swing members 44 as the remaining half of the plurality of swing members 44 in each of the first and second switching drive units (26, 27). Accordingly, to the joint rod 46, the remaining half of the plurality of swing members 44 in each of the first and second switching drive units (26, 27) are respectively joined swingably.

The joint rod drive units (47, 48) are provided as mechanisms to drive the joint rods (45, 46) so as to advance/retreat the joint rods (45, 46). In each of the first and second switching drive units (26, 27), the joint rod drive units (47, 48) are provided in a pair. The joint rod drive unit 47 is configured to drive the joint rod 45 so as to advance/retreat the joint rod 45, and the joint rod drive unit 48 is configured to drive the joint rod 46 so as to advance/retreat the joint rod 46. In the present embodiment, the joint rod drive units (47, 48) are installed at the front wall 35 side on a lower surface of the bottom wall 37.

The joint rod drive units (47, 48) are provided as mechanisms to advance and retreat the joint rods (45, 46) by reciprocating the joint rods (45, 46) along a linear direction, and are configured as, for example, cylinder mechanisms to be activated by an air pressure or a hydraulic pressure. When the joint rod drive units (47, 48) are configured as cylinder mechanisms, each joint rod drive unit includes, for example, a piston, a cylinder main body including a pair of pressure chambers which are partitioned by the piston and a pressure medium is supplied to and discharged from, and a rod that has one end joined to the piston and the other end joined to an end portion of the joint rods (45, 46). By activating the joint rod drive units (47, 48) and moving the rod in a direction of projecting from the cylinder main body, the joint rods (45, 46) are driven to advance from the joint rod drive units (47, 48). Then, by activating the joint rod drive units (47, 48) and moving the rod so as to retreat to the cylinder main body, the joint rods (45, 46) are driven so as to retreat to the joint rod drive units (47, 48) side.

The joint rod drive units (47, 48) are activated based on a control command from the control unit 32, and drives the joint rods (45, 46) to make the joint rods (45, 46) perform an advancing operation and a retreating operation. More specifically, for example, by activating a solenoid valve unit provided in a pressure air supply and discharge passage not illustrated that joins a pressure source of the pressure air and the pressure chambers of the cylinder main body based on a control command from the control unit 32, the joint rod drive units (47, 48) are activated, and the joint rods (45, 46) are operated to advance or retreat.

FIG. 9A illustrates a state where the joint rods (45, 46) have retreated to the joint rod drive units (47, 48), and FIG. 9B illustrates a state where the joint rods (45, 46) have advanced from the joint rod drive units (47, 48). In FIG. 9A and FIG. 10, an advancing direction X2 of the joint rods (45, 46) performing an advancing operation is represented by the arrow X2, and in FIG. 9B and FIG. 10, a retreating direction X3 of the joint rods (45, 46) performing a retreating operation is represented by the arrow X3. In the present embodiment, the advancing direction X2 is set to a direction parallel to the advancing direction X1 from the inlet door 35*a* to the outlet door 36*a*, and the retreating direction X3 is set to a direction opposite the advancing direction X1.

When the joint rods (45, 46) are driven to advance or retreat by the joint rod drive units (47, 48), the joint pins (45*a*, 46*a*) penetrating through the slots 44*a* of the swing members 44 in a loose-fit state also move. Accordingly, the swing members 44 fixed to the rotary shafts 42 swing so as to rotate around the rotary shafts 42. Then, along with swing of the swing members 44, the rotary shafts 42 supported rotatably rotate. In FIG. 10, swing directions X4 of the swing members 44 that swing around the rotary shafts 42 are represented by two-way arrows X4. In FIG. 10, positions of the swing members 44 in a state where the joint rods (45, 46) have retreated are represented by solid lines, and positions of the swing members 44 in the middle of, and at the completion of an advancing operation when the joint rods (45, 46) perform the advancing operation in the advancing direction X2 are represented by alternate long and two short dashed lines.

As illustrated in FIG. 9A, in the state where the joint rods (45, 46) have retreated, the shielding members (24, 25) are in the shielding state. From this state, by driving the joint rods (45, 46) by the joint rod drive units (47, 48), the joint rods (45, 46) advance in the advancing direction X2. Along with this, the respective joint pins (45*a*, 46*a*) penetrating through the slots 44*a* of the respective swing members 44 also move along the advancing direction X2, and the plurality of swing members 44 swing. Then, along with swing of the plurality of swing members 44, the plurality of rotary shafts 42 supported rotatably rotate, and the plurality of shielding plates 43 rotate simultaneously together with the plurality of rotary shafts 42. Accordingly, the states of the shielding members (24, 25) are switched from the shielding state into the radiation state illustrated in FIG. 5, FIG. 7, FIG. 8B, and FIG. 9B. Accordingly, the switching drive units (26, 27) are configured to switch the states of the shielding members (24, 25) from the shielding state into the radiation state by simultaneously rotating the plurality of shielding plates 44.

As illustrated in FIG. 9B, in the state where the joint rods (45, 46) have advanced, the shielding members (24, 25) are in the radiation state. From this state, by driving the joint rods (45, 46) by the joint rod drive units (47, 48), the joint rods (45, 46) retreat in the retreating direction X3. Along with this, the respective joint pins (45*a*, 46*a*) penetrating through the slots 44*a* of the respective swing members 44 also move along the retreating direction X3, and the plurality of swing members 44 swing. Then, along with swing of the plurality of swing members 44, the plurality of rotary shafts 42 supported rotatably rotate, and the plurality of shielding plates 43 simultaneously rotate together with the plurality of rotary shafts 42. Accordingly, the states of the shielding members (24, 25) are switched from the radiation state into the shielding state illustrated in FIG. 1 to FIG. 3, FIG. 6, FIG. 8A, and FIG. 9A. Accordingly, the switching drive units (26, 27) are configured to switch the states of the shielding members (24, 25) from the radiation state into the shielding state by simultaneously rotating the plurality of shielding plates 44.

The switching drive units (26, 27) are configured to be activated based on a control command from the control unit 43, and switch the states of the shielding members (24, 25) from the shielding state into the radiation state or from the radiation state into the shielding state. More specifically, the switching drive units (26, 27) are configured to switch the states of the shielding members (24, 25) between the shielding state and the radiation state by activating the joint rod drive units (47, 48) by the switching drive units (26, 27) based on a control command from the control unit 32 so as to make the joint rods (45, 46) perform the advancing operation and the retreating operation.

The switching drive units (26, 27) are configured to switch the states of the shielding members (24, 25) between the shielding state and the radiation state based on a temperature measurement result by the temperature measuring unit 28. As described above, the temperature measuring unit 28 is connected to the control unit 32, and configured so that a temperature measurement result by the temperature measuring unit 28 is input into the control unit 32. Then, the control unit 32 creates a control command based on the temperature measurement result by the temperature measuring unit 28, and based on the control command, the states of the shielding members (24, 25) are switched between the shielding state and the radiation state. That is, the switching drive units (26, 27) are configured to switch the states of the shielding members (24, 25) between the shielding state and the radiation state according to control of the control unit 32 based on a temperature measurement result by the temperature measuring unit 28.

The switching drive units (26, 27) are configured to switch the states of the shielding members (25, 26) from the radiation state into the shielding state according to control of the control unit 32 based on a temperature measurement result by the temperature measuring unit 28 when a temperature measured by the temperature measuring unit 28 during heating of the workpieces 10 reaches a predetermined temperature lower than the A1 transformation point. Specifically, for example, the switching drive units (26, 27) are configured to switch the states of the shielding members (24, 25) from the radiation state into the shielding state when a temperature measured by the temperature measuring unit 28 during heating of the workpieces 10 reaches a predetermined temperature 50° C. lower than the A1 transformation point. During heating treatment, the temperatures of the workpieces 10 rise so as to follow a rise in temperature of the atmosphere inside the heat treatment chamber 21. Therefore, when the temperature measured by the temperature measuring unit 28 reaches a predetermined temperature 50° C. lower than the A1 transformation point, the temperatures of the workpieces 10 are lower than the predetermined temperature 50° C. lower than the A1 transformation point. Therefore, when the workpieces 10 reach the predetermined temperature 50° C. lower than the A1 transformation point, the states of the shielding members (24, 25) have already been switched from the radiation state into the shielding state. The A1 transformation point is, for example, 727° C.

The switching drive units (26, 27) are configured to switch the states of the shielding members (24, 25) from the shielding state into the radiation state according to control of the control unit 32 based on a temperature measurement result by the temperature measuring unit 28 when the temperature measured by the temperature measuring unit 28 during heating of the workpieces 10 reaches a switching temperature as a temperature higher than a predetermined temperature higher than the A3 transformation point. Specifically, for example, the switching drive units (26, 27) are configured to switch the states of the shielding members (24, 25) from the shielding state into the radiation state when the temperature measured by the temperature measuring unit 28 during heating of the workpieces 10 reaches a switching temperature higher than the predetermined temperature 50° C. higher than the A3 transformation point. The switching temperature described above is set as a temperature of the workpiece 10 during heating treatment, higher than the predetermined temperature 50° C. higher than the A3 transformation point. The switching temperature is set based on, for example, a result of checking the relationship between temperatures of the workpieces 10 during heating treatment and a temperature measured by the temperature measuring unit 28 in advance.

According to the description given above, the switching drive units (26, 27) are configured to maintain the shielding members (24, 25) in the shielding state when the temperatures of the workpieces 10 are temperatures within a predetermined temperature range including the A1 transformation point. The predetermined temperature range is set so as to include at least a temperature range not lower than a temperature 50° C. lower than the A1 transformation point and not higher than a temperature 50° C. higher than the A3 transformation point.

[Centrifugal Fan]

Figure 11A:
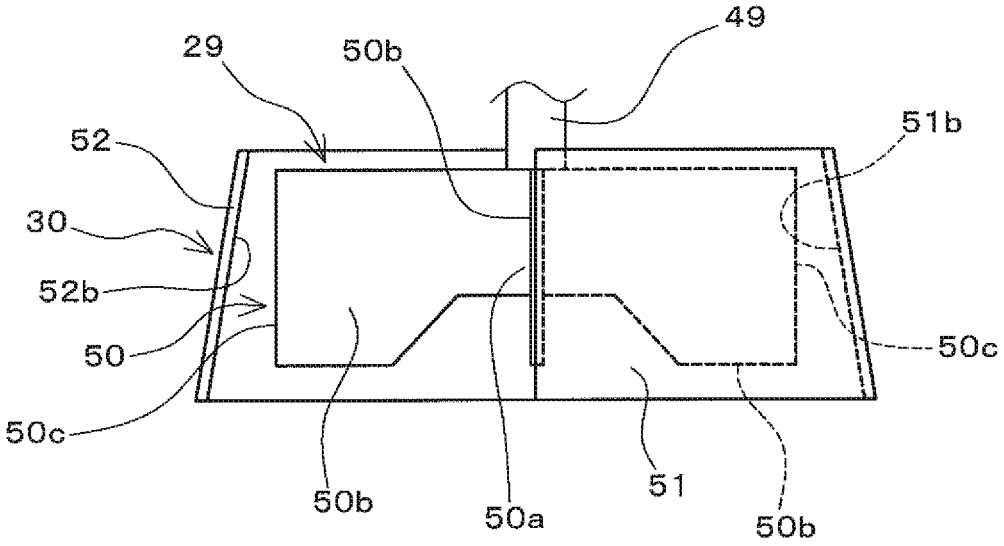
FIGS. 11A and 11B are schematic views of a centrifugal fan and an air current regulation unit in the heat treatment apparatus.
Figure 11B:
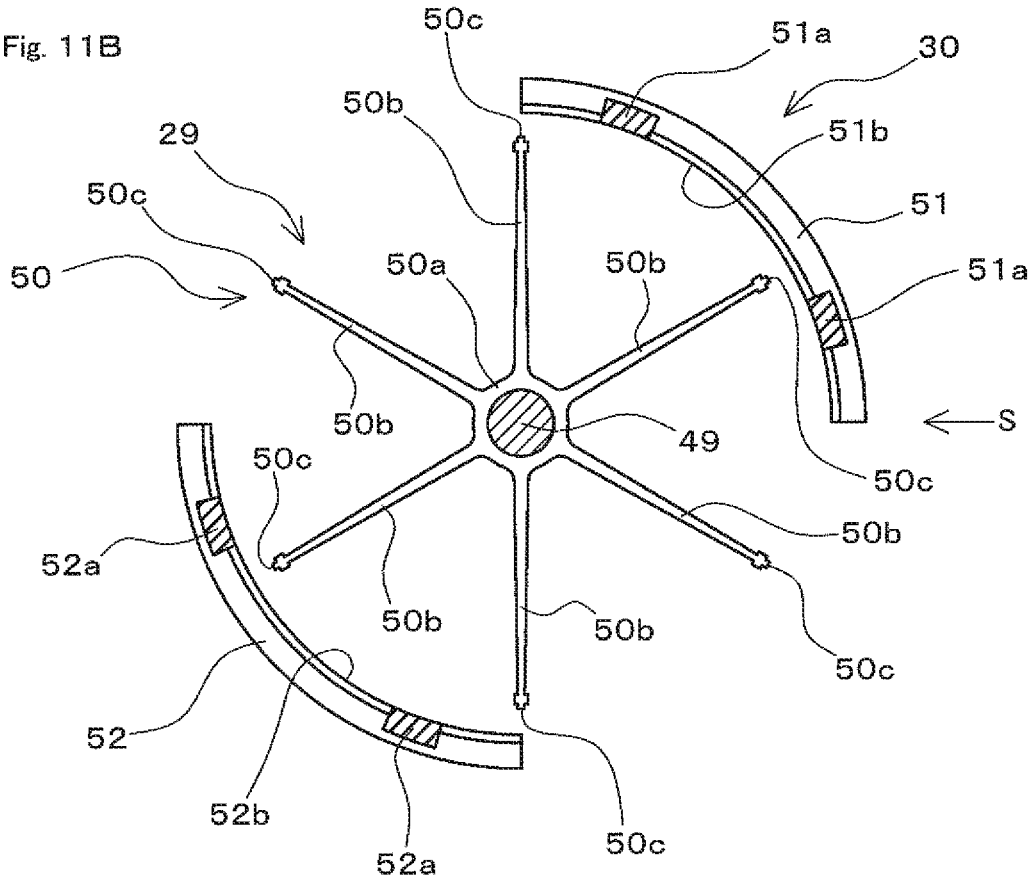

FIGS. 11A and 11B are schematic views of a centrifugal fan 29 and an air current regulation unit 30, FIG. 11A is a view of the centrifugal fan 29 and the air current regulation unit 30 viewed from a horizontal direction, and FIG. 11B is a view of the centrifugal fan 29 and the air current regulation unit 30 viewed from above. FIG. 11A is a view of the centrifugal fan 29 and the air current regulation unit 30 from the arrow S direction in FIG. 11B. Referring to FIG. 1, FIG. 2, FIG. 5, FIG. 11A, and FIG. 11B, the centrifugal fan (fan) 29 is disposed to face the workpieces 10 inside the heat treatment chamber 21, and is provided as a fan to suck gas from the workpiece 10 side and generate air current that passes through the circumferences of the workpieces 10.

The centrifugal fan 29 is installed on the ceiling wall 38 inside the heat treatment chamber 21. The centrifugal fan 29 is disposed in a region above the plurality of conveyance rollers 40 that convey the cases 11 storing the workpieces 10 and below the central portion of the ceiling wall 38. Accordingly, the centrifugal fan 29 is disposed to face the workpieces 10 at a position above the workpieces 10 that are conveyed together with the cases 11 by the plurality of conveyance rollers 40 and disposed inside the heat treatment chamber 21. The centrifugal fan 29 is disposed between the pair of heaters (22, 23) together with the workpieces 10.

The centrifugal fan 29 is configured to include a fan rotary shaft 49 and a rotary blade 50. The fan rotary shaft 49 is disposed to extend in the up-down direction and penetrate through the ceiling wall 38, and installed rotatably with respect to the ceiling wall 38. A lower end side of the fan rotary shaft 49 is disposed inside the heat treatment chamber 21, and to this lower end side, the rotary blade 50 is fixed. An upper end side of the fan rotary shaft 49 is disposed outside the heat treatment chamber 21 by penetrating through the ceiling wall 38, and is joined to a fan drive motor 53. The fan drive motor 53 is provided as an electric motor to rotationally drive the fan rotary shaft 49, and is configured to rotate based on a control command from the control unit 32.

The rotary blade 50 is fixed to the fan rotary shaft 49 while being disposed near the ceiling wall 38. The rotary blade 50 is configured to include a hub 50*a* fixed to the fan rotary shaft 49, and a plurality of blades 50*b* extending radially from the hub 50*a* around the fan rotary shaft 49. In the present embodiment, a form of the rotary blade 50 configured to include six blades 50*b* as the plurality of blades 50*b* is illustrated by way of example. In the present embodiment, as a shape of the blade 50*b*, a shape that has a surface spreading in the up-down direction and spreads planarly outward in a radial direction of the centrifugal fan 29 from the fan rotary shaft 49 is illustrated by way of example, however, the shape of the blade 50*b* is not limited to this. The shape of the blade 50*b* may be a shape spreading in a curved surface shape, or may be a shape variously combining a portion spreading planarly and a portion spreading in a curved surface shape.

The rotary blade 50 is fixed to the fan rotary shaft 49, and rotates together with the fan rotary shaft 49 that is driven to rotate by the fan drive motor 53. The rotary blade 50 is configured to flow gas sucked from the workpiece 10 side below the centrifugal fan 29 outward in radial directions of the centrifugal fan 29 by rotation of the plurality of blades 50*b* together with the rotary shaft 49 in a region near the ceiling wall 38. The centrifugal fan 29 is configured to generate air current flowing from a lower side to an upper side of the workpieces 10 by sucking gas from the workpiece 10 side below the centrifugal fan 29. Accordingly, the centrifugal fan 29 is configured to generate air current that passes through the circumferences of the workpieces 10 along the up-down direction as a direction parallel to the extending direction of the shielding members (24, 25).

[Air Current Regulation Unit]

Figure 12:
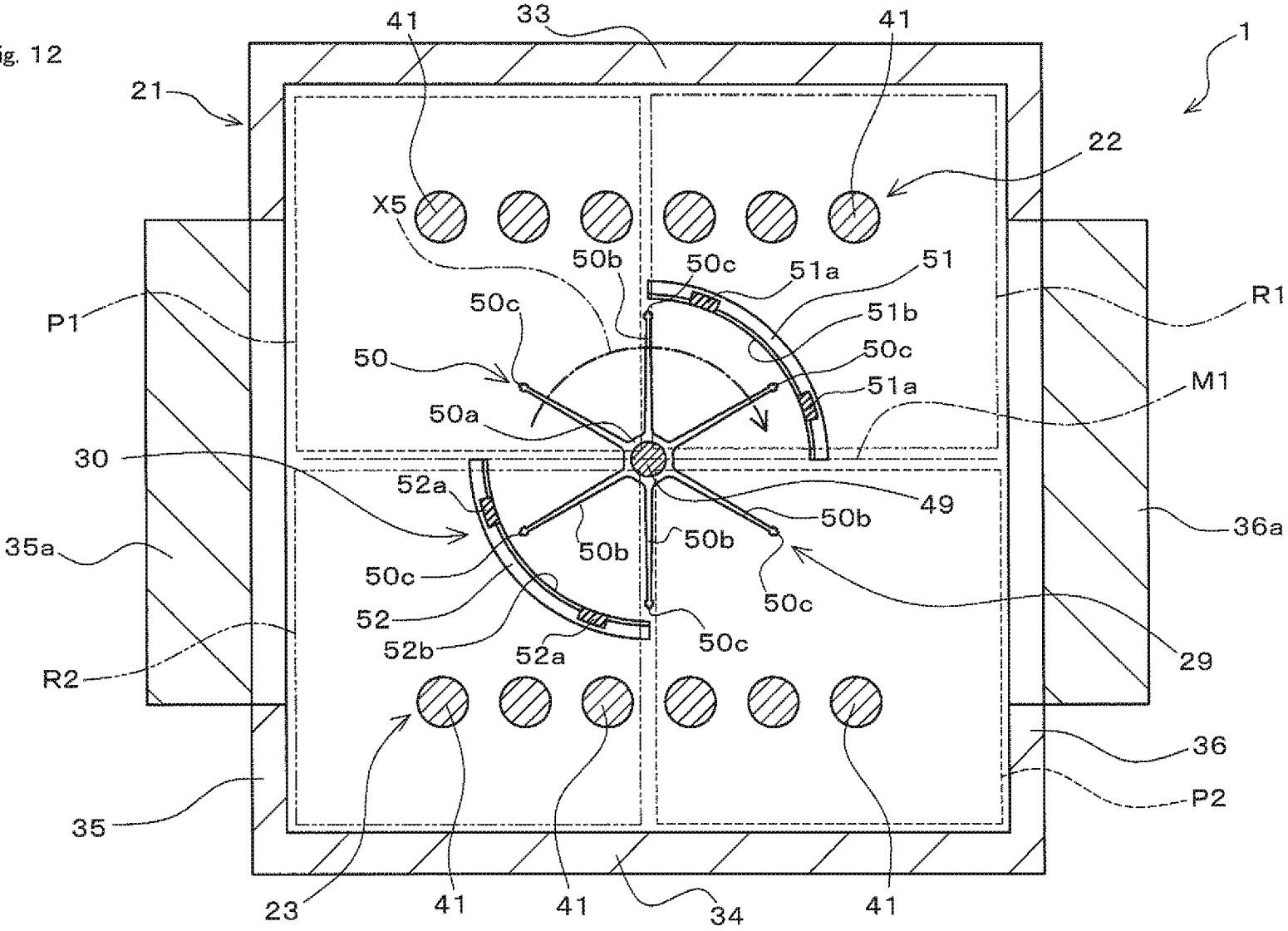
FIG. 12 is a schematic sectional view of the heat treatment apparatus, illustrating a configuration with partial omission of the inside of a heat treatment chamber in the heat treatment apparatus.

FIG. 12 is a schematic sectional view of the heat treatment apparatus 1, illustrating, with partial omission, a configuration of the inside of the heat treatment chamber 21 in the heat treatment apparatus 1. FIG. 12 illustrates a plan view of a state of the heat treatment chamber 21 viewed from a position corresponding to the arrow line B-B position in FIG. 2, with partial omission in configuration. Referring to FIG. 1, FIG. 2, FIG. 5 to FIG. 7, FIG. 11A, FIG. 11B, and FIG. 12, the air current regulation unit 30 is installed on the ceiling wall 38 inside the heat treatment chamber 21. The air current regulation unit 30 is disposed around the centrifugal fan 29, and is provided as a mechanism to regulate flows of air current flowing outward in radial directions of the centrifugal fan 29 from the centrifugal fan 29.

The air current regulation unit 30 is configured to include a first air current restricting member 51 and a second air current restricting member 52. The first air current restricting member 51 and the second air current restricting member 52 are disposed along an outer circumferential direction of the centrifugal fan 29 around the centrifugal fan 29. The first air current restricting member 51 and the second air current restricting member 52 are disposed to face each other across the centrifugal fan 29.

Here, dispositions and configurations of the first air current restricting member 51 and the second air current restricting member 52 of the air current regulation unit 30 inside the heat treatment chamber 21 are described in greater detail. In FIG. 12, an intermediate position M1 between the pair of side walls (33, 34) of the heat treatment chamber 21 is represented by an alternate long and short dashed line M1. The intermediate position M1 is a position equidistant from the pair of side walls (33, 34), and is a position along a plane parallel to the respective side walls (33, 34).

In FIG. 12, a region R1 at the first side wall 33 side relative to the intermediate position M1 inside the heat treatment chamber 21 and at the rear wall 36 side relative to an intermediate position between the front wall 35 and the rear wall 36 is illustrated as a region enclosed by an alternate long and two short dashed line R1. The region R1 is configured as a region in which the first air current restricting member 51 is disposed, and the flow of air current from the centrifugal fan 29 is restricted by the first air current restricting member 51. Hereinafter, the region R1 is also referred to as a first air current restricting region R1. In the first air current restricting region R1, the first air current restricting member 51 is disposed at an outer side in a radial direction of the centrifugal fan 29 with respect to the centrifugal fan 29, and fixed to the ceiling wall 38. At a plurality of positions of an upper end portion of the first air current restricting member 51, attaching portions 51*a* are provided. By attaching the attaching portions 51*a* to the ceiling wall 38, the first air current restricting member 51 is fixed and attached to the ceiling wall 38.

In FIG. 12, a region R2 at the second side wall 34 side relative to the intermediate position M1 inside the heat treatment chamber 21, and at the front wall 35 side relative to the intermediate position between the front wall 35 and the rear wall 36 is illustrated as a region enclosed by an alternate long and two short dashed line R2. The region R2 is configured as a region in which the second air current restricting member 52 is disposed, and the flow of air current from the centrifugal fan 29 is restricted by the second air current restricting member 52. Hereinafter, the region R2 is also referred to as a second air current restricting region R2. In the second air current restricting region R2, the second air current restricting member 52 is disposed at an outer side in a radial direction of the centrifugal fan 29 with respect to the centrifugal fan 29 and fixed to the ceiling wall 38. At a plurality of positions of an upper end portion of the second air current restricting member 52, attaching portions 52*a* are provided. By attaching the attaching portions 52*a* to the ceiling wall 38, the second air current restricting member 52 is fixed and attached to the ceiling wall 38.

In FIG. 12, a region P1 at the first side wall 33 side relative to the intermediate position M1 inside the heat treatment chamber 21, and at the front wall 35 side relative to the intermediate position between the front wall 35 and the rear wall 36 is illustrated as a region enclosed by a dashed line P1. The region P1 is configured as an open region in which any of the first air current restricting member 51 and the second air current restricting member 52 is not disposed. Therefore, the region P1 is configured as a region in which the flow of air current from the centrifugal fan 29 is not restricted, and the flow of air current from the centrifugal fan 29 is allowed. Hereinafter, the region P1 is also referred to as a first air current allowing region P1.

In FIG. 12, a region P2 at the second side wall 34 side relative to the intermediate position M1 inside the heat treatment chamber 21, and at the rear wall 36 side relative to the intermediate position between the front wall 35 and the rear wall 36 is illustrated as a region enclosed by a dashed line P2. The region P2 is configured as an open region in which any of the first air current restricting member 51 and the second air current restricting member 52 is not disposed. Therefore, the region P2 is configured as a region in which the flow of air current from the centrifugal fan 29 is not restricted, and the flow of air current from the centrifugal fan 29 is allowed. Hereinafter, the region P2 is also referred to as a second air current allowing region P2.

In FIG. 12, a rotation direction X5 of the rotary blade 50 of the centrifugal fan 29 is represented by an alternate long and short dashed line arrow X5. In the present embodiment, the rotation direction X5 of the rotary blade 50 of the centrifugal fan 29 is set to be clockwise as viewed from above. Therefore, when the rotary blade 50 rotates, each blade 50*b* of the rotary blade 50 rotates around the rotary shaft 49 while repeatedly moving through the first air current allowing region P1, the first air current restricting region R1, the second air current allowing region P2, and the second air current restricting region R2 in this order when defining the first air current allowing region P1 as a rotation starting point.

The rotary blade 50 rotates in the rotation direction X5 as described above, so that outer circumferential edge portions 50*c* of the rotary blade 50 separate from the first side wall 33 in the first air current restricting region R1, approach the second side wall 34 in the second air current allowing region P2, separates from the second side wall 34 in the second air current restricting region R2, and approach the first side wall 33 in the first air current allowing region P1. The outer circumferential edge portions 50*c* of the rotary blade 50 are configured as edge portions at tip end sides of the respective blades 50*b* extending radially from the hub 50*a*.

The first air current restricting member 51 is disposed at an outer side in a radial direction of the centrifugal fan 29 in the first air current restricting region R1 as described above. Therefore, in the first air current restricting region R1, the rotary blade 50 rotates at an inner side in a radial direction of the centrifugal fan 29 with respect to the first air current restricting member 51. When the rotary blade 50 rotates, the outer circumferential edge portions 50*c* of the rotary blade 50 rotate in a direction of separating from the first side wall 33 in the first air current restricting region R1. Therefore, the first air current restricting member 51 is configured to restrict the flow of air current from the centrifugal fan 29 to the first side wall 33 side in the first air current restricting region R1 as a region which is at the first side wall 33 side relative to the intermediate position M1 inside the heat treatment chamber 21 and in which the outer circumferential edge portions 50*c* of the rotary blade 50 separate from the first side wall 33 when the rotary blade 50 rotates.

The second air current restricting member 52 is disposed at an outer side in a radial direction of the centrifugal fan 29 in the second air current restricting region R2 as described above. Therefore, in the second air current restricting region R2, the rotary blade 50 rotates at an inner side in a radial direction of the centrifugal fan 29 with respect to the second air current restricting member 52. When the rotary blade 50 rotates, the outer circumferential edge portions 50*c* of the rotary blade 50 rotate in a direction of separating from the second side wall 34 in the second air current restricting region R2. Therefore, the second air current restricting member 52 is configured to restrict the flow of air current from the centrifugal fan 29 to the second side wall 34 side in the second air current restricting region R2 as a region which is at the second side wall 34 side relative to the intermediate position M1 inside the heat treatment chamber 21 and in which the outer circumferential edge portions 50*c* of the rotary blade 50 separate from the second side wall 34 when the rotary blade 50 rotates.

As described above, in the first air current restricting region R1 and the second air current restricting region R2, flows of air current from the centrifugal fan 29 are restricted. Therefore, in regions at the respective side wall (33, 34) sides relative to the intermediate position between the pair of side walls (33, 34) inside the heat treatment chamber 21, the air current regulation unit 30 regulates flows of air current from the centrifugal fan 29 to the respective side wall (33, 34) sides when the rotary blade 50 of the centrifugal fan 29 rotates, so as to restrict the flows of air current in the regions (R1, R2) in which the outer circumferential edge portions 50*c* of the rotating rotary blade 50 separate from the respective side walls (33, 34). In addition, as described above, in the first air current allowing region P1 and the second air current allowing region P2, flows of air current from the centrifugal fan 29 are allowed. Therefore, in the regions at the respective side wall (33, 34) sides relative to the intermediate position M1 between the pair of side walls (33, 34) inside the heat treatment chamber 21, the air current regulation unit 30 regulates flows of the air current from the centrifugal fan 29 to the respective side wall (33, 34) sides when the rotary blade 50 of the centrifugal fan 29 rotates, so as to allow the flows of air current in the regions (P1, P2) in which the outer circumferential edge portions 50*c* of the rotating rotary blade 50 approach the respective side walls.

The first air current restricting member 51 includes a first curved wall surface 51*b* as a curved wall surface disposed and curved along the outer circumference of the centrifugal fan 29. The second air current restricting member 52 includes a second curved wall surface 52*b* as a curved wall surface disposed and curved along the outer circumference of the centrifugal fan 29. That is, the first air current restricting member 51 and the second air current restricting member 52 respectively include curved wall surfaces (51*b*, 52*b*) disposed and curved along the outer circumference of the centrifugal fan 29.

The first curved wall surface 51*b* of the first air current restricting member 51 and the second curved wall surface 52*b* of the second air current restricting member 51 are disposed to face each other across the centrifugal fan 29. The first curved wall surface 51*b* and the second curved wall surface 52*b* are configured so that their dimensions in a direction extending from the workpiece 10 side to the opposite side of the workpiece 10 side (that is, the up-down direction) become larger than the rotary blade 50 of the centrifugal fan 29. That is, the heights (dimensions in the up-down direction) of the first curved wall surface 51*b* and the second curved wall surface 52*b* are set to be larger than the height (dimension in the up-down direction) of the rotary blade 50 of the centrifugal fan 29.

The first curved wall surface 51*b* is configured as a curved surface that faces the centrifugal fan 29 in the first air current restricting member 51 curved along the outer circumference of the centrifugal fan 29. In the present embodiment, a shape in a horizontal section of the first curved wall surface 51*a* as a section perpendicular to the up-down direction is formed into an arc shape. A radius of curvature of the arc shape in the horizontal section of the first curved wall surface 51*a* is set to be large at a lower end side of the first air current restricting member 51 as the workpiece 10 side, and set to be small at an upper end side of the first air current restricting member 51 as the opposite side of the workpiece 10 side. Therefore, the first curved wall surface 51*a* is configured as a portion of a conical curved surface that narrows upward from the lower side (that is, from the workpiece 10 side toward the opposite side of the workpiece 10 side).

The second curved wall surface 52*b* is configured as a curved surface that faces the centrifugal fan 29 in the second air current restricting member 52 curved along the outer circumference of the centrifugal fan 29. In the present embodiment, a shape in a horizontal section of the second curved wall surface 52*b* as a section perpendicular to the up-down direction is formed into an arc shape. A radius of curvature of the arc shape in the horizontal section of the second curved wall surface 52*b* is set to be large at a lower end side of the second air current restricting member 52 as the workpiece 10 side, and set to be small at an upper end side of the second air current restricting member 52 as the opposite side of the workpiece 10 side. Therefore, the second curved wall surface 52*b* is configured as a portion of the conical curved surface narrowing upward from the lower side (that is, from the workpiece 10 side toward the opposite side of the workpiece 10 side).

As described above, the first curved wall surface 51*b* and the second curved wall surface 52*b* are configured as portions of a conical curved surface narrowing from the workpiece 10 side toward the opposite side of the workpiece 10 side. Therefore, the first curved wall surface 51*b* and the second curved wall surface 52*b* are provided so as to extend and approach each other toward the outer circumferential edge portions 50*c* of the rotary blade 50 of the centrifugal fan 29 from the workpiece 10 side to the opposite side of the workpiece 10 side.

Figure 13:
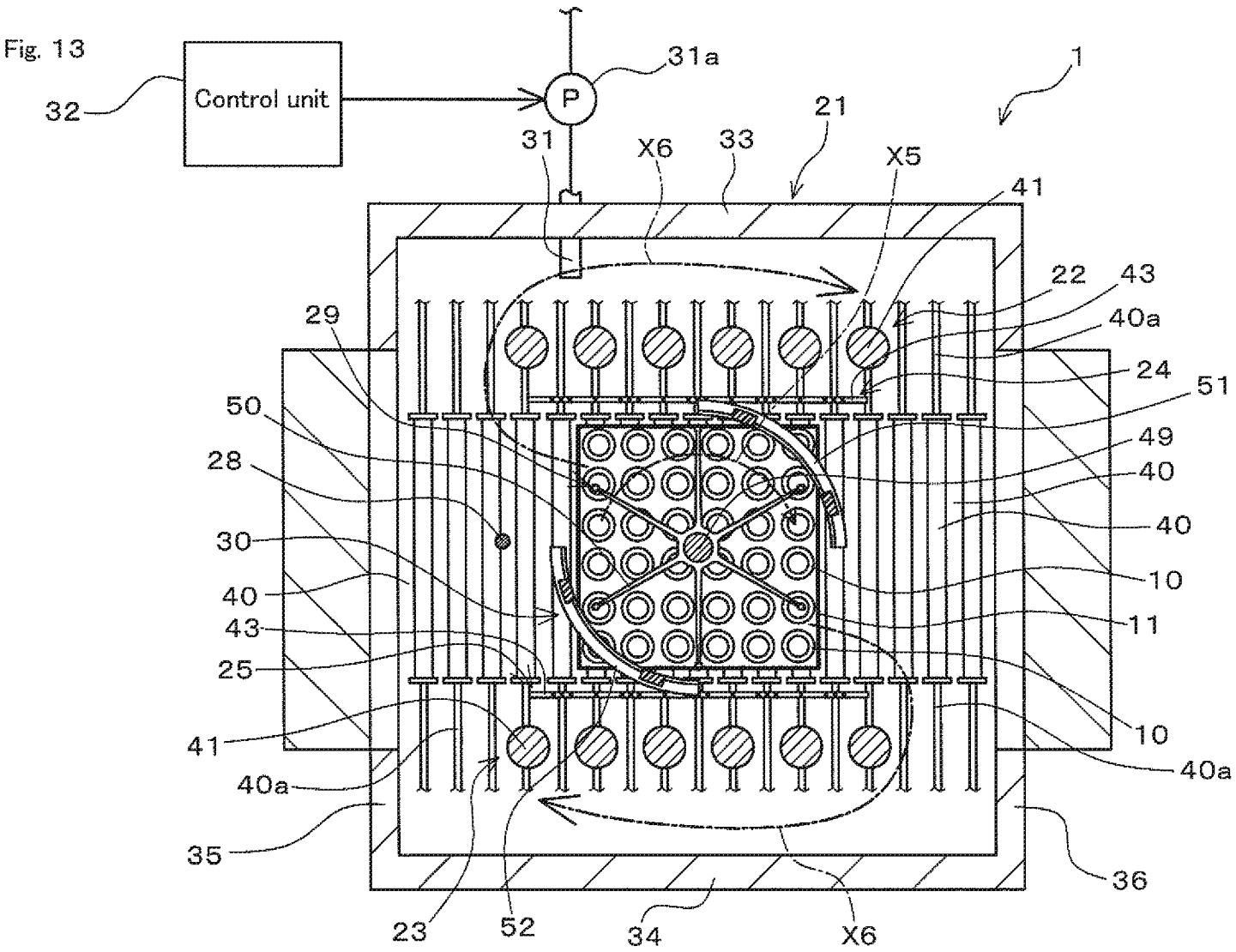
FIG. 13 is a schematic sectional view of the heat treatment apparatus corresponding to FIG. 1, describing operations of the centrifugal fan and the air current regulation unit.
Figure 14:
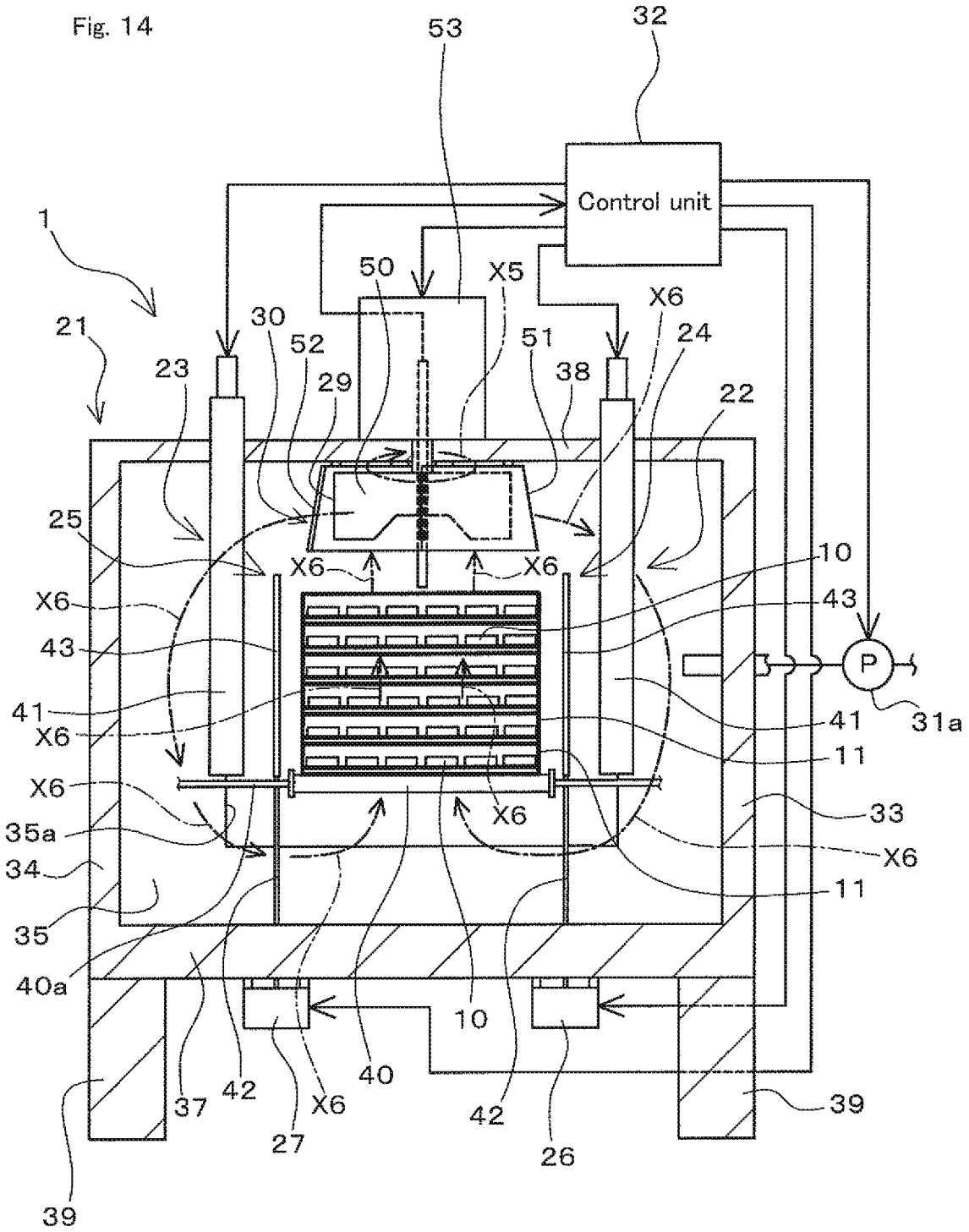
FIG. 14 is a schematic sectional view of the heat treatment apparatus corresponding to FIG. 2, describing operations of the centrifugal fan and the air current regulation unit.

FIG. 13 and FIG. 14 are schematic sectional views of the heat treatment apparatus 1, describing operations of the centrifugal fan 29 and the air current regulation unit 30. FIG. 13 is a schematic sectional view of the heat treatment apparatus 1 corresponding to FIG. 1, and FIG. 14 is a schematic sectional view of the heat treatment apparatus 1 corresponding to FIG. 2. Referring to FIG. 13 and FIG. 14, flows of air current inside the heat treatment chamber 21 according to operations of the centrifugal fan 29 and the air current regulation unit 30 will be further described.

Based on a control command from the control unit 32, the fan drive motor 53 is activated and the rotary blade 50 rotates in the rotation direction X5 together with the fan rotary shaft 49. Between the pair of side walls (33, 34) parallel to each other in the heat treatment chamber 21, by rotation of the rotary blade 50 of the centrifugal fan disposed between the first and second air current restricting members (51, 52) of the air current regulation unit 30 and facing the workpieces 10, flows of air current that circulate inside the heat treatment chamber 21 are generated. In FIG. 13 and FIG. 14, the rotation direction X5 of the rotary blade 50 of the centrifugal fan 29 is represented by an alternate long and short dashed line arrow X5. In FIG. 13 and FIG. 14, flow directions X6 of the air current circulating inside the heat treatment chamber 21 in response to activations of the centrifugal fan 29 and the air current regulation unit 30 are represented by a plurality of alternate long and short dashed line arrows X6.

Between the pair of side walls (33, 34) parallel to each other inside the heat treatment chamber 21, by rotation of the rotary blade 50 of the centrifugal fan 29 disposed to face the workpieces 10, gas at the workpiece 10 side is sucked and air current flowing along the flow directions X6 outward in radial directions of the centrifugal fan 29 is generated. Then, the air current that was sucked from the workpiece 10 side by the centrifugal fan 29 and flowed outward in radial directions of the centrifugal fan 29 flows while being regulated by the air current regulation unit 30. That is, in the first and second air current restricting regions (R1, R2), flows of air current from the centrifugal fan 29 to the first and second side wall (33, 34) sides are restricted by the first and second air current restricting members (51, 52). In the first and second air current allowing regions (P1, P2), flows of air current from the centrifugal fan 29 to the first and second side wall (33, 34) sides are allowed.

As described above, air current that was sucked from the workpiece 10 side and flowed outward in radial directions of the centrifugal fan 29 further flows along the respective side walls (33, 34) while flowing toward the side walls (33, 34) as represented by the flow directions X6 in FIG. 13 and FIG. 14 due to an air blowing operation caused by rotation of the centrifugal fan 29 and an air current flow direction regulating operation by the air current regulation unit 30. At this time, the air current flows along the respective side walls (33, 34) while descending from the upper side toward the lower side. Then, the air current that flowed along the side walls (33, 34) flows to the workpiece 10 side from below the workpieces 10, and pass through the workpieces 10 and is sucked by the centrifugal fan 29, and flows outward in radial directions of the centrifugal fan 29 again. Accordingly, the atmosphere inside the heat treatment chamber 21 entirely efficiently circulates and flows so as to flow along the side walls (33, 34) after passing through the workpieces 10, and pass through the workpieces 10 again during heat treatment.

[Control Unit]

Referring to FIG. 1 to FIG. 3, FIG. 5, FIG. 13, and FIG. 14, inside the heat treatment chamber 21, a heat treatment operation for the workpieces 10 is controlled by the control unit 32. Specifically, the control unit 32 controls the heat treatment operation for the workpieces 10 by controlling operations of the electric motor that drives the chain mechanism of the conveyance rollers 40, the fan drive motor 53 to rotationally drive the centrifugal fan 29, the pump 31*a* of the atmosphere gas supply unit 31, the first and second heaters (22, 23), and the first and second switching drive units (26, 27).

The control unit 32 includes a hardware processor such as a CPU (Central Processing Unit), a memory such as a RAM (Random Access Memory) and a ROM (Read Only Memory), an operation unit such as an operation panel to be operated by a user, and an interface circuit, etc. In the memory of the control unit 32, programs to create control commands to control operations of the fan drive motor 53, the pump 31*a* of the atmosphere gas supply unit 31, the first and second heaters (22, 23), and the first and second switching drive units (26, 27), etc., are stored. For example, by operating the operation unit by an operator, the programs described above are read out by the hardware processor from the memory and executed. Accordingly, the control commands described above are created, and based on the control commands, the fan drive motor 53, the pump 31*a* of the atmosphere gas supply unit 31, the first and second heaters (22, 23), and the first and second switching drive units (26, 27) are activated.

As described above, the apparatus is configured so that a temperature measurement result by the temperature measuring unit 28 is input into the control unit 32. The control unit 32 is configured to control operations of the first and second switching drive units (26, 27) based on the temperature measurement result by the temperature measuring unit 28. Based on the temperature measurement result by the temperature measuring unit 28, the control unit 32 controls heat generating operations of the respective heating elements 41 of the first and second heaters (22, 23) so that the temperature inside the heat treatment chamber 21 rises along a predetermined temperature rise pattern. The control unit 32 controls the heat generating operations of the respective heating elements 41 by, for example, regulating electric power to be supplied to the electric heating bodies of the respective heating elements 41 of the first and second heaters (22, 23).

[Operation of Heat Treatment Apparatus]

Figure 15:
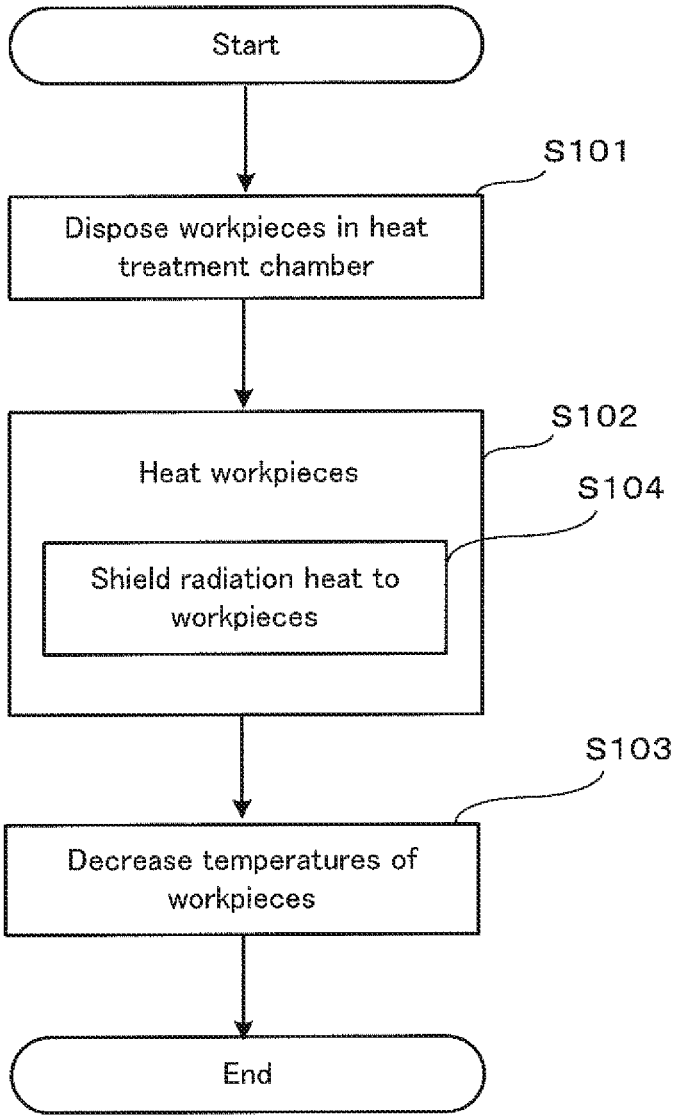
FIG. 15 is a flowchart describing an example of heat treatment operation in the heat treatment apparatus.

Next, an example of a heat treatment operation in the heat treatment apparatus 1 will be described. FIG. 15 is a flowchart describing an example of a heat treatment operation in the heat treatment apparatus 1. By performing operation of the heat treatment apparatus 1 illustrated in FIG. 15, the heat treatment method of the present embodiment is carried out. Hereinafter, when description is given by referring to a flowchart, drawings other than the flowchart will also be referred to as necessary.

In the heat treatment operation in the heat treatment apparatus 1, first, for example, workpieces 10 are carried into the heat treatment chamber 21 from the inlet door 35*a* by an operator, or mechanically by an automatic carry-in device (not illustrated). The workpieces 10 are carried into the heat treatment chamber 21 together with the cases 11 in a state where the workpieces 10 are stored in the cases 11. The workpieces 10 carried into the heat treatment chamber 21 are disposed on the plurality of conveyance rollers 40 inside the heat treatment chamber 21. Then, by the conveyance rollers 40 driven based on a control command from the control unit 32, the cases 11 are conveyed to a predetermined position at a substantially central portion inside the heat treatment chamber 21. After conveyance to the predetermined position, the conveyance by the conveyance rollers 40 is stopped, and the workpieces 10 stored in the cases 11 are disposed at the predetermined position inside the heat treatment chamber 21 (Step S101). In the state where the workpieces 10 are disposed inside the heat treatment chamber 21, the workpieces 10 are disposed between the pair of heaters (22, 23) and between the pair of shielding members (24, 25). Further, in the state where workpieces 10 are disposed inside the heat treatment chamber 21, the workpieces 10 are disposed below the centrifugal fan 29 so as to face the centrifugal fan 29.

When the workpieces 10 are disposed inside the heat treatment chamber 21, heat treatment to heat the workpieces 10 is subsequently applied (Step S102). That is, inside the heat treatment chamber 21 in which the metallic workpieces 10 as heating treatment targets and the heaters (22, 23) are disposed, a heating step (Step S102) of heating the workpieces 10 by using the heaters (22, 23) is performed. More specifically, according to control of the control unit 32, a heat generating operation by the heaters (22, 23) is started, and the atmosphere inside the heat treatment chamber 21 is heated. Then, by the heated atmosphere inside the heat treatment chamber 21, the workpieces 10 inside the heat treatment chamber 21 are heated.

In the heating step of heating the workpieces 10, along with the heat generating operation of the first and second heaters (22, 23), a rotating operation of the centrifugal fan 29 is performed. Specifically, according to control of the control unit 32, the heat generating operation of the first and second heaters (22, 23) is started, and driving of the fan drive motor 53 to rotationally drive the fan rotary shaft 49 of the centrifugal fan 29 is started. By rotation of the centrifugal fan 29, air current circulating inside the heat treatment chamber 21 is generated, and this air current flows while being regulated by the air current regulation unit 30. Accordingly, flows of air current that flow while circulating inside the heat treatment chamber 21 along the flow directions X6 illustrated in FIG. 13 and FIG. 14 are formed. Therefore, during the heating step, the atmosphere inside the heat treatment chamber 21 entirely efficiently circulates and flows so as to flow along the respective side walls (33, 34) after passing through the workpieces 10, and pass through the workpieces 10 again.

In the heating step, based on control of the control unit 32, first, the atmosphere inside the heat treatment chamber 21 is heated to the temperature of the A1 transformation point. When the temperature of the atmosphere inside the heat treatment chamber 21 rises to the A1 transformation point, for example, the temperature may be maintained for a predetermined period of time. Accordingly, the entirety including the insides of the workpieces 10 can be heated to the A1 transformation point. Next, in the heating step, based on control of the control unit 32, the atmosphere inside the heat treatment chamber 21 is heated from the temperature of the A1 transformation point to the temperature of the A3 transformation point. When the atmosphere inside the heat treatment chamber 21 is heated to the temperature of the A3 transformation point, based on control of the control unit 32, the atmosphere inside the heat treatment chamber 21 is further heated to a predetermined maximum set temperature equal to or higher than the A3 transformation point.

Figure 16:
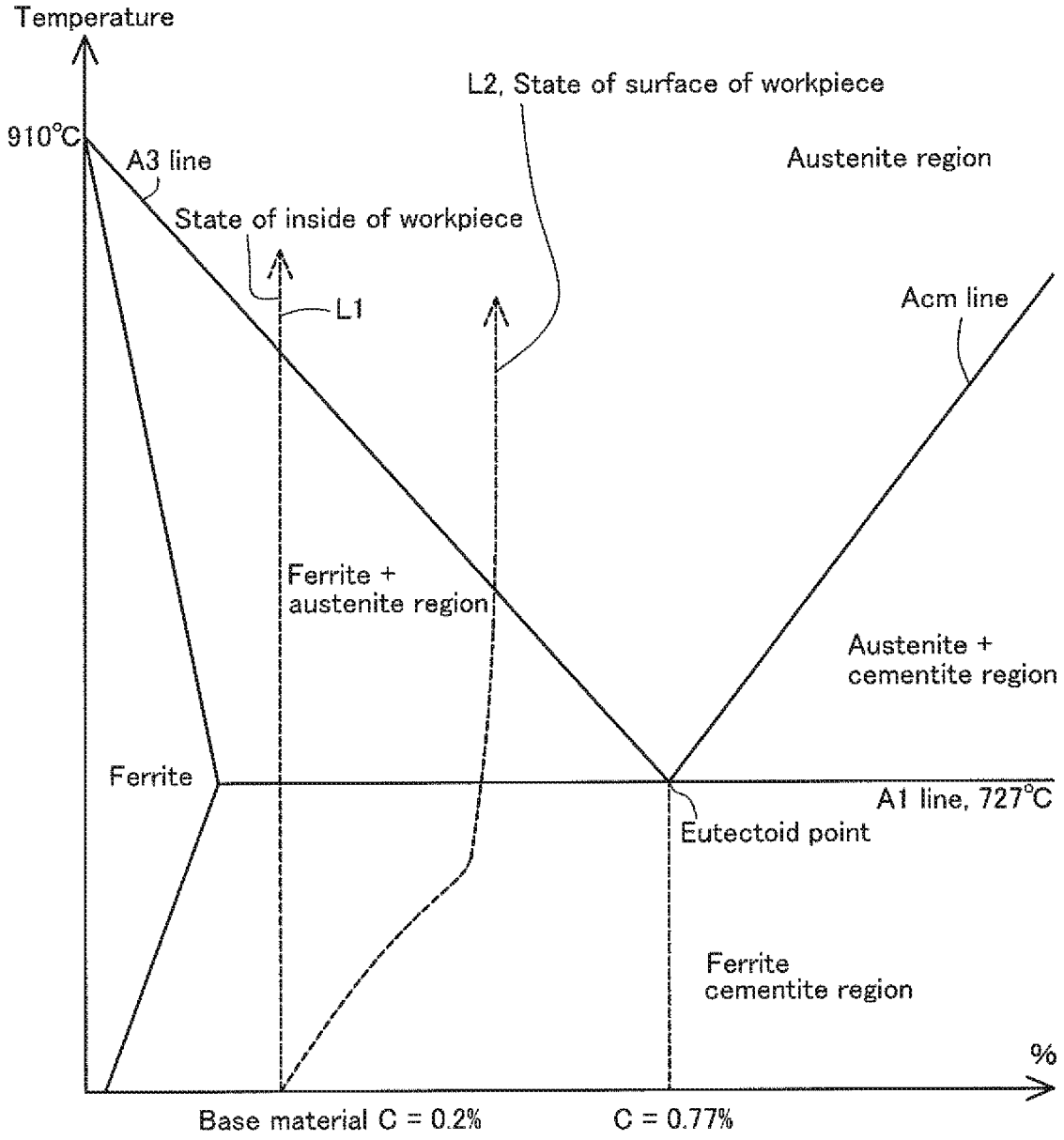
FIG. 16 is a schematic equilibrium state diagram of an Fe—C alloy for describing a state of a workpiece subjected to heat treatment by the heat treatment apparatus.

FIG. 16 is a schematic equilibrium state diagram of an Fe—C alloy for describing a state of the workpieces 10 to be subjected to heat treatment by the heat treatment apparatus 1. In the heating step, the insides of the workpieces 10 are heated to a temperature higher than the A3 transformation point through the course regulated by a line L1 with a dashed arrow L1 in FIG. 1. At this time, the insides of the workpieces 10 turn into a ferrite+cementite state at a temperature equal to or lower than the A1 transformation point. Then, as represented by the line L1, when exceeding the A1 transformation point, the insides of the workpieces 10 transform into a ferrite+austenite state. When the workpieces 10 further rise in temperature and the temperatures of the insides of the workpieces 10 exceed the A3 transformation point, ferrite disappears and the workpieces 10 transform into an austenite state. A carbon potential of the insides of the workpieces 10 does not change even when the workpieces 10 are heated to a temperature higher than the A3 transformation point.

On the other hand, the surfaces of the workpieces increase in carbon potential through the course represented by a line L2 with a dashed arrow L2 in FIG. 16, and roughly converge to a carbon potential of the atmosphere inside the heat treatment chamber 21. The surfaces of the workpieces 10 react to carbon in the atmosphere along with a temperature rise of the atmosphere inside the heat treatment chamber 21. Accordingly, the carbon potential of the surfaces of the workpieces 10 increases. In particular, the surfaces of the workpieces 10 increase in carbon potential substantially in proportion to the temperature rise until reaching the A1 transformation point. Then, when the temperatures of the surfaces of the workpieces 10 become close to the A1 transformation point, the carbon potential of the surfaces of the workpieces 10 becomes substantially constant, while slightly increasing with a temperature rise of the outer surfaces of the workpieces 10. In this way, the surfaces of the workpieces 10 are subjected to carburizing treatment.

In the heating step, by the shielding members (24, 25) disposed between the heaters (22, 23) and the workpieces 10 inside the heat treatment chamber 21, a shielding step (Step S104) of shielding radiation of radiation heat from the heaters (22, 23) to the workpieces is performed. The shielding step is performed during execution of the heating step. More specifically, during the heating step, the shielding step is performed by controlling operations of the switching drive units (26, 27) by control of the control unit 32, and switching the states of the shielding members (24, 25) from the radiation state into the shielding state and maintaining the shielding states.

In the present embodiment, when starting the heating step, the shielding members (24, 25) are in the radiation state. Then, after starting the heating step, based on a temperature measurement result by the temperature measuring unit 28, the control unit 32 controls the switching drive units (26, 27), and in response to activations of the switching drive units (26, 27), the states of the shielding members (24, 25) are switched from the radiation state into the shielding state. More specifically, during heating of the workpieces 10, when a temperature measured by the temperature measuring unit 28 reaches, for example, a predetermined temperature 50° C. lower than the A1 transformation point, by control of the control unit 32, the switching drive units (26, 27) are activated, and the states of the shielding members (24, 25) are switched from the radiation state into the shielding state.

When the states of the shielding members (24, 25) are switched from the radiation state into the shielding state, the shielding state is maintained until the temperature measured by the temperature measuring unit 28 reaches the above-described switching temperature higher than the predetermined temperature 50° C. higher than the A3 transformation point. Then, during heating of the workpieces 10, when the temperature measured by the temperature measuring unit 28 reaches the switching temperature higher than the predetermined temperature 50° C. higher than the A3 transformation point, by control of the control unit 32, the switching drive units (26, 27) are activated, and the states of the shielding members (24, 25) are switched from the shielding state into the radiation state.

During the heating step, when the temperature measured by the temperature measuring unit 28 reaches the predetermined temperature 50° C. lower than the A1 transformation point, the temperatures of the workpieces 10 are lower than the predetermined temperature 50° C. lower than the A1 transformation point. When the temperature measured by the temperature measuring unit 28 reaches the switching temperature higher than the predetermined temperature 50° C. higher than the A3 transformation point, the temperatures of the workpieces 10 have already reached the predetermined temperature 50° C. higher than the A3 transformation point. Therefore, in the present embodiment, when the temperatures of the workpieces 10 are temperatures within a temperature range including the A1 transformation point, and within the temperature range not lower than the temperature 50° C. lower than the A1 transformation point and not higher than the temperature 50° C. higher than the A3 transformation point, the shielding members (24, 25) are maintained in the shielding state.

In the heating step, based on control of the control unit 32, when the atmosphere inside the heat treatment chamber 21 is heated to the predetermined maximum set temperature equal to or higher than the A3 transformation point, this temperature state is maintained for a predetermined period of time. By maintaining the predetermined maximum set temperature for the predetermined period of time, necessary heat treatment is applied to the workpieces 10. After elapse of the predetermined period of time, based on control of the control unit 32, the heating operation of the heaters (22, 23) is stopped, and the temperatures of the workpieces 10 are lowered to a predetermined target temperature inside the heat treatment chamber 21 (Step S103).

When the treatment to lower the temperatures of the workpieces 10 to the predetermined target temperature is finished inside the heat treatment chamber 21, the cases 11 storing the workpieces 10 are conveyed to the outlet door 36*a* by the conveyance rollers 40 driven based on a control command from the control unit 32. After being conveyed to the outlet door 36*a*, the workpieces 10 stored in the cases 11 are carried out of the heat treatment chamber 21 together with the cases 11. To the workpieces 10 carried out of the heat treatment chamber 21, another treatment, for example, quenching treatment in the quenching apparatus 16 is applied.

[Effect of Present Embodiment]

As described above, according to the present embodiment, the heat treatment apparatus 1 includes the heaters (22, 23) to heat metallic workpieces 10 as heating treatment targets, the heat treatment chamber 21 in which the heaters (22, 23) and the workpieces 10 are disposed, and the shielding members (24, 25) that are disposed between the heaters (22, 23) and the workpieces 10 inside the heat treatment chamber 21, and capable of shielding radiation of radiation heat from the heaters (22, 23) to the workpieces 10. The heat treatment method of the present embodiment includes a heating step of heating workpieces 10 by using the heaters (22, 23) inside the heat treatment chamber 21 in which the metallic workpieces 10 as heating treatment targets and the heaters (22, 23) are disposed, and a shielding step performed during execution of the heating step to shield radiation of radiation heat from the heaters (22, 23) to the workpieces 10 by the shielding members (24, 25) disposed between the heaters (22, 23) and the workpieces 10 inside the heat treatment chamber 21.

According to the heat treatment apparatus 1 and the heat treatment method of the present embodiment, by the shielding members (24, 25) disposed between the heaters (22, 23) and the workpieces 10 inside the heat treatment chamber 21, radiation of radiation heat from the heaters (22, 23) to the workpieces 10 can be shielded. Therefore, in a state where radiation of radiation heat from the heaters (22, 23) to the workpieces 10 is shielded by the shielding members (24, 25), heating of the workpieces 10 by radiation heat from the heaters (22, 23) is suppressed, and the workpieces are entirely heated by the atmosphere heated by the heaters (22, 23). That is, a great influence of heating by radiation heat from the heaters (22, 23) on a portion of the workpieces 10 is suppressed, and the workpieces 10 are entirely uniformly heated by the atmosphere heated by the heaters (22, 23). Accordingly, in each of the surfaces and the insides of the workpieces 10, variation in temperature rise among the respective portions of the workpieces 10 is reduced, variation in stress state among the respective portions is reduced, and distortion occurring in the workpieces 10 due to the heat treatment can be made smaller. Therefore, according to the present embodiment, the heat treatment apparatus 1 and the heat treatment method capable of reducing, when applying heat treatment by heating to metallic workpieces 10, variation in temperature rise among the respective portions of the workpieces 10, and reducing distortion due to the heat treatment, can be provided.

According to the present embodiment, the heat treatment apparatus 1 further includes the switching drive units (26, 27) to switch the states of the shielding members (24, 25) by driving the shielding members (24, 25). The switching drive units (26, 27) are configured to switch the states of the shielding members (24, 25) between a radiation state where the shielding members (24, 25) are disposed so as to allow radiation of radiation heat from the heaters (22, 23) to the workpieces 10 and a shielding state where the shielding members (24, 25) are disposed so as to shield radiation heat from the heaters (22, 23) to the workpieces 10, by driving the shielding members (24, 25). According to this configuration, when applying heat treatment by heating to the workpieces 10, the states of the shielding members (24, 25) can be easily switched between the radiation state and the shielding state according to desired conditions such as a heating temperature condition. Therefore, when applying heat treatment by heating to the workpieces 10, in a temperature range in which variation in stress state due to variation in temperature rise among the respective portions of the workpieces 10 easily occurs, by setting the shielding members (24, 25) into the shielding state, variation in temperature rise among the respective portions of the workpieces 10 due to heating by radiation heat can be reduced. In a temperature range in which variation in stress state due to variation in temperature rise among the respective portions of the workpieces 10 hardly occurs, by setting the shielding members (24, 25) into the radiation state, the temperatures of the workpieces 10 can be raised by heating by radiation heat as well.

According to the present embodiment, the switching drive units (26, 27) are configured to maintain the shielding members (24, 25) in the shielding state when the temperatures of the workpieces 10 are within a predetermined temperature range including the A1 transformation point. According to this configuration, when the workpieces 10 are at a temperature within the predetermined temperature range including the A1 transformation point as a temperature at which structures in the workpieces 10 start to transform from a ferrite+cementite state into an austenite state, the shielding members (24, 25) are maintained in the shielding state. Therefore, when heating the workpieces 10, at a timing at which structures of the workpieces 10 start to transform into austenite, heating by radiation heat from the heaters (22, 23) is suppressed, and the workpieces 10 are entirely heated by the atmosphere heated by the heaters (22, 23). Accordingly, in a temperature range including the austenite transformation starting timing, in each of the surfaces and the insides of the workpieces 10, variation in temperature rise among the respective portions of the workpieces 10 is reduced, and in the entirety of the workpieces 10, austenite transformation is more uniformly started. That is, in the respective portions of the workpieces 10, the austenite transformation starting timings can be made more uniform. Accordingly, in the respective portions of the workpieces 10, volume changes occurring at the start of austenite transformation are more uniformly started, variation in stress state among the respective portions is reduced, and distortion occurring in the workpieces 10 can be made smaller. Therefore, according to the configuration described above, distortion occurring when structures of the workpieces 10 start austenite transformation can be made smaller. When heat treatment by heating is applied to the workpieces 10 for carburizing treatment of the workpieces 10, timings of penetration of carbon into the surfaces of the workpieces 10 can be made more uniform. That is, austenite transformation starting timings in the respective portions of the workpieces 10 can be made more uniform, so that the timings of penetration of carbon into the surfaces of the workpieces 10 can be made more uniform. Therefore, according to the configuration described above, at the time of carburizing treatment of the workpieces 10, since timings of penetration of carbon into the surfaces of the workpieces 10 can be made more uniform, distortion occurring in the workpieces 10 can be made smaller.

According to the present embodiment, the predetermined temperature range in which the switching drive units (26, 27) maintain the shielding members (24, 25) in the shielding state is set so as to include the temperature range not lower than the temperature 50° C. lower than the A1 transformation point and not higher than the temperature 50° C. higher than the A3 transformation point. According to this configuration, from the temperature 50° C. lower than the A1 transformation point as a temperature at which structures of the workpieces 10 start austenite transformation to a temperature 50° C. higher than the A3 transformation point as a temperature at which austenite transformation ends, the shielding members (24, 25) are maintained in the shielding state. Therefore, throughout the temperature range from the start to the end of austenite transformation, heating by radiation heat from the heaters (22, 23) is suppressed, and the workpieces 10 are entirely heated by the atmosphere heated by the heaters (22, 23). Accordingly, throughout the temperature range from the start to the end of austenite transformation, in each of the surfaces and insides of the workpieces 10, variation in temperature rise among the respective portions of the workpieces 10 is reduced, and in the entirety of the workpieces 10, austenite transformation more uniformly advances. Therefore, at the respective portions of the workpieces 10, volume changes occurring during austenite transformation more uniformly occur, variation in stress state among the respective portions is reduced, and distortion occurring in the workpieces 10 can be made smaller. Therefore, according to the configuration described above, distortion occurring when structures of the workpieces 10 transform into austenite can be made smaller. According to the configuration described above, from the temperature 50° C. lower than the A1 transformation point, the shielding members (24, 25) are maintained in the shielding state. Therefore, before the start of austenite transformation, variation in temperature rise among the respective portions of the workpieces 10 can be more reliably reduced. According to the configuration described above, until the temperature 50° C. higher than the A3 transformation point is reached, the shielding members (24, 25) are maintained in the shielding state. Therefore, until austenite transformation completely ends, variation in temperature rise among the respective portions of the workpieces 10 can be more reliably reduced.

According to the present embodiment, the apparatus further includes the temperature measuring unit that measures a temperature at a predetermined temperature measurement position inside the heat treatment chamber 21, and the switching drive units (26, 27) are configured to switch the states of the shielding members (24, 25) based on a temperature measurement result by the temperature measuring unit 28. According to this configuration, according to an actual temperature state inside the heat treatment chamber 21, the states of the shielding members (24, 25) can be easily switched between the radiation state and the shielding state.

According to the present embodiment, the switching drive units (26, 27) are configured to switch the states of the shielding members (24, 25) from the radiation state into the shielding state when a temperature measured by the temperature measuring unit 28 reaches a predetermined temperature lower than the A1 transformation point. According to this configuration, during heating of the workpieces 10, when an actual temperature inside the heat treatment chamber 21 reaches a temperature lower than the A1 transformation point, the states of the shielding members (24, 25) are switched into the shielding state. Therefore, at a timing before the start of austenite transformation, variation in temperature rise among the respective portions of the workpieces 10 can be more reliably reduced by suppressing heating by radiation heat from the heaters (22, 23).

According to the present embodiment, each of the shielding members (24, 25) includes the plurality of rotary shafts 42 extending parallel to each other and the plurality of shielding plates 43 supported respectively rotatably around the plurality of rotary shafts 42, and the switching drive units (26, 27) are configured to switch the states of the shielding members (24, 25) from the radiation state into the shielding state by simultaneously rotating the plurality of shielding plates 43. According to this configuration, the states of the shielding members (24, 25) can be more quickly switched from the radiation state into the shielding state.

According to the present embodiment, the shielding plates 43 are fixed to the rotary shafts 42, each of the switching drive units (26, 27) includes a plurality of swing members 44 respectively fixed to the plurality of rotary shafts 42, joint rods (45, 46) joining the plurality of swing members 44, and joint rod drive units (47, 48) that drive the joint rods (45, 46) so as to advance/retreat the joint rods (45, 46), and the plurality of swing members 44 are joined swingably to the joint rods (45, 46). According to this configuration, by advancing or retreating the joint rods (45, 46), the plurality of swing members 44 can be simultaneously swung, and the plurality of shielding plates 43 can be simultaneously rotated together with the plurality of rotary shafts 42. Therefore, a structure to switch the states of the shielding members (24, 25) from the radiation state into the shielding state by simultaneously rotating the plurality of shielding plates 44 constituting the shielding members (24, 25) around the respective rotary shafts 42 can be realized by a simple configuration in which the swing members 44 joined swingably to the joint rods (45, 46) are fixed to the rotary shafts 42.

According to the present embodiment, the heat treatment apparatus 1 includes, in addition to the shielding members (24, 25) and the switching drive units (26, 27), a fan 29 that is disposed to face the workpieces 10 inside the heat treatment chamber 21, and generates air current passing through the circumferences of the workpieces 10. According to this configuration, gas of the atmosphere heated by the heaters (22, 23) is circulated inside the heat treatment chamber 21 by the fan 29 that generates air current passing through the circumferences of the workpieces 10. Therefore, gas of the atmosphere heated by the heaters (22, 23) is always supplied to the circumferences of the workpieces 10, so that the workpieces 10 can be efficiently heated by the atmosphere heated by the heaters (22, 23).

According to the present embodiment, the fan 29 is configured to generate air current passing through the circumferences of the workpieces 10 along a direction parallel to the extending direction of the shielding members (24, 25). According to this configuration, when gas of the atmosphere heated by the heaters (22, 23) is circulated inside the heat treatment chamber 21 by the fan 29 that generates air current passing through the circumferences of the workpieces 10, the shielding members (24, 25) function as straightening members. Therefore, the workpieces 10 can be more efficiently heated by the atmosphere heated by the heaters (22, 23).

According to the present embodiment, the heat treatment apparatus 1 includes the heat treatment chamber 21, the centrifugal fan 29, and the air current regulation unit 30. The heat treatment chamber 21 has a pair of side walls (33, 34) disposed parallel to each other, and metallic workpieces 10 as heat treatment targets are disposed between the pair of side walls (33, 34). The centrifugal fan 29 is disposed to face the workpieces 10 inside the heat treatment chamber 21, and generates air current by sucking gas from the workpiece 10 side. In regions at the respective side wall (33, 34) sides relative to the intermediate position M1 between the pair of side walls (33, 34) inside the heat treatment chamber 21, the air current regulation unit 30 regulates flows of air current from the centrifugal fan 29 to the respective side wall (33, 34) sides when the rotary blade 50 of the centrifugal fan 29 rotates, so as to restrict the flows of air current in regions (R1, R2) in which outer circumferential edge portions 50*c* of the rotating rotary blade 50 separate from the respective side walls (33, 34), and allow the flows of air current in the regions (P1, P2) in which the outer circumferential edge portions 50*c* of the rotating rotary blade 50 approach the respective side walls (33, 34).

According to the configuration described above, between the pair of side walls (33, 34) parallel to each other inside the heat treatment chamber 21, by rotation of the centrifugal fan 29 disposed to face the workpieces 10 in the rotation direction X5, gas at the workpiece 10 side is sucked and air current flowing outward in radial directions of the centrifugal fan 29 is generated. Then, the air current sucked from the workpiece 10 side and flowed outward in radial directions of the centrifugal fan 29 by the centrifugal fan 29 flows while being regulated by the air current regulation unit 30. Specifically, in regions (R1, R2) which are at the respective side wall (33, 34) sides relative to the intermediate position M1 between the pair of side walls (33, 34) inside the heat treatment chamber 21 and in which the outer circumferential edge portions 50*c* of the rotary blade 50 rotating in the rotation direction X5 separate from the respective side walls (33, 34), flows of air current from the centrifugal fan 29 to the respective side wall (33, 34) sides are restricted. In the regions (P1, P2) which are at the respective side wall (33, 34) sides relative to the intermediate position M1 between the pair of side walls (33, 34) inside the heat treatment chamber 21 and in which the outer circumferential edge portions 50*c* of the rotary blade 50 rotating in the rotation direction X5 approach the respective side walls (33, 34), flows of air current from the centrifugal fan 29 to the respective side wall (33, 34) sides are allowed. Accordingly, when the centrifugal fan 29 rotates between the pair of side walls (33, 34) parallel to each other inside the heat treatment chamber 21, air current that was sucked from the workpiece 10 side and flowed outward in radial directions of the centrifugal fan 29 further flows along the respective side walls (33, 34) while flowing toward the respective side walls (33, 34) due to an air blowing operation caused by rotation of the centrifugal fan 29 and an air current flow direction regulating operation by the air current regulation unit 30. The air current that flowed along the respective side walls (33, 34) passes through the workpieces 10 and is sucked by the centrifugal fan 29, and flows outward in radial directions of the centrifugal fan 29 again. Accordingly, the atmosphere inside the heat treatment chamber 21 entirely efficiently circulates and flows so as to flow along the respective side walls (33, 34) after passing through the workpieces 10, and pass through the workpieces 10 again as represented by the flow directions X6 in FIG. 13 and FIG. 14.

According to the configuration described above, conventional generation of a flow deflected to a region having less flow resistance between the pair of side walls can be suppressed, and the atmosphere inside the heat treatment chamber 21 can be entirely efficiently circulated during heat treatment. According to the configuration described above, the atmosphere inside the heat treatment chamber 21 can be entirely efficiently circulated during heat treatment, and in a state where variation in temperature distribution of the atmosphere inside the heat treatment chamber 21 is suppressed, the atmosphere inside the heat treatment chamber 21 can be entirely more uniformly changed in temperature. Accordingly, in each of the surfaces and insides of the workpieces 10, variation in temperature change state among the respective portions of the workpieces 10 during heat treatment is reduced, and variation in stress state among the respective portions is reduced, so that distortion due to heat treatment can be made smaller. Therefore, according to the configuration described above, a heat treatment apparatus 1 capable of making smaller distortion caused by heat treatment when applying the heat treatment to metallic workpieces 10 by reducing variation in temperature change state among the respective portions of the workpieces 10 during the heat treatment, can be provided.

In addition, according to the present embodiment, the heat treatment apparatus 1 further includes the pair of heaters (22, 23) respectively disposed along the pair of side walls (33, 34) inside the heat treatment chamber 21, and the centrifugal fan 29 and the workpieces 10 are disposed between the pair of heaters (22, 23). According to this configuration, the atmosphere inside the heat treatment chamber 21 is heated by the pair of heaters (22, 23) disposed along the pair of side walls (33, 34), and heat treatment by heating is applied to the workpieces 10 disposed inside the heat treatment chamber 21. According to the configuration described above, when the centrifugal fan 29 rotates between the pair of heaters (22, 23) disposed along the pair of side walls (33, 34) parallel to each other inside the heat treatment chamber 21, air current that was sucked from the workpiece 10 side and flowed outward in radial directions of the centrifugal fan 29 further flows along the respective side walls (33, 34) and the respective heaters (22, 23) while flowing toward the respective side walls (33, 34) and the respective heaters (22, 23) due to an air blowing operation caused by rotation of the centrifugal fan 29 and an air current flow direction regulating operation by the air current regulation unit 30. The air current that flowed along the respective side walls (33, 34) and the respective heaters (22, 23) passes through the workpieces 10 and is sucked by the centrifugal fan 29, and flows outward in radial directions of the centrifugal fan 29 again. Accordingly, during the heat treatment by heating, the atmosphere inside the heat treatment chamber 21 entirely efficiently circulates and flows so as to flow along the respective side walls (33, 34) and the respective heaters (22, 23) after passing through the workpieces 10, and pass through the workpieces 10 again.

Therefore, according to the configuration described above, generation of air current deflected to a region having less flow resistance between the pair of heaters (22, 23) respectively disposed along the pair of side walls (33, 34) can be suppressed, and the atmosphere inside the heat treatment chamber 21 can be entirely efficiently circulated during heat treatment by heating. According to the configuration described above, the atmosphere inside the heat treatment chamber 21 can be entirely efficiently circulated during heat treatment by heating, and in a state where variation in temperature distribution when the temperature of the atmosphere inside the heat treatment chamber 21 rises is suppressed, the atmosphere inside the heat treatment chamber 21 can be entirely more uniformly raised and changed in temperature. Accordingly, in each of the surfaces and the insides of the workpieces 10, variation in temperature change state when rising in temperature among the respective portions of the workpieces 10 during heat treatment is reduced, variation in stress state among the respective portions is reduced, and distortion due to the heat treatment during heating can be made smaller.

According to the present embodiment, the heat treatment chamber 21 has the first side wall 33 and the second side wall 34 as the pair of side walls (33, 34), and the air current regulation unit 30 includes the first air current restricting member 51 and the second air current restricting member 52. The first air current restricting member 51 restricts a flow of air current from the centrifugal fan 29 to the first side wall 33 side in the region R1 which is at the first side wall 33 side relative to the intermediate position M1 inside the heat treatment chamber 21 and in which the outer circumferential edge portions 50*c* of the rotary blade 50 separate from the first side wall 33 during rotation of the rotary blade 50. Further, the second air current restricting member 52 restricts a flow of air current from the centrifugal fan 29 to the second side wall 34 side in the region R2 which is at the second side wall 34 side relative to the intermediate position M1 inside the heat treatment chamber 21 and in which the outer circumferential edge portions 50*c* of the rotary blade 50 separate from the second side wall 34 during rotation of the rotary blade 50. According to this configuration, the air current regulation unit 30 can be realized by a simple structure provided with two members including the first and second air current restricting members (51, 52).

According to the present embodiment, the first air current restricting member 51 and the second air current restricting member 52 respectively have curved wall surfaces (51*b*, 52*b*) disposed so as to curve along the outer circumference of the centrifugal fan 29. According to this configuration, when flows of air current from the centrifugal fan 29 to the respective side wall (33, 34) sides are respectively restricted by the first and second air current restricting members (51, 52), the flows of air current whose flow directions are restricted, smoothly flow along the curved wall surfaces (51*b*, 52*b*) disposed so as to curve along the outer circumference of the centrifugal fan 29. Therefore, an increase in pressure loss caused when the flows of air current from the centrifugal fan 29 to the respective side wall (33, 34) sides are restricted by the respective first and second air current restricting members (51, 52) can be suppressed.

According to the present embodiment, the first curved wall surface 51*b* as a curved wall surface of the first air current restricting member 51 and the second curved wall surface 52*b* as a curved wall surface of the second air current restricting member 52 are disposed to face each other across the centrifugal fan 29, and the first curved wall surface 51*b* and the second curved wall surface 52*b* are configured so that their dimensions in a direction extending from the workpiece 10 side toward the opposite side of the workpiece 10 side become larger than those of the rotary blade 50 of the centrifugal fan 29. According to this configuration, the heights of the respective first and second curved wall surfaces (51*b*, 52*b*) are set to be larger than the height of the rotary blade 50 of the centrifugal fan 29. Therefore, by the first and second air current restricting members (51, 52) provided with the respective curved wall surfaces (51*b*, 52*b*), air current that was sucked from the workpiece 10 side and flowed outward in radial directions of the centrifugal fan 29 by the centrifugal fan 29 can be more completely regulated, and flow directions of the air current can be more stably regulated.

According to the present embodiment, the first curved wall surface 51*b* and the second curved wall surface 52*b* are provided so as to extend from the workpiece 10 side to the opposite side of the workpiece 10 side to extend and approach each other toward the outer circumferential edge portions 50*c* of the rotary blade 50 of the centrifugal fan 29. According to this configuration, the first and second curved wall surfaces (51*b*, 52*b*) are configured to separate at the workpiece 10 side as a sucking side at which gas is sucked by the centrifugal fan 29, and approach each other toward the side opposite the sucking side. That is, the region between the first and second curved wall surfaces (51*b*, 52*b*) disposed to face each other across the centrifugal fan 29 is set to become wide at the sucking side at which gas is sucked by the centrifugal fan 29 and become narrow at the side opposite the sucking side. Therefore, when gas at the workpiece 10 side is sucked and air current that flows outward in radial directions of the centrifugal fan 29 and is regulated in flow direction by the air current regulation unit 30 is generated, flowing of the air current can be made faster. That is, flows of air current that are blown by rotation of the centrifugal fan 29 and regulated in flow direction by the air current regulation unit 30 and flow toward the respective side walls (33, 34) can be made faster in speed. Accordingly, the atmosphere inside the heat treatment chamber 21 can be entirely more efficiently circulated during heat treatment.

Example

By using a heat treatment apparatus according to an example having the same configuration as that of the heat treatment apparatus 1 described in the embodiment described above, and a heat treatment apparatus according to a comparative example having the same configuration as a conventional configuration, heat treatment by heating was applied to ring-shaped metallic workpieces 10, and temperature changes of the workpieces 10 during the heat treatment were measured. The heat treatment apparatus according to the comparative example is configured as a heat treatment apparatus not including the shielding members (24, 25), the switching drive units (26, 27), and the air current regulation unit 30 in the heat treatment apparatus 1.

In the heat treatment using the heat treatment apparatus according to the example, the heat treatment was applied to the workpieces 10 by maintaining the shielding members (24, 25) in the shielding state continuously from the start of heating. In each of the heat treatment using the heat treatment apparatus according to the example and the heat treatment using the heat treatment apparatus according to the comparative example, the centrifugal fan 29 was rotated continuously from the start of heating to the end of heating. In each of the heat treatment using the heat treatment apparatus according to the example and the heat treatment using the heat treatment apparatus according to the comparative example, temperatures at a plurality of positions on the surface of the workpiece 10 were measured continuously from the start of heating. More specifically, thermocouples were attached to a plurality of positions in the circumferential direction on the surface of each ring-shaped workpiece 10, temperatures of the workpiece 10 were measured, and temperature changes of the workpiece 10 during heat treatment were measured.

Figure 17A:
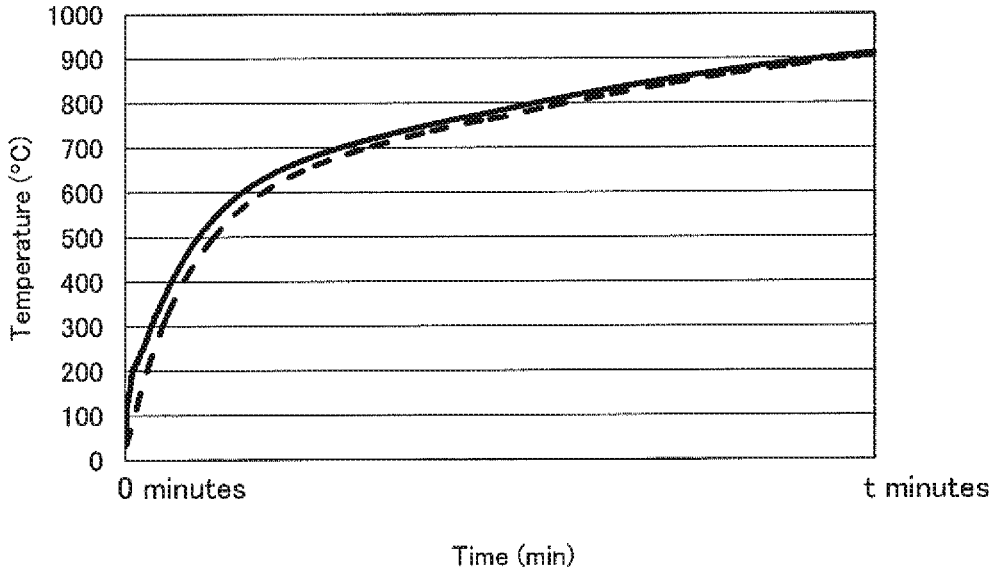
FIGS. 17A and 17B are diagrams illustrating measurement results of temperature changes of a workpiece during heat treatment.
Figure 17B:
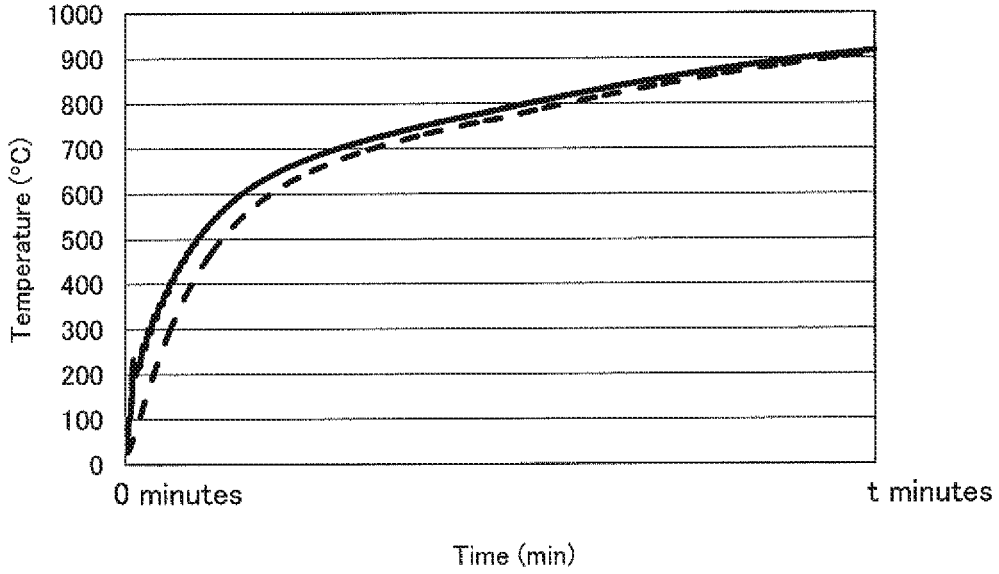
Figure 18A:
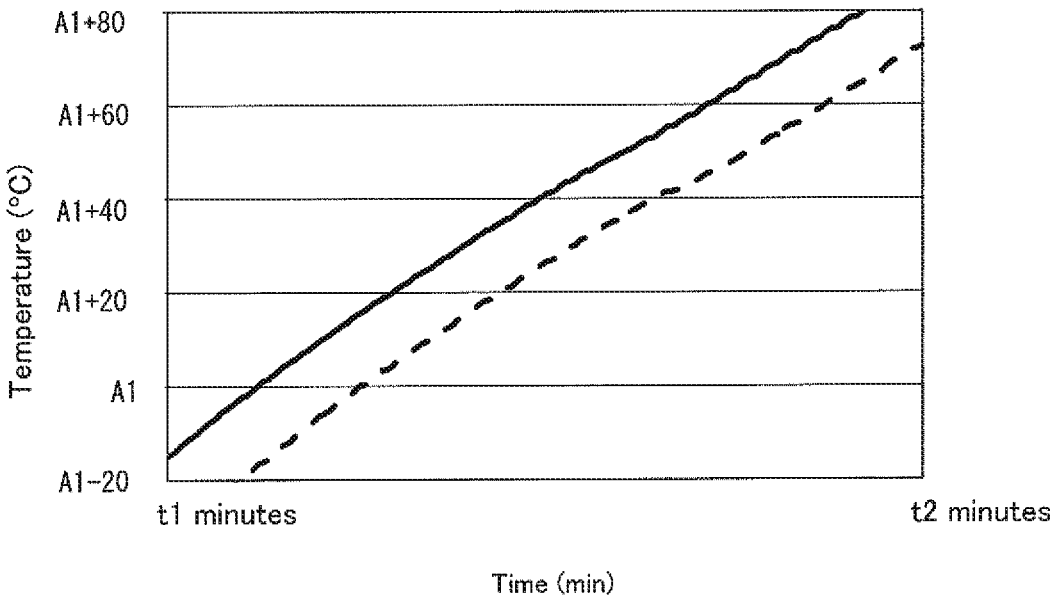
FIGS. 18A and 18B are diagrams illustrating measurement results of temperature changes of a workpiece during heat treatment.
Figure 18B:
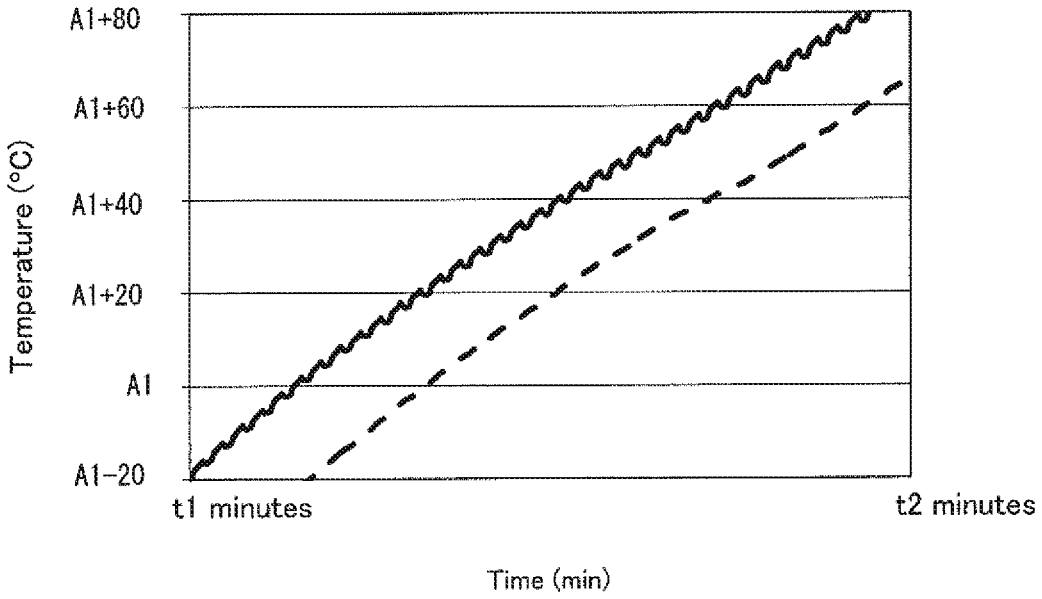

FIG. 17A, FIG. 17B, FIG. 18A, and FIG. 18B are diagrams illustrating measurement results of temperature changes of the workpiece 10 during heat treatment. FIG. 17A and FIG. 18A illustrate temperature measurement results of the workpiece 10 subjected to heat treatment by the heat treatment apparatus of the example, and FIG. 17B and FIG. 18B illustrate temperature measurement results of the workpiece 10 subjected to heat treatment by the heat treatment apparatus of the comparative example. In FIG. 17A, FIG. 17B, FIG. 18A, and FIG. 18B, temperatures measured by the thermocouples are represented on the vertical axis, and elapsed times (minutes) during heating are represented on the horizontal axis. In FIG. 17A and FIG. 17B, measurement results of temperature changes of the workpiece 10 during a period from the time (0 minutes) of the start of heating to a time (t minutes) at which the measured temperature of the workpiece 10 reaches a temperature sufficiently exceeding the A3 transformation point are illustrated. On the other hand, FIGS. 18A and 18B illustrate parts of temperature changes illustrated in FIGS. 17A and 17B in an enlarged manner, and FIG. 18A illustrates a part of FIG. 17A in an enlarged manner, and FIG. 18B illustrates a part of FIG. 17B in an enlarged manner. More specifically, in FIG. 18A and FIG. 18B, measurement results of temperature changes of the workpiece 10 during a period from a time (t1 minutes) at which the measured temperature of the workpiece 10 is somewhat lower than the A1 transformation point to a time (t2 minutes) at which the measured temperature of the workpiece 10 has become somewhat higher than the A1 transformation point. In FIG. 18A and FIG. 18B, temperatures on the vertical axis representing measured temperatures are indicated as temperatures relative to the A1 transformation point, and temperatures from a temperature 20° C. lower than the A1 transformation point to a temperature 80° C. higher than the A1 transformation point are indicated. In FIG. 17A, FIG. 17B, FIG. 18A, and FIG. 18B, among the plurality of temperature measurement positions in the circumferential direction on the surface of the ring-shaped workpiece 10, temperature measurement results at a position at which the temperature most rapidly rose are represented by a solid line, and temperature measurement results at a position at which the temperature most gently rose are represented by a dashed line.

As illustrated in FIG. 17B and FIG. 18B, in the workpiece 10 subjected to heat treatment by the heat treatment apparatus of the comparative example, great variation in temperature rise was observed between a position at which the temperature most rapidly rose and a position at which the temperature most gently rose. In the workpiece 10 subjected to heat treatment by the heat treatment apparatus of the comparative example, a largest difference in temperature rise was observed between a portion disposed to face the heaters (22, 23) and a portion disposed not to face the heaters (22, 23) and most distant from the heaters (22, 23). That is, among the plurality of temperature measurement positions in the circumferential direction on the surface of the workpiece 10, the most rapid temperature rise occurred at a portion facing the heaters (22, 23), and a most gentle temperature rise occurred at a position that does not face the heaters (22, 23) and is most distant from the heaters (22, 23).

On the other hand, as illustrated in FIG. 17A and FIG. 18A, in the workpiece 10 subjected to heat treatment by the heat treatment apparatus of the example, variation in temperature rise between a position with a most rapid temperature rise and a position with a most gentle temperature rise was greatly reduced. Therefore, it was proved that variation in temperature rise among the respective portions of the workpiece 10 during heat treatment could be reduced by applying the heat treatment to the workpiece 10 by the heat treatment apparatus of the example. Accordingly, when applying heat treatment to the workpiece 10, distortion due to the heat treatment can be made smaller.

[Modifications]

Although an embodiment of the present invention is described above, the present invention is not limited to the embodiment described above, and can be variously changed within the scope of the claims. That is, the present invention is not limited to the embodiment described above, and is intended so that modifications and applications related to those included in the claims and to be clarified by reading and understanding this description, and equivalents, are all included in the scope of the present invention. For example, the following modifications may be carried out.

Figure 19:
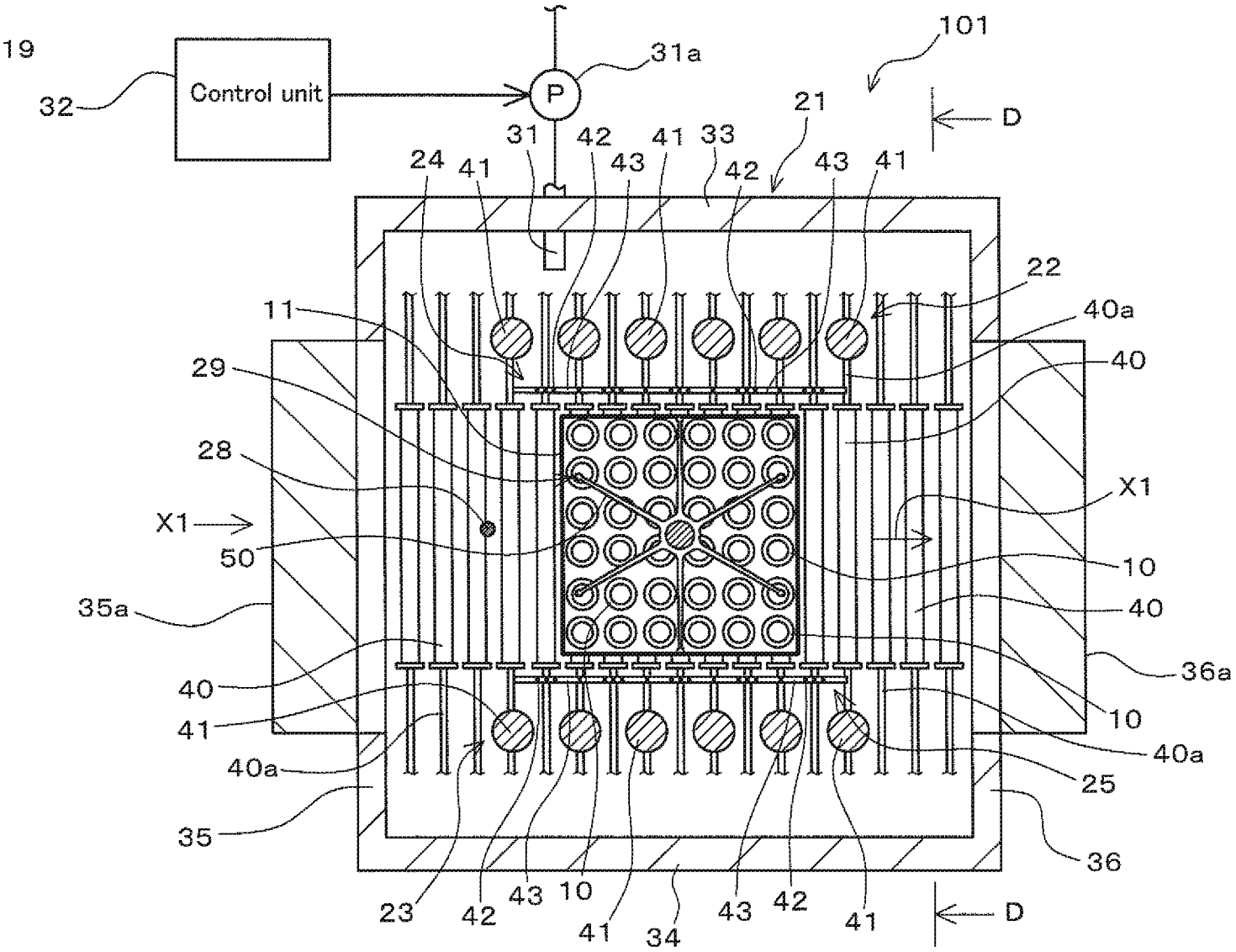
FIG. 19 is a schematic sectional view of a heat treatment apparatus according to a first modification, illustrating a state viewed from the arrow line E-E position in FIG. 20.
Figure 20:
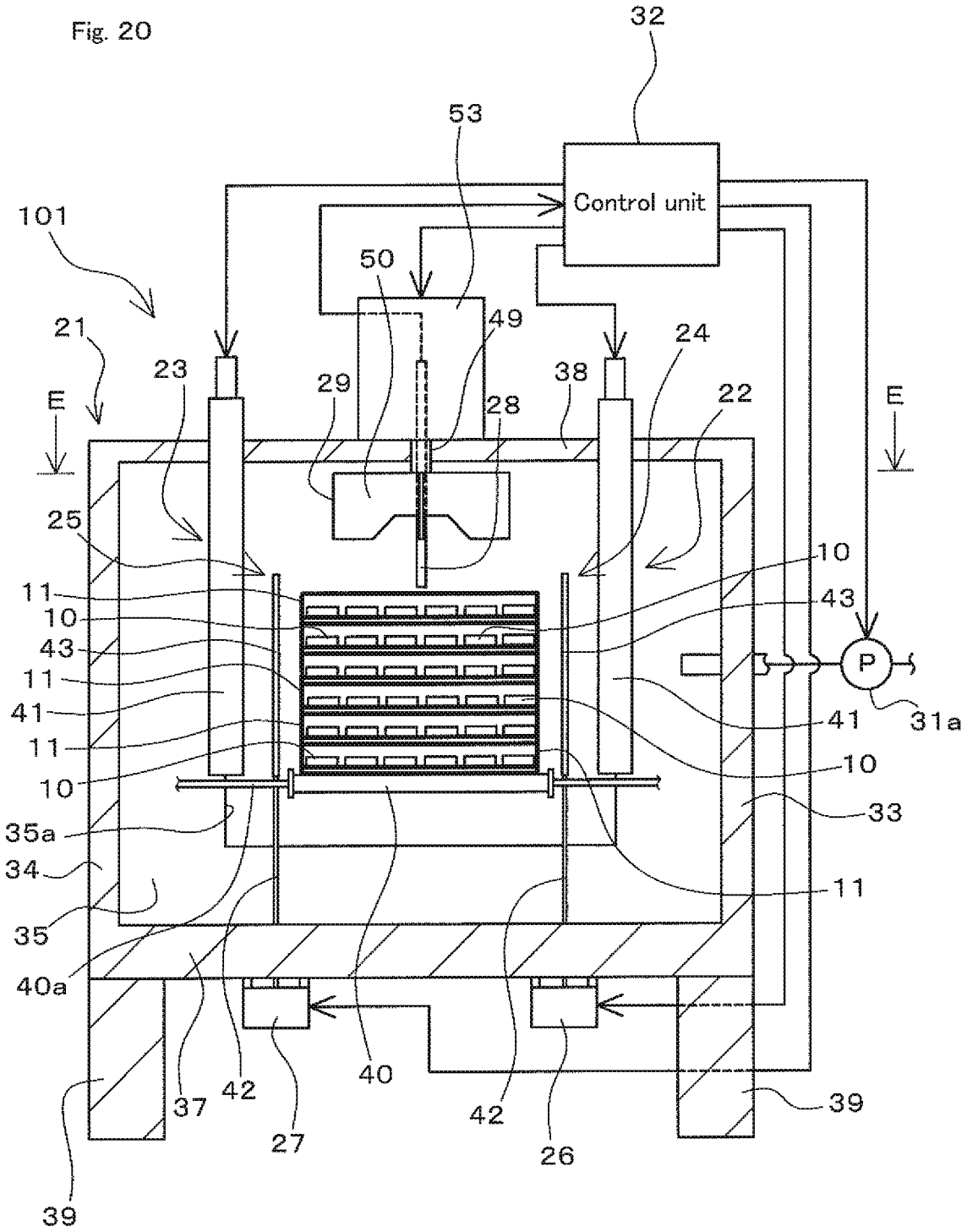
FIG. 20 is a schematic sectional view of the heat treatment apparatus according to the first modification, illustrating a state viewed from the arrow line D-D position in FIG. 19.

FIG. 19 and FIG. 20 are schematic sectional views of a heat treatment apparatus 101 according to a first modification. FIG. 19 is a sectional view illustrating a state viewed from the arrow line E-E position in FIG. 20, and FIG. 20 is a sectional view illustrating a state viewed from the arrow line D-D position in FIG. 19. In the following description about the first modification, differences from the embodiment described above are described, and components similar to or corresponding to those in the embodiment described above are provided with the same reference signs or described by quoting the same reference signs in the drawings, and overlapping description will be omitted.

The heat treatment apparatus 1 of the embodiment described above was configured to include the shielding members (24, 25), the switching drive units (26, 27), and the air current regulation unit 30. On the other hand, the heat treatment apparatus 101 according to the first modification is different from the heat treatment apparatus of the embodiment described above in that the heat treatment apparatus 101 does not include the air current regulation unit 30 although including the shielding members (24, 25) and the switching drive units (26, 27).

According to the heat treatment apparatus 101 of the first modification and a heat treatment method to be executed by using the heat treatment apparatus 101, by the shielding members (24, 25) disposed between the heaters (22, 23) and the workpieces 10 inside the heat treatment chamber 21, radiation of radiation heat from the heaters (22, 23) to the workpieces 10 can be shielded. Therefore, in a state where radiation of radiation heat from the heaters (22, 23) to the workpieces 10 is shielded by the shielding members (24, 25), heating of the workpieces 10 by radiation heat from the heaters (22, 23) is suppressed, and the workpieces are entirely heated by the atmosphere heated by the heaters (22, 23). That is, a great influence of heating by radiation heat from the heaters (22, 23) on portions of the workpieces 10 is suppressed, and the workpieces 10 are entirely more uniformly heated by the atmosphere heated by the heaters (22, 23). Accordingly, in each of the surfaces and insides of the workpieces 10, variation in temperature rise among the respective portions of the workpieces 10 is reduced, variation in stress state among the respective portions is reduced, and distortion occurring in the workpieces 10 due to the heat treatment can be made smaller. Therefore, according to the heat treatment apparatus 101 of the first modification and the heat treatment method to be executed by using the heat treatment apparatus 101, when applying heat treatment by heating to metallic workpieces 10, variation in temperature rise among the respective portions of the workpieces 10 can be reduced, and distortion due to the heat treatment can be made smaller.

Figure 21:
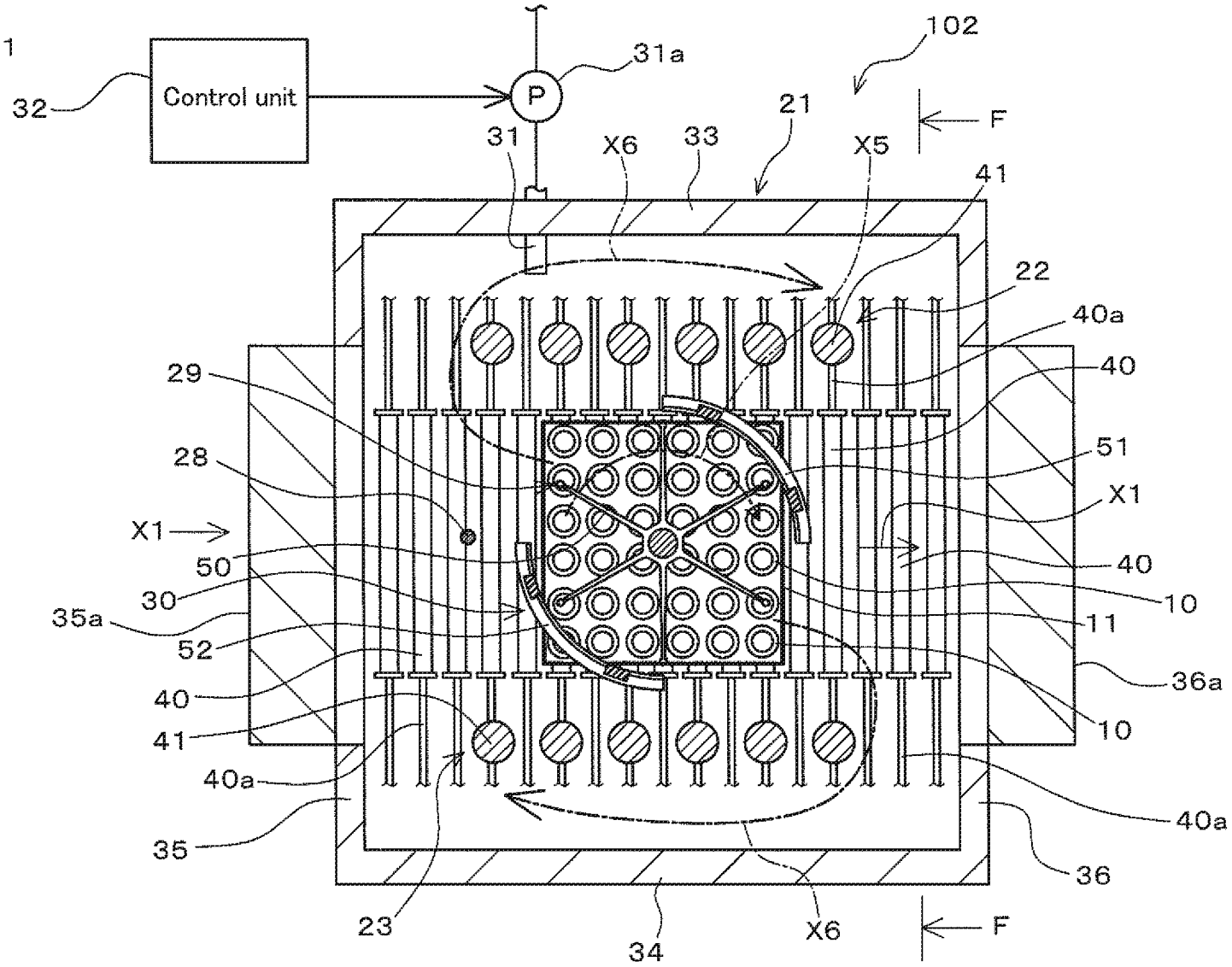
FIG. 21 is a schematic sectional view of a heat treatment apparatus according to a second modification, illustrating a state viewed from the arrow line G-G position in FIG. 22.
Figure 22:
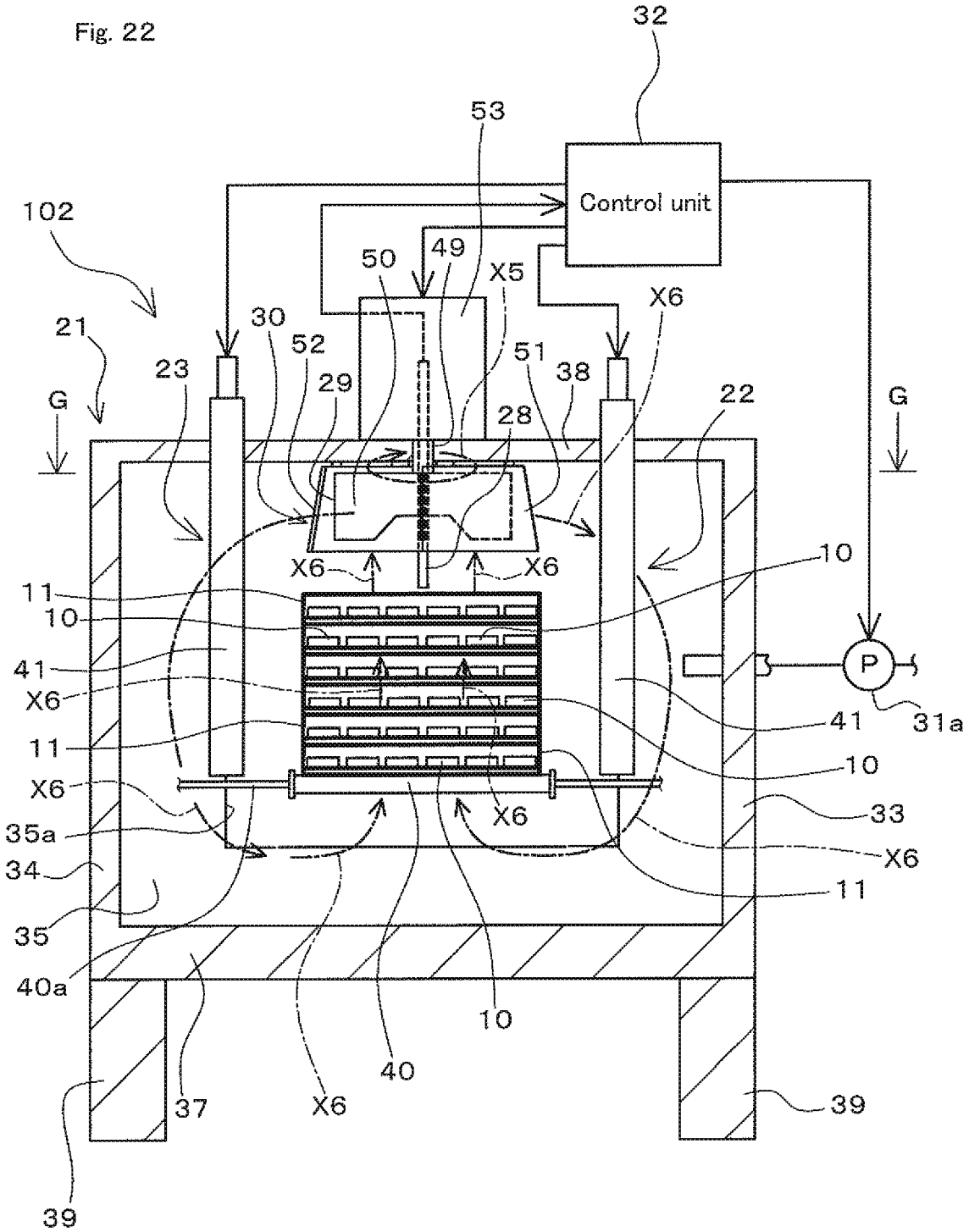
FIG. 22 is a schematic sectional view of the heat treatment apparatus according to the second modification, illustrating a state viewed from the arrow line F-F position in FIG. 21.

FIG. 21 and FIG. 22 are schematic sectional views of a heat treatment apparatus 102 according to a second modification. FIG. 21 is a sectional view illustrating a state viewed from the arrow line G-G position in FIG. 22, and FIG. 22 is a sectional view illustrating a state viewed from the arrow line F-F position in FIG. 21. In the following description about the second modification, differences from the embodiment described above will be described, and components similar to or corresponding to those in the embodiment described above will be provided with the same reference signs or described by quoting the same reference signs in the drawings, and overlapping description will be omitted.

The heat treatment apparatus 1 of the embodiment described above was configured to include the shielding members (24, 25), the switching drive units (26, 27), and the air current regulation unit 30. On the other hand, the heat treatment apparatus 102 according to the second modification is different from the heat treatment apparatus of the embodiment described above in that the heat treatment apparatus 102 does not include the shielding members (24, 25) and the switching drive units (26, 27) although including the air current regulation unit 30.

According to the heat treatment apparatus 102 of the second modification, between the pair of side walls (33, 34) parallel to each other in the heat treatment chamber 21, by rotation of the centrifugal fan 29 disposed to face the workpieces 10 in the rotation direction X5, gas at the workpiece 10 side is sucked and air current flowing outward in radial directions of the centrifugal fan 29 is generated. Then, the air current that was sucked from the workpiece 10 side and flowed outward in radial directions of the centrifugal fan 29 by the centrifugal fan 29 flows while being regulated by the air current regulation unit 30. Specifically, in regions (R1, R2) which are at the respective side wall (33, 34) sides relative to the intermediate position M1 between the pair of side walls (33, 34) inside the heat treatment chamber 21 and in which the outer circumferential edge portions 50*c* of the rotary blade 50 rotating in the rotation direction X5 separate from the respective side walls (33, 34), flows of air current from the centrifugal fan 29 to the respective side wall (33, 34) sides are restricted. In regions which are at the respective side wall (33, 34) sides relative to the intermediate position M1 between the pair of side walls (33, 34) inside the heat treatment chamber 21 and in which the outer circumferential edge portions 50*c* of the rotary blade 50 rotating in the rotation direction X5 approach the respective side walls (33, 34), flows of air current from the centrifugal fan 29 to the respective side wall (33, 34) sides are allowed. Accordingly, when the centrifugal fan 29 rotates between the pair of side walls (33, 34) parallel to each other in the heat treatment chamber 21, air current that was sucked from the workpiece 10 side and flowed outward in radial directions of the centrifugal fan 29 further flow along the respective side walls (33, 34) while flowing toward the respective side walls (33, 34) due to an air blowing operation caused by rotation of the centrifugal fan 29 and an air current flow direction regulating operation by the air current regulation unit 30. Air current that flowed along the respective side walls (33, 34) passes through the workpieces 10 and is sucked by the centrifugal fan 29, and flows outward in radial directions of the centrifugal fan 29 again. Accordingly, during heat treatment, the atmosphere inside the heat treatment chamber 21 entirely efficiently circulates and flows so as to flow along the respective side walls (33, 34) after passing through the workpieces 10, and pass through the workpieces 10 again as represented by the flow directions X6 in FIG. 21 and FIG. 22.

Therefore, according to the heat treatment apparatus 102 of the second modification, conventional generation of air current deflected to a region having less flow resistance between the pair of side walls can be suppressed, and the atmosphere inside the heat treatment chamber 21 can be entirely efficiently circulated. According to the heat treatment apparatus 102 of the second modification, the atmosphere inside the heat treatment chamber 21 is entirely efficiently circulated during heat treatment, and in a state where variation in temperature distribution of the atmosphere inside the heat treatment chamber 21 is suppressed, the atmosphere inside the heat treatment chamber 21 can be entirely more uniformly changed in temperature. Accordingly, in each of the surfaces and insides of the workpieces 10, variation in temperature change state among the respective portions of the workpieces 10 during heat treatment can be reduced, and distortion due to the heat treatment can be made smaller. Therefore, according to the heat treatment apparatus 102 of the second modification, when applying heat treatment to metallic workpieces 10, variation in temperature change state among the respective portions of the workpieces 10 during the heat treatment can be reduced, and distortion due to the heat treatment can be made smaller.

Figure 23:
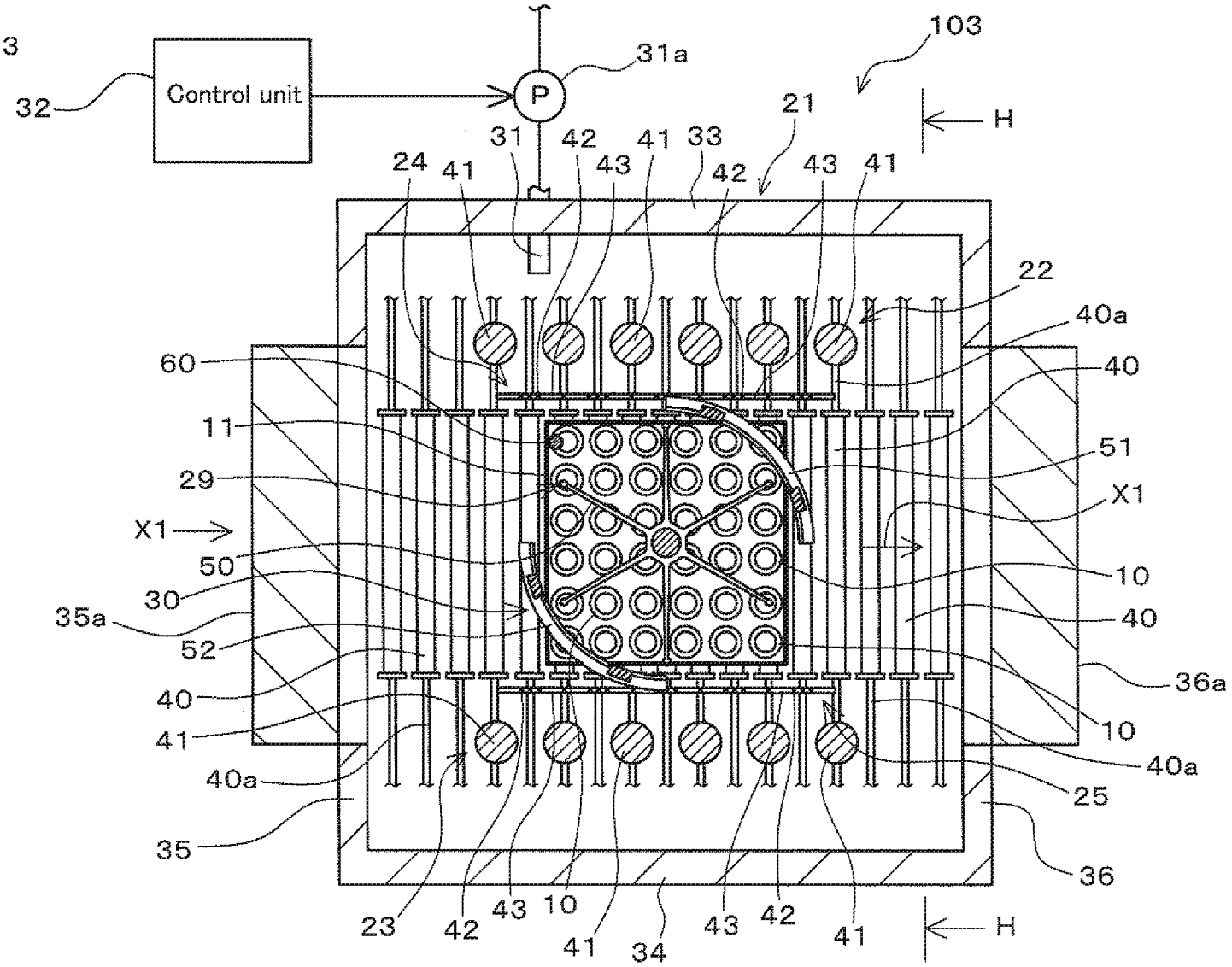
FIG. 23 is a schematic sectional view of a heat treatment apparatus according to a third modification, illustrating a state viewed from the arrow line I-I position in FIG. 24.
Figure 24:
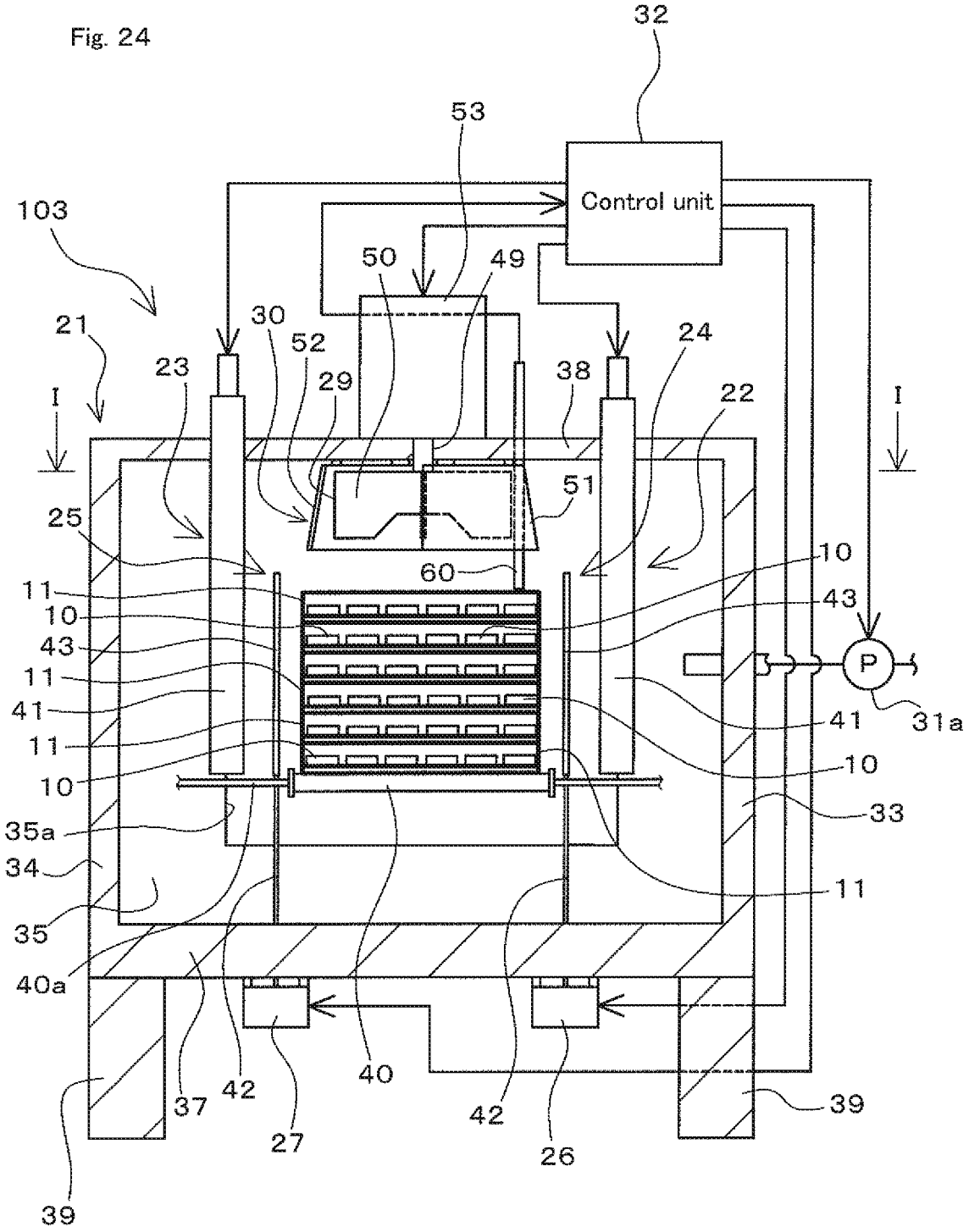
FIG. 24 is a schematic sectional view of the heat treatment apparatus according to the third modification, illustrating a state viewed from the arrow line H-H position in FIG. 23.

FIG. 23 and FIG. 24 are schematic sectional views of a heat treatment apparatus 103 according to a third modification. FIG. 23 is a sectional view illustrating a state viewed from the arrow line I-I position in FIG. 24, and FIG. 24 is a sectional view illustrating a state viewed from the arrow line H-H position in FIG. 23. In the following description about the third modification, differences from the embodiment described above will be described, and components similar to or corresponding to those in the embodiment described above will be provided with the same reference signs or described by quoting the same reference signs in the drawings, and overlapping description will be omitted.

The heat treatment apparatus 1 of the embodiment described above is configured so that the temperature measuring unit 28 measures a temperature at a predetermined temperature measurement position inside the heat treatment chamber 21 to measure the atmosphere inside the heat treatment chamber 21. On the other hand, the heat treatment apparatus 103 according to the third embodiment is configured to include a temperature measuring unit 60 that measures not a temperature of the atmosphere inside the heat treatment chamber 21 but a temperature of the workpiece 10.

The temperature measuring unit 60 is configured to include, for example, a radiation thermometer, and is provided as a temperature sensor to measure a temperature of one of the workpieces 10 disposed inside the heat treatment chamber 21. The temperature measuring unit 60 includes, for example, a thermometer storage case that extends downward in a tubular shape from the ceiling wall inside the heat treatment chamber 21 and stores the radiation thermometer inside. Into and from the thermometer storage case, a cooling gas is supplied from and discharged to the outside so as to cool and protect the radiation thermometer inside the thermometer storage case. The temperature measuring unit 60 is installed inside the heat treatment chamber 21 so as to face a workpiece 10 disposed at a predetermined position inside the heat treatment chamber 21. For example, the temperature measuring unit 60 is installed inside the heat treatment chamber 21 so as to face a workpiece 10 stored and disposed at a predetermined position in a top case 11 of cases 11 disposed inside the heat treatment chamber 21 from above the workpiece 10 as illustrated in FIG. 23 and FIG. 24. The temperature measuring unit 60 is configured to measure a temperature of the workpiece 10 facing the temperature measuring unit 60 during the heat treatment. In the temperature measuring unit 60, at a lower end portion of the thermometer storage case facing the workpiece 10, for example, a transparent window member having heat resistance in a high-temperature region is provided, and the radiation thermometer stored in the thermometer storage case is configured to measure a temperature of the workpiece 10 via the window member.

The temperature measuring unit 60 is connected to the control unit 32, and a temperature measurement result by the temperature measuring unit 60 is input into the control unit 32. Then, the control unit 32 controls the switching drive units (26, 27) based on the temperature measurement result by the temperature measuring unit 60. The switching drive units (26, 27) are controlled by the control unit 32 based on the temperature measurement result by the temperature measuring unit 60, and switch the states of the shielding members (24, 25) between the shielding state and the radiation state.

The switching drive units (26, 27) are configured to switch the states of the shielding members (24, 25) from the radiation state into the shielding state when the temperature measured by the temperature measuring unit 60 reaches a temperature equal to the A1 transformation point or a predetermined temperature lower than the A1 transformation point according to control of the control unit 32 based on the temperature measurement result by the temperature measuring unit 60. In the case where the states of the shieling members (24, 25) are switched from the radiation state into the shielding state when the measured temperature is at the predetermined temperature lower than the A1 transformation point, the switching drive units (26, 27) are configured to maintain the shielding members (24, 25) in the shielding state when the temperature of the workpiece 10 is a temperature within a predetermined temperature range including the A1 transformation point. The predetermined temperature range described above is set so as to include at least a temperature range not lower than a temperature 50° C. lower than the A1 transformation point and not higher than a temperature 50° C. higher than the A3 transformation point.

According to the heat treatment apparatus 103 of the third modification, based on a temperature measurement result of the workpiece 10, the states of the shielding members (24, 25) are switched. Therefore, the states of the shielding members (24, 25) can be easily switched between the radiation state and the shielding state according to an actual temperature state of the workpiece 10.

Although the embodiment and modifications of the present invention are described above, the present invention is not limited to these, and can be further variously changed. For example, still other modifications as described below may be carried out.

For example, a heat treatment apparatus including both of a workpiece temperature measuring unit to measure a temperature of a workpiece and an atmosphere temperature measuring unit to measure a temperature of the atmosphere at a predetermined measurement position inside the heat treatment chamber. In this case, the control unit may be configured to select either one of the workpiece temperature measuring unit and the atmosphere temperature measuring unit to control the switching drive units.

In the embodiment and the first to third modifications described above, a form in which the metallic workpieces to be subjected to heat treatment by the heat treatment apparatus are ring-shaped members is described by way of example, however, other forms are possible. The shape of the workpiece to be subjected to heat treatment by the heat treatment apparatus is not limited to the ring shape, and may be shapes other than the ring shape, and for example, may be various shapes, for example, a columnar shape, a prism shape, a square tube shape, a rectangular parallelepiped shape, a cubic shape, a rod shape, a plate shape, and shapes having special sectional shapes or surface shapes, etc.

In the embodiment and the first to third modifications described above, a form in which each of the shielding members includes a plurality of shielding plates is illustrated, however, other forms are possible. For example, a form in which each shielding member includes one shielding plate may be carried out. In this case, a form in which by driving the shielding members each consisting of one shielding plate so as to be driven in the up-down direction or the front-rear direction by the switching drive unit, the states of the shielding members are switched between the shielding state and the radiation state, may be carried out.

In the embodiment described above, a form in which the switching drive units (26, 27) switch the states of the shielding members (24, 25) from the radiation state into the shielding state when the temperature measured by the temperature measuring unit 28 reaches a predetermined temperature lower than the A1 transformation point is illustrated, however, other forms are possible. A form in which the switching drive units (26, 27) switch the states of the shielding members (24, 25) from the radiation state into the shielding state when the temperature measured by the temperature measuring unit 28 reaches a temperate equal to the A1 transformation point, may be carried out. A form in which the switching drive units (26, 27) switch the states of the shielding members (24, 25) from the radiation state into the shielding state just after the start of heat treatment of the workpieces 10 inside the heat treatment chamber 21 may also be carried out.

In the second modification, a form in which the heat treatment apparatus including the heaters, the centrifugal fan, and the air current regulation unit applies heat treatment by heating to workpieces is described by way of example. However, other forms are possible, and a form in which no heaters are provided, and the heat treatment apparatus is used for cooling workpieces 10 by air cooling may be carried out. That is, in a heat treatment apparatus not provided with the heaters but including the centrifugal fan and the air current regulation unit, a form in which heat treatment by cooling is applied to workpieces by performing air cooling may be carried out. According to this heat treatment apparatus, when applying heat treatment by cooling workpieces 10 by air cooling, variation in temperature change state among the respective portions of the workpieces when being lowered in temperature during heat treatment can be reduced, and distortion due to the heat treatment can be made smaller.

INDUSTRIAL APPLICABILITY

The present invention can be widely applied as a heat treatment apparatus to apply heat treatment to metallic workpieces.

What is claimed is:

1. A heat treatment apparatus comprising:

a heat treatment chamber having a pair of side walls disposed parallel to each other, a front wall and a rear wall perpendicular to the pair of side walls, a bottom wall, and a ceiling wall, and configured so that a metallic workpiece as a heat treatment target is disposed between the pair of side walls;

a centrifugal fan installed on the ceiling wall and disposed to face the workpiece inside the heat treatment chamber, and configured to generate air current flowing from a lower side to an upper side of the workpiece by sucking gas from the lower side;

a pair of heaters disposed along each of the pair of side walls inside the heat treatment chamber; and an air current regulation unit configured to regulate, in regions at the respective side wall sides relative to an intermediate position between the pair of side walls inside the heat treatment chamber, flows of the air current from the centrifugal fan to the respective side wall sides when the centrifugal fan rotates, so as to restrict the flows of the air current in predetermined regions in a circumferential direction of the centrifugal fan around the centrifugal fan, and allow the flows of the air current in other regions in a circumferential direction of the centrifugal fan around the centrifugal fan, wherein the centrifugal fan and the workpiece are disposed between the pair of heaters, the air current regulation unit is disposed between the pair of heaters and around the centrifugal fan, each of the pair of heaters includes a plurality of heating elements which extend downward from the ceiling wall and are juxtaposed along the respective side walls, the centrifugal fan is configured to flow gas sucked from the lower side outward in radial directions of the centrifugal fan, the air current regulation unit includes air current restricting members disposed in the predetermined regions, and the air current restricting members are disposed in the predetermined regions along the circumferential direction of the centrifugal fan around the centrifugal fan so that air current that flowed outward in radial directions of the centrifugal fan flows toward the respective side walls and the respective heaters while passing through the other regions, and further flows along the plurality of heating elements which are juxtaposed along the respective side walls.

2. The heat treatment apparatus according to claim 1, wherein the heat treatment chamber includes a first side wall and a second side wall as the pair of side walls, the air current regulation unit includes a first air current restricting member and a second air current restricting member as the air current restricting members, the first air current restricting member restricts a flow of the air current from the centrifugal fan to the first side wall side in a region which is at the first side wall side relative to the intermediate position inside the heat treatment chamber and in which outer circumferential edge portions of a rotary blade of the centrifugal fan separate from the first side wall when the rotary blade rotates, and the second air current restricting member restricts a flow of the air current from the centrifugal fan to the second side wall side in a region which is at the second side wall side relative to the intermediate position inside the heat treatment chamber and in which the outer circumferential edge portions of the rotary blade separate from the second side wall when the rotary blade rotates.

3. The heat treatment apparatus according to claim 2, wherein each of the first air current restricting member and the second air current restricting member includes a curved wall surface curved and disposed along an outer circumference of the centrifugal fan.

4. The heat treatment apparatus according to claim 3, wherein a first curved wall surface as the curved wall surface of the first air current restricting member and a second curved wall surface as the curved wall surface of the second air current restricting member are disposed to face each other across the centrifugal fan, and dimensions of the first curved wall surface and the second curved wall surface in the up-down direction are larger than those of the rotary blade of the centrifugal fan.

5. The heat treatment apparatus according to claim 4, wherein the first curved wall surface and the second curved wall surface are provided so as to extend and approach each other toward the outer circumferential edge portions of the rotary blade of the centrifugal fan upward from the lower side.

* * * * *